United States Patent [19]

Hirano et al.

[11] Patent Number: 4,987,052

[45] Date of Patent: Jan. 22, 1991

[54] SILVER HALIDE PHOTOGRAPHIC MATERIAL AND METHOD FOR FORMING SUPERHIGH CONTRAST NEGATIVE IMAGES USING THE SAME

[75] Inventors: Shigeo Hirano; Kazunobu Katoh; Yoshio Inagaki; Nobuaki Inoue, all of Kanagawa, Japan

[73] Assignee: Fuji Photo Film Co., Ltd., Kanagawa, Japan

[21] Appl. No.: 139,230

[22] Filed: Dec. 29, 1987

Related U.S. Application Data

[63] Continuation-in-part of Ser. No. 37,283, Apr. 8, 1987, abandoned.

[30] Foreign Application Priority Data

Apr. 8, 1986 [JP] Japan ..... 61-80640
May 30, 1986 [JP] Japan ..... 61-124830
May 30, 1986 [JP] Japan ..... 61-124831

[51] Int. Cl.[5] ..... G03C 1/16; G03C 1/42

[52] U.S. Cl. ..... 430/264; 430/572; 430/574; 430/576; 430/577

[58] Field of Search ..... 430/264, 949, 572, 574, 430/576, 577

[56] References Cited

U.S. PATENT DOCUMENTS 4,221,857 9/1980 Okutsu et al. ..... 430/264
4,230,796 10/1980 Gunther et al. ..... 430/949
4,328,302 5/1982 Nishimura et al. ..... 430/949
4,332,878 6/1982 Akimura et al. ..... 430/264
4,385,108 5/1983 Takagi et al. ..... 430/264
4,429,036 1/1984 Hirano et al. ..... 430/264
4,447,522 5/1984 Hirano et al. ..... 430/949
4,722,884 2/1988 Inoue et al. ..... 430/949
4,729,946 3/1988 Kasama et al. ..... 430/949
4,737,442 4/1988 Yagihara et al. ..... 430/264
4,740,453 4/1988 Nakamura et al. ..... 430/264
4,755,449 7/1988 Inoue et al. ..... 430/264
4,761,362 8/1988 Sasaoka et al. ..... 430/949
4,786,587 11/1988 Kuwabara ..... 430/264

FOREIGN PATENT DOCUMENTS 0138200 10/1984 European Pat. Off. .
0145293 11/1984 European Pat. Off. .
0164120 6/1985 European Pat. Off. .
0154293 11/1985 European Pat. Off. .

*Primary Examiner*—Richard L. Schilling
*Attorney, Agent, or Firm*—Sughrue, Mion, Zinn, Macpeak & Seas

[57] ABSTRACT

A silver halide photographic material is disclosed, which comprises at least one silver halide emulsion layer on a support, at least one of the emulson layer and other layers contains at least one hydrazine derivative and at least one of these layers contains at least one compound having both a silver halide adsorbing group and an acid group represented by the general formula (I):

C-L-D (I)

wherein C represents a group that enhances adsorption to silver halide, D represents an acid group, and L represents a divalent linking group, and possessing substantially no absorption maximum in the visible region. A method for forming superhigh contrast negative images is also disclosed, comprising imagewise exposing this silver halide photographic material, followed by developing with a developing solution containing sulfite ions in an amount of about 0.15 mol or more per liter and having a pH of about 10.5 to about 12.3.

28 Claims, No Drawings

SILVER HALIDE PHOTOGRAPHIC MATERIAL AND METHOD FOR FORMING SUPERHIGH CONTRAST NEGATIVE IMAGES USING THE SAME

CROSS-RELATED APPLICATION

This is a continuation-in-part of U.S. patent application Ser. No. 037,283 filed Apr. 8, 1987, now abandoned.

FIELD OF THE INVENTION

The present invention relates to silver halide photographic materials, and particularly to negative type silver halide photographic materials and a method for forming superhigh contrast negative images using these materials, and even more particularly to silver halide photographic materials used in photomechanical processes and a method for forming superhigh contrast negative images using the same.

BACKGROUND OF THE INVENTION

It is known that photographic images having very high contrast can be formed using certain silver halides, and a method for forming such photographic images is generally practiced in the field of photomechanical image forming processes.

For example, a method of obtaining line originals or dot images having high contrast and a high optical density where an image portion and a non-image portion are clearly distinguished by treating a lith type silver halide photographic material comprising a silver chlorobromide having a silver chrolide content of at least 50 mol % with a hydroquinone developing solution wherein the effective concentration of sulfite ions is relatively low (generally, up to about 0.1 mol/liter), is known. However, in this type of method, because the concentration of sulfite ions is low, the developer is unstable due to aerial oxidation, and thus, workers in this have made various attempts over the years to stabilize the developer solution.

Therefore, an image forming system has been desired wherein the instability of the image formation due to such a developing method (a lith developing system) is obviated, and development can be effected using a processing solution having a good shelf stability to provide resulting images with superhigh contrast, particularly, having a gamma of about 10 or higher. As described in U.S. Pat. Nos. 4,166,742, 4,168,977, 4,221,857, 4,224,401, 4,243,739, 4,272,606 and 4,311,781, a system has been suggested wherein a surface latent image type (negative type) silver halide photographic material, to which a specific acylhydrazine compound has been incorporated, is treated at a pH of 11.0 to 12.3 with a developing solution containing not less than 0.15 mol of a sulfite preservative per liter and having a good shelf stability to form superhigh contrast negative images having a gamma of higher than 10. Further, this type of image forming system allows both silver iodobromide and silver chloroiodobromide to be used as the silver halide, whereas in prior superhigh contrast image forming methods, only silver chlorobromide having a high content of silver chloride could be employed.

However, in this type of image forming method, when a large amount of film high in optical density is processed, the pH of the processing solution is lowered or the concentration of $Br^{\ominus}$ ions increases, resulting in an undesirable effects on the resulting images, i.e., a decrease in sensitivity and gamma. Although it has been reported that such problems can be lessened by using a hydrazine compound having a ureido group as disclosed in Japanese Patent Application (OPI) No. 67843/81 (the term "OPI" as used herein refers to a "published unexamined Japanese patent application") or using an onium salt or an amine compound as disclosed in Japanese Patent Application (OPI) Nos. 140340/85 and 9347/85, in these methods, because of the very high infectious developability, when a low contrast document, particularly one with fine lines such as Ming-cho type letters, is photographed, even parts that should become white fine parts become blackened, resulting in an illegible image. Such a problem also occurs when photographing a dot image, and thus, white parts among dots are liable to become blackened and the halftone gradation disadvantageously becomes very short.

Further, these methods provide remarkably high sensitivity and high contrast, but at the same time give rise to undesirable "black pepper" due to such infectious development, which is a serious problem in photomechanical processes. The term "black pepper" means black spots composed of fine developed silver grains formed at sections that have not been exposed and therefore are not image sections. In general, black peppers are frequently formed due to a decrease in sulfite ions used in a developing solution as a preservative or by a rise in the pH value of the developer, and greatly lowers the commercial value of the photosensitive material for photomechanical processes. Therefore, intensive efforst have been made to find a solution for this problem, i.e., decreasing the amount of black peppers, but a decrease in the amount of black peppers often also results in a concomitant decrease in sensitivity and gamma. Hitherto, superior methods for decreasing black peppers without interfering with high sensitivity and superhigh contrast effects obtainable by the incorporation of hydrazine derivatives are not known. However, it has been found that although certain sensitizing dyes can prevent black peppers from being formed without decreasing the sensitivity and the gamma since they have substantial absorption maximums in the visible region, undesirable remaining color then becomes a problem when the sensitizing dye remains in the film after the photographic material has been developed, fixed, and washed with water.

SUMMARY OF THE INVENTION

Therefore, an object of the present invention is to provide high sensitivity superhigh contrast silver halide photographic materials that employ a stable developing solution and a method for forming superhigh contrast negative images using the same.

Another object of the present invention is to provide superhigh contrast silver halide photographic materials that form a reduced amount of black peppers, and a method for forming superhigh contrast negative images using the same.

Still another object of the present invention is to provide superhigh contrast silver halide photographic materials that are improved with respect to eliminating undesired remaining color after development, and a method for forming superhigh contrast negative images using the same.

A further object of the present invention is to provide silver halide photographic materials whose exposure latitude is wide, particularly on the high exposure side, when photographing line originals and halftone images, and a method for forming superhigh contrast negative images using the same.

A still further object of the present invention is to provide silver halide photographic materials wherein the photographic characteristics of sensitivity, gamma and maximum density ($D_{max}$) undergo less of a decrease if the concentration of bromine ions increases or the pH is not lowered in the doveloper solution when a large amount of film is processed, and a method for forming superhigh contrast negaitve images using the same.

The above objects are able to be attained by providing a silver halide photographic material comprising at least one silver halide emulsion layer on a support wherein at least one of the emulsion layer and other constituting layers of the photographic material contains at least one hydrazine derivative and at least one of the emulsion layer and the other constituting layers contains at least one of the following compounds having both a silver halide adsorbing group and an acid group as represented by the general formula (I):

C-L-D (I)

wherein C represents a group that enhances adsorption to a silver halide, D represents an acid group, and L represents a divalent linking group, and possessing substantially no absorption maximum in the visible region, and by providing a method for forming superhigh contrast negative images, wherein the silver halide photographic material described above is imagewise exposed, and subsequently developed with a developing solution containing sulfite ions in an amount of about 0.15 mol or more per liter and having a pH of about 10.5 to about 12.3.

DETAILED DESCRIPTION OF THE INVENTION

It has unexpectedly been found that the compounds of the general formula (I) of the present invention soften halftone gradation, improve the latitude of a line image and decrease the amount of black peppers without interfering with the sensitization, the superhigh contrasting action and the effect seen when using hydrazine derivatives to treat the exposure latitude for a low active developing solution.

The compounds of the general formula (I) are preferably added to the layer containing a hydrazine derivative, although they may be added to another layer.

Preferably, hydrazine derivatives used in the present invention have a structure represented by the general formula (II):

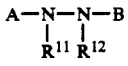

(II)

wherein A represents an aliphatic group or an aromatic group, B represents a formyl group, an acyl group, an alkylsulfonyl group, an arylsulfonyl group, an alkylsulfinyl group, an arylsulfinyl group, a carbamoyl group, a sulfamoyl group, an alkoxycarbonyl group, an aryloxycarbonyl group, a sulfinamoyl group, an alkoxysulfonyl group, a thioacyl group, a thiocarbamoyl group, or a heterocyclic group, $R^{11}$ and $R^{12}$ both represent a hydrogen atom or one of $R^{11}$ and $R^{12}$ represents a hydrogen atom and the other represents a substituted or unsubstituted alkylsulfonyl group, a substituted or unsubstituted arylsulfonyl group or a substituted or unsubstituted acyl group, and B, $R^{12}$ and the nitrogen atom to which they are joined may form a partial structure

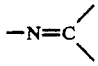

of hydrazone, or the general formula (III):

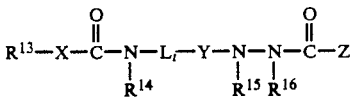

(III)

wherein $R^{13}$ represents an organic group having 30 or less carbon atoms, X represent —$NR^{17}$— or O, L represents a divalent organic linking group, Y represents a substituted or unsubstituted phenylene group or a naphthylene group, Z represents a hydrogen atom, an aliphatic group or an aromatic group, $R^{14}$ and $R^{17}$, which may be the same or different, each represents a hydrogen atom or an aliphatic group, $R^{15}$ and $R^{16}$ both represent a hydrogen atom or one of $R^{15}$ and $R^{16}$ represents a hydrogen atom and the other represents an alkylsulfonyl group, an arylsulfonyl group, or an acyl group, and i is 0 or 1.

The hydrazines represented by the general formula (III) are preferred.

The hydrazines represented by the general formula (II) will be described in further detail below.

Aliphatic groups represented by A in the general formula (II) preferably contain 1 to 30 carbon atoms and, in particular, straight chained, branched or cyclic alkyl groups having 1 to 20 carbon atoms. The branched alkyl groups may be cyclized to form a saturated heterocyclic ring containing one or more hetero atoms. The alkyl groups may have a substituent such as an aryl group, an alkoxyl group, a sulfoxy group, a sulfonamido group, a carbonamido group, etc. Specific examples thereof are a t-butyl group, an n-octyl group, a t-octyl group, a cyclohexyl group, a pyrrolidyl group, an imidazolyl group, a tetrahydrofuryl group, a morpholino group, etc.

The aromatic groups represented by A in the general formula (II) include monocyclic or bicyclic aryl groups or unsaturated heterocyclic groups. The unsaturated heterocyclic groups may form heteroaryl groups by condensing with monocyclic or bicyclic aryl groups. Examples thereof are heteroaryl groups containing a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, or the like.

More preferably, A represents an aryl group.

The aryl groups or unsaturated heterocyclic groups represented by A may also have a substituent. Typical examples of suitable substituents include a straight chained, branched or cyclic alkyl group (preferably having 1 to 20 carbon atoms), an aralkyl group (preferably a monocyclic or bicyclic aralkyl group having 1 to 3 carbon atoms in the alkyl moiety), an alkoxy group (preferably having 1 to 20 carbon atoms), a substituted amino group (preferably having a $C_1$–$C_{20}$ alkyl substituent), an acylamino group (preferably having 2 to 30 carbon atoms), a sulfonamido group (preferably having 1 to 30 carbon atoms), a ureido group (preferably having 1 to 30 carbon atoms), etc.

A in the general formula (II) may further contain a ballast group commonly used in photographic additives such as couplers, in order to render the compounds nondiffusible. The ballast groups are photographically relatively inactive groups having not less than 8 carbon atoms, and can be selected from, for example, an alkyl group, an alkoxy group, a phenyl group, an alkylphenyl group, a phenoxy group, an alkylphenoxy group, etc.

A in the general formula (II) may also contain a group for enhancing adsorption to the surfaces of silver halide grains. Suitable adsorbing groups include a thiourea group, a heterocyclic thioamido group, a mercapto heterocyclic group, a triazole group, etc., as disclosed in U.S. Pat. Nos. 4,385,108 and 4,459,347, Japanese Patent Application (OPI) Nos. 195233/84, 200231/84, 201045/84, 201046/84, 201047/84, 201048/84, 201049/84, 179734/85, and 170733/86, U.S. patent application Ser. No. 826,153 (filed on Feb. 4, 1987), etc.

Examples of B in the general formula (II) are a formyl group, an acyl group (e.g., an acetyl group, a propionyl group, a trifluoroacetyl group, a chloroacetyl group, a benzoyl group, a 4-chlorobenzoyl group, a pyruvoyl group, a methoxalyl group, a methyloxamoyl group, etc.), an alkylsulfonyl group (e.g., a methanesulfonyl group, a 2-chloroethanesulfonyl group, etc.), an arylsulfonyl group (e.g., a benzenesulfonyl group, etc.), an alkylsulfinyl group (e.g., a methanesulfinyl group, etc.), an arylsulfinyl group (e.g., a benzenesulfinyl group, etc.), a carbamoyl group (e.g., a methylcarbamoyl group, a phenylcarbamoyl group, etc.), a sulfamoyl group (e.g., a dimethylsulfamoyl group, etc.), an alkoxycarbonyl group (e.g., a methoxycarbonyl group, a methoxyethoxycarbonyl group, etc.), an aryloxycarbonyl group (e.g., a phenoxycarbonyl group, etc.), a sulfinamoyl group (e.g., a methylsulfinamoyl group, etc.), an alkoxysulfonyl group (e.g., a methoxysulfonyl group, an ethoxysulfonyl group, etc.), a thioacyl group (e.g., a methylthiocarbonyl group, etc.), a thiocarbamoyl group (e.g., a methylthiocarbamoyl group, etc.) or a heterocyclic group (e.g , a pyridine ring group, etc.).

B particularly preferably represents a formyl group or an acyl group.

B in the general formula (II) may, together with $R^{12}$ and the nitrogen atom to which $R^{12}$ is bonded, form a partial structure

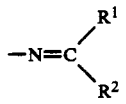

of hydrazine, in which $R^1$ represents an alkyl group, an aryl group or a heterocyclic group, and $R^2$ represents a hydrogen atom, an alkyl group, an aryl group or a heterocyclic group.

$R^{11}$ and $R^{12}$ in the general formula (II) each preferably represents a hydrogen atom, a substituted or unsubstituted alkylsulfonyl or arylsulfonyl group having 20 or less carbon atoms (preferably a phenylsulfonyl group or a substituted phenylsulfonyl group where the sum of the Hammett substituent constants is −0.5 or more), or a substituted or unsubstituted acyl group having 20 or less carbon atoms (preferably a benzoyl group or a substituted benzoyl group where the sum of the Hammett substituent constants is −0.5 or more, or a straight chained, branched or cyclic substituted or unsubstituted aliphatic acyl group). Examples of the substituents of $R^{11}$ and $R^{12}$ in the general formula (II) are a halogen atom, an ether group, a sulfonamido group, a carbonamido group, a hydroxyl group, a carboxyl group, and a sulfonic acid group.

Most preferably, both $R^{11}$ and $R^{12}$ represent a hydrogen atom.

Of the hydrazines represented by the general formula (II), particularly preferable hydrazines are o those represented by the following general formula (II'):

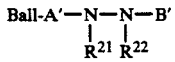

(II')

wherein A', B', $R^{21}$, and $R^{22}$ are the same as defined for A, B, $R^{11}$, and $R^{12}$ of the general formula (II), respectively, and Ball represents a ballast group which is relatively photographically deactive and which has 8 or more carbon atoms.

In the general foamula (II'), the ballast group is preferably the group which can be used in a coupler, and examples of the ballast group are shown below:

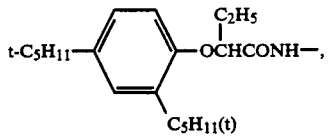

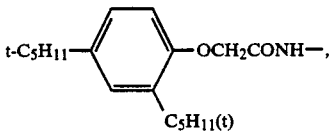

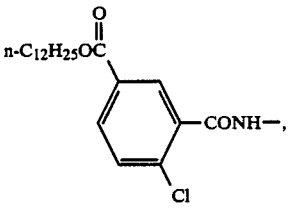

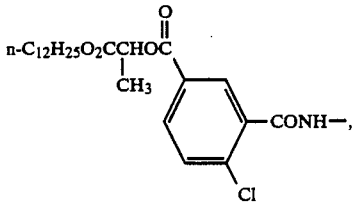

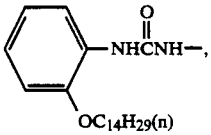

-continued
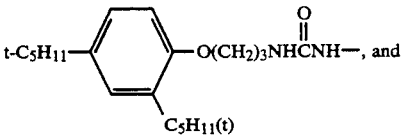
-continued
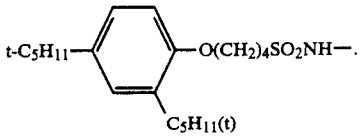
Examples of compounds represented by the general formula (II) are shown below, but the present invention is not to be construed as being limited to these compounds.
(II-1)
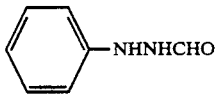
(II-2)
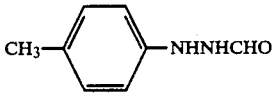
(II-3)
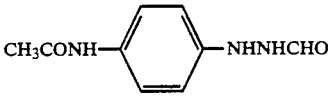
(II-4)
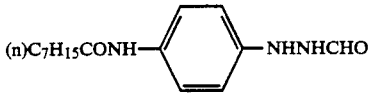
(II-5)
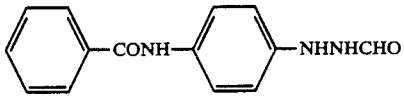
(II-6)
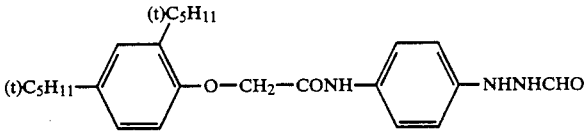
(II-7)
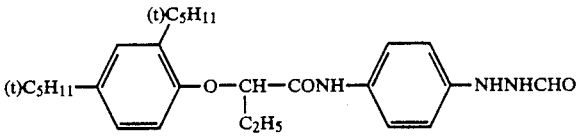
(II-8)
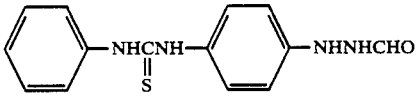
(II-9)
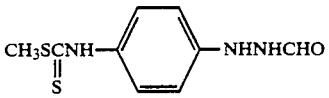
(II-10)
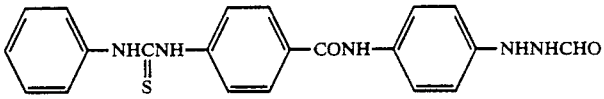

-continued
(II-11)
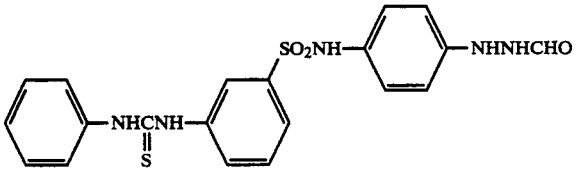
(II-12)
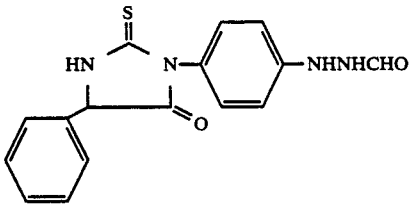
(II-13)
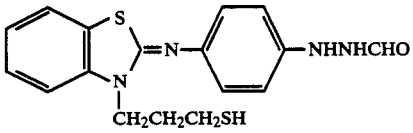
(II-14)
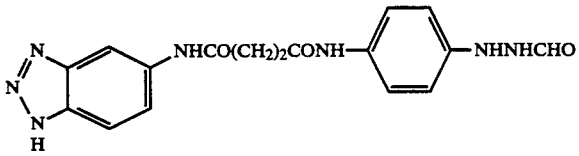
(II-15)
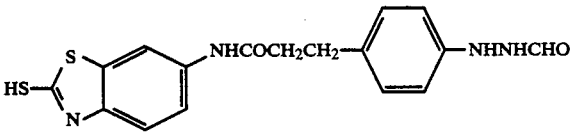
(II-16)
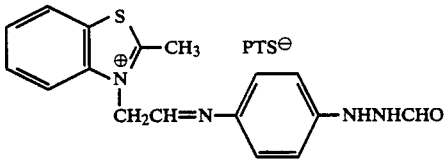
(II-17)
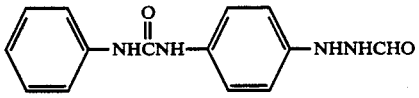
(II-18)
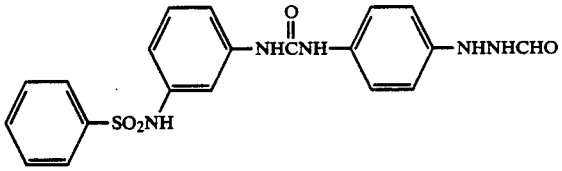
(II-19)
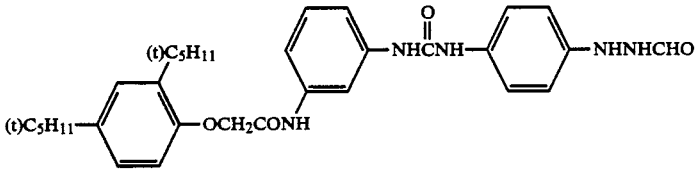

-continued
(II-20)
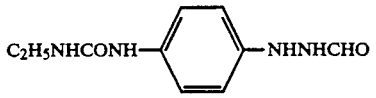
(II-21)
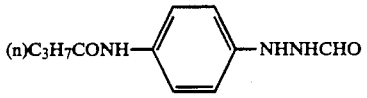
(II-22)
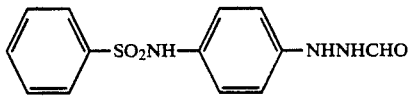
(II-23)
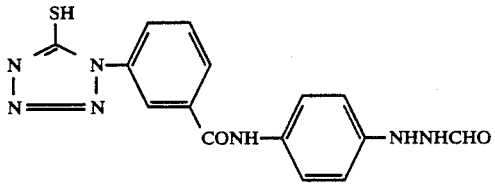
(II-24)
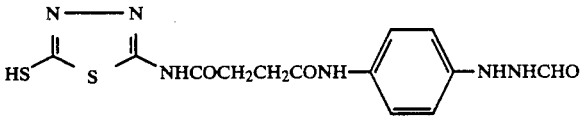
(II-25)
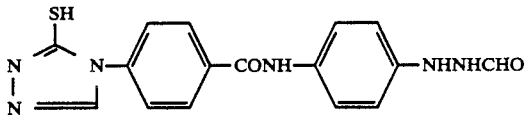
(II-26)
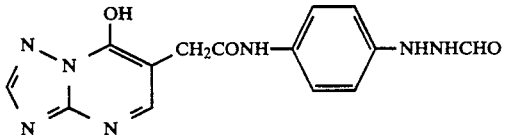
(II-27)
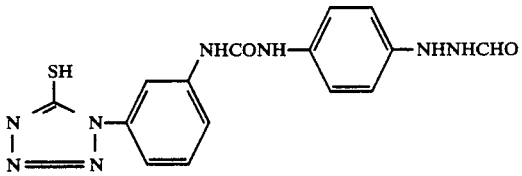
(II-28)
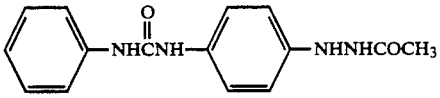
(II-29)
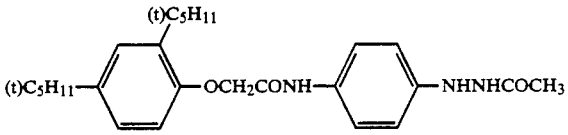
(II-30)
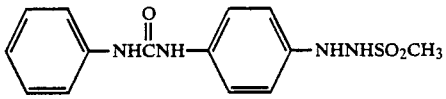

-continued
(II-31)
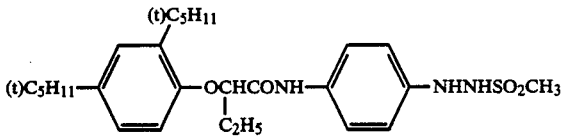
(II-32)
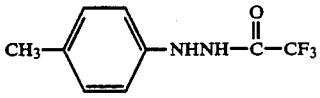
(II-33)
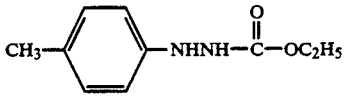
(II-34)
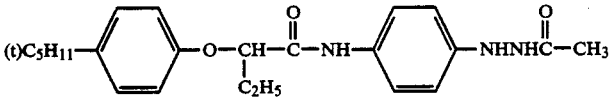
(II-35)
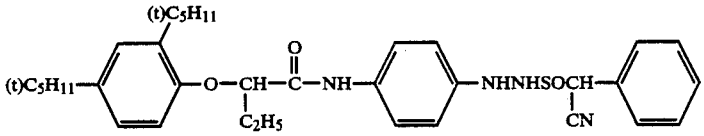
(II-36)
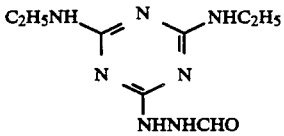
(II-37)
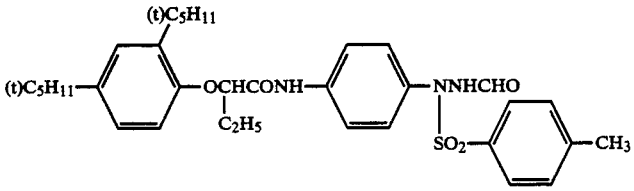
(II-38)
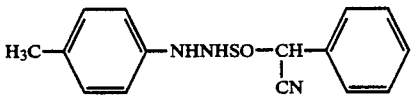
(II-39)
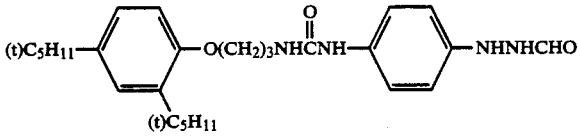
(II-40)
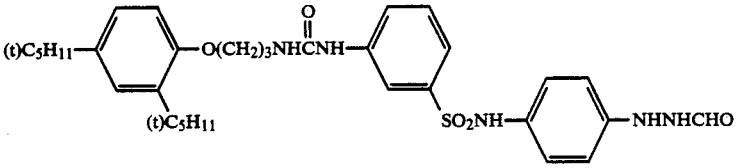
(II-41)
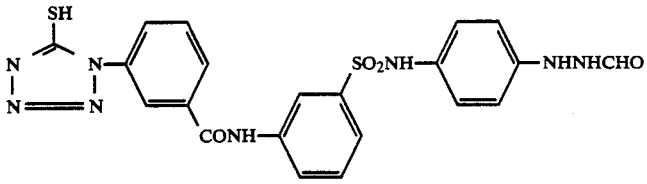

-continued

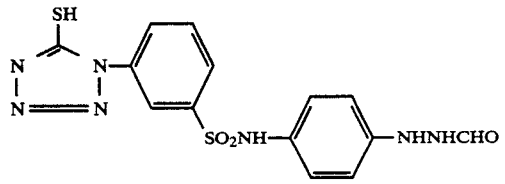

(II-42)

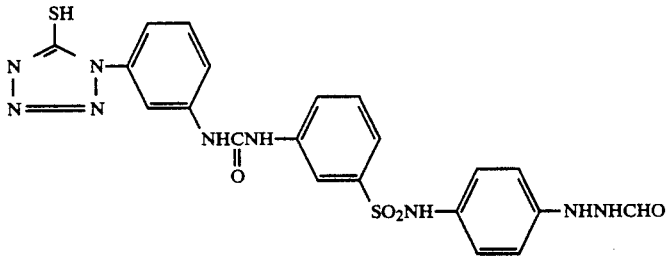

(II-43)

Methods of synthesizing compounds represented by the general formula (II) used in the present invention are described in Japanese Patent Application (OPI) Nos. 20921/78, 20922/78, 66732/78 and 20318/78, U.S. Pat. Nos. 4,459,347 and 4,478,928, etc.

Preferably, a hydrazine derivative of the general formula (II) used in the present invention is present in an amount of about $1\times10^{-6}$ to about $5\times10^{-2}$ mol, more preferably $1\times10^{-5}$ to $2\times10^{-2}$ mol, per mol of total silver halide.

Hydrazine derivatives of the general formula (III) will be described in detail below.

Examples of organic groups represented by $R^{13}$ in the general formula (III) include a substituted or unsubstituted alkyl group, a substituted or unsubstituted phenyl group, a substituted or unsubstituted naphthyl group, and a substituted or unsubstituted heterocyclic group (preferably a 5- or 6-membered heterocyclic group containing at least one O, N or S atom, which may form a condensed ring with a benzene ring or another heterocyclic ring).

$R^{13}$ preferably represents an aliphatic, aromatic, or heterocyclic group having 30 or less carbon atoms.

$R^{13}$ more preferably has 20 or less carbon atoms.

Examples of substituents of $R^{13}$ in the general formula (III) include a straight chained, branched or cyclic alkyl group (preferably having 1 to 20 carbon atoms), an aralkyl group (preferably a monocyclic or bicyclic aralkyl group having 1 to 3 carbon atoms in the alkyl moiety), an alkoxy group (preferably having 1 to 20 carbon atoms), a mono- or disubstituted amino group (preferably an amino group substituted by an alkyl, acyl, alkylsulfonyl, or arylsulfonyl group having 1 to 20 carbon atoms and when the amino group is disubstituted, the sum of the carbon atoms of the substituents is 20 or less), a mono-, di- or trisubstituted or unsubstituted ureido group (preferably having 1 to 29 carbon atoms), a substituted or unsubstituted aryl group (preferably a monocyclic or bicyclic aryl group having 6 to 29 carbon atoms), a substituted or unsubstituted arylthio group (preferably having 6 to 29 carbon atoms), a substituted or unsubstituted alkylthio group (preferably having 1 to 29 carbon atoms), a substituted or unsubstituted alkylsulfinyl group (preferably having 1 to 29 carbon atoms), a substituted or unsubstituted arylsulfinyl group (which is preferably monocyclic or bicyclic having 6 to 29 carbon atoms), a substituted or unsubstituted alkylsulfonyl group (preferably having 1 to 29 carbon atoms), a substituted or unsubstituted arylsulfonyl group (which is preferably monocyclic or bicyclic having 6 to 29 carbon atoms), an aryloxy group (which is preferably monocyclic or bicyclic having 6 to 29 carbon atoms), a carbamoyl group (preferably having 1 to 29 carbon atoms), a sulfamoyl group (preferably having 1 to 29 carbon atoms), a hydroxyl group, a halogen atom (e.g., F, Cl, Br and I), a sulfonic acid group, a carboxylic acid group, etc.

These above-noted substituents may be further substituted by the following substituents: an alkyl group having 1 to 20 carbon atoms, an aryl group (which is monocyclic or bicyclic having 6 to 20 carbon atoms), an alkoxy group having 1 to 20 carbon atoms, an aryloxy group having 6 to 20 carbon atoms, an alkylthio group having 1 to 20 carbon atoms, an arylthio group having 6 to 20 carbon atoms, an alkylsulfonyl group having 1 to 20 carbon atoms, an arylsulfonyl group having 6 to 20 carbon atoms, a carbonamido group having 1 to 20 carbon atoms, a sulfonamido group having 0 to 20 carbon atoms, a carbamoyl group having 1 to 20 carbon atoms, a sulfamoyl group having 1 to 20 carbon atoms, an alkylsulfinyl group having 1 to 20 carbon atoms, an arylsulfinyl group having 1 to 20 carbon atoms, an ester group having 2 to 20 carbon atoms, a hydroxyl group, —COOM or —$SO_2M$ (wherein M represents a hydrogen atom or an alkali metal atom or substituted or unsubstituted ammonium), or a halogen atom (F, Cl, Br or I). These substituents may be bonded together to form a ring.

The divalent organic linking group represented by L is a straight chained, branched or cyclic alkylene group having 1 to 20 carbon atoms, a phenylene group or aralkylene group having 7 to 20 carbon atoms or a divalent group having 1 to 20 carbon atoms formed by connecting —O—, —S—, —CO—, —CONH—, —$SO_2$NH— or —COO— to one of these groups.

In the general formula (III), Y represents a phenylene group or a naphthylene group, and Z represents a hydrogen atom, an aliphatic group or an aromatic group. Suitable aliphatic groups represented by Z include an alkyl group having 1 to 20 carbon atoms, an alkenyl group having 2 to 20 carbon atoms, an alkynyl group having 2 to 20 carbon atoms, and a cycloalkyl group having 3 to 20 carbon atoms. Suitable aromatic groups include a phenyl group and a naphthyl group having 6 to 20 carbon atoms.

Substituents for Y and Z may be the same as described above for $R^{13}$. Preferably, Z is a hydrogen atom.

$R^{14}$ and $R^{17}$, which may be the same or different, each represents a hydrogen atom or an aliphatic group. Aliphatic groups for $R^{14}$ and $R^{17}$ may be the same as described above for Z.

$R^{15}$ and $R^{16}$ both represent a hydrogen atom, or one of them represents a hydrogen atom and the other represents an alkylsulfonyl group, an arylsulfonyl group or an acyl group. Preferably, both $R^{15}$ and $R^{16}$ represent a hydrogen atom.

Particularly preferably, X represents $-NR^{17}$.

Examples of compounds represented by the general formula (III) are shown below; however, the present invention is not to be construed as being limited to these compounds.

(III-1)

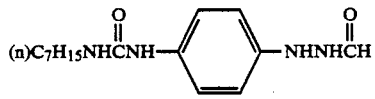

(III-2)

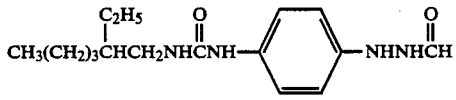

(III-3)

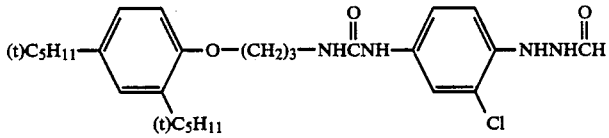

(III-4)

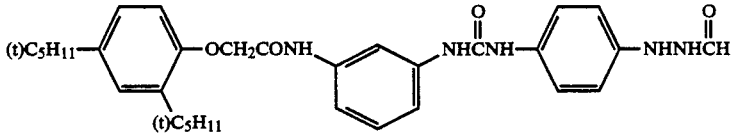

(III-5)

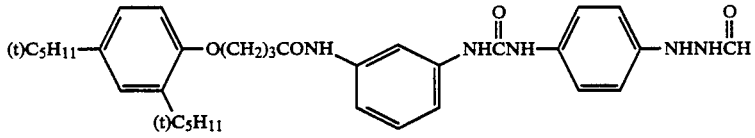

(III-6)

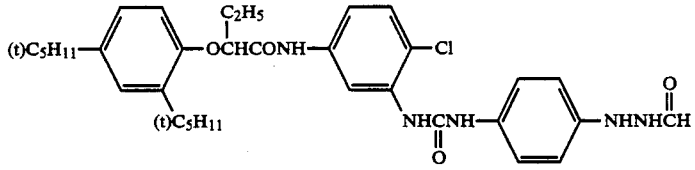

(III-7)

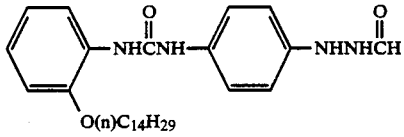

(III-8)

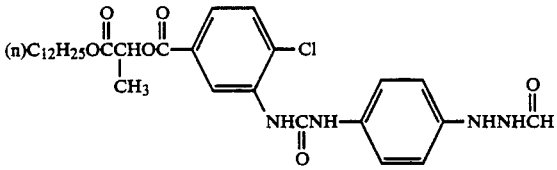

-continued
(III-9)
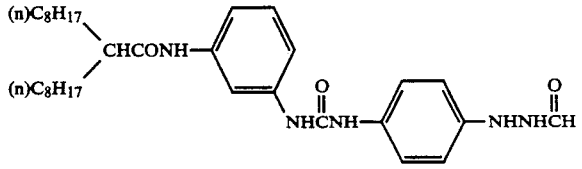
(III-10)
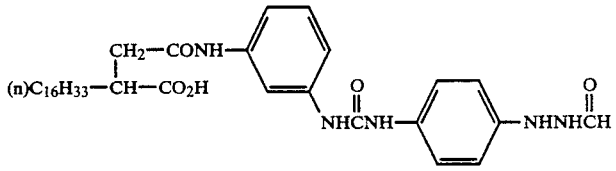
(III-11)
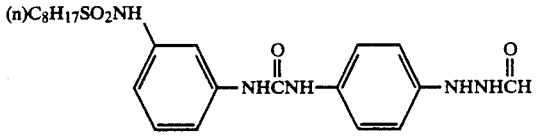
(III-12)
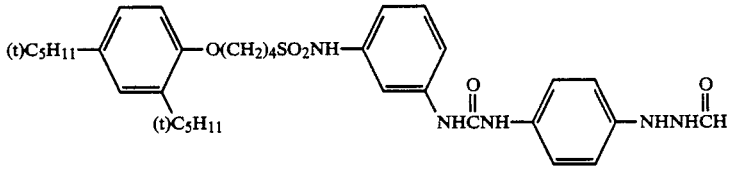
(III-13)
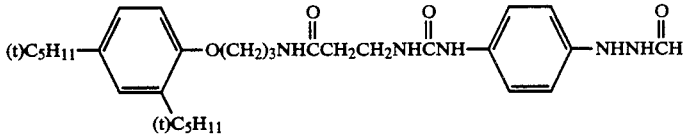
(III-14)
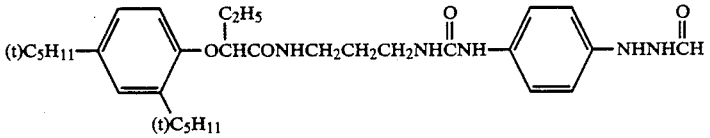
(III-15)
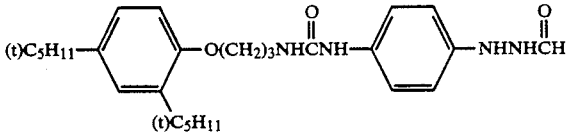
(III-16)
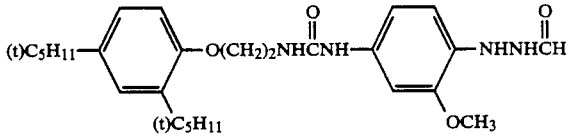
(III-17)
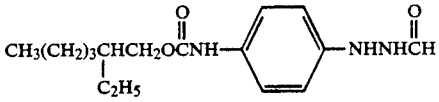
(III-18)
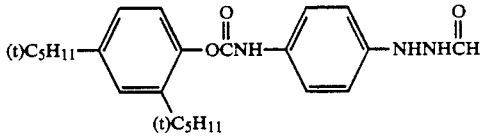

-continued
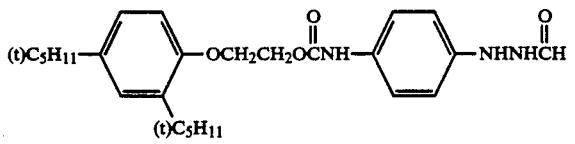
(III-19)
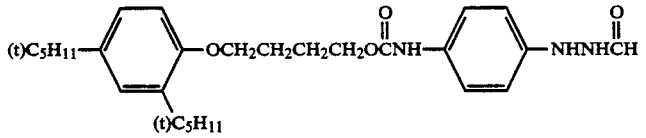
III-20)
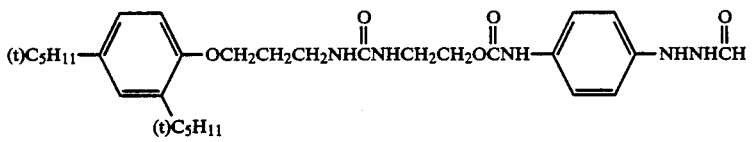
(III-21)
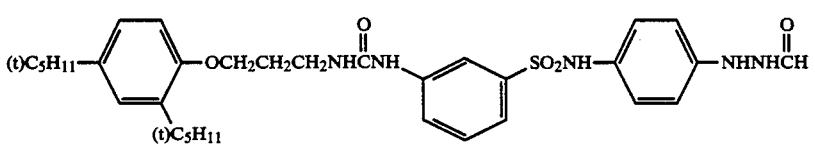
(III-22)
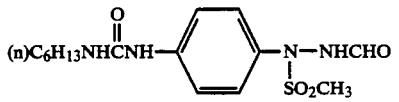
(III-23)
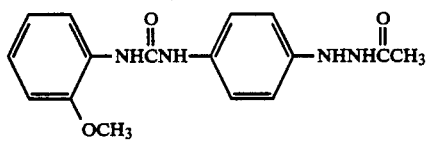
(III-24)
(III-25)
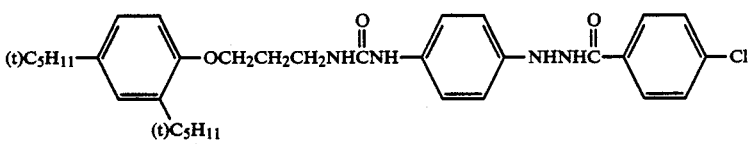
(III-26)
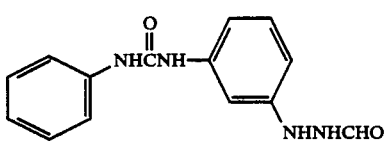
(III-27)
Hydrazine derivatives represented by the general formula (III) can be synthesized in accordance with the methods described in Japanese Patent Application (OPI) No. 67843/81 and U.S. Pat. No. 4,560,638.
For example, if X in the general formula (III) is —$NR^{17}$—, the following two methods can be used:
(i)
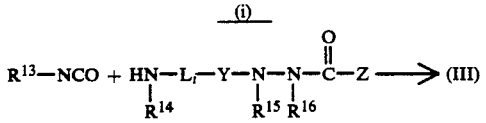
-continued
or
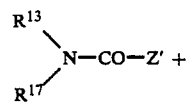
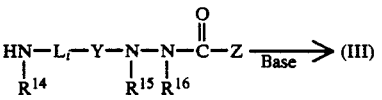

-continued

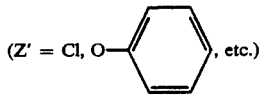

(ii)

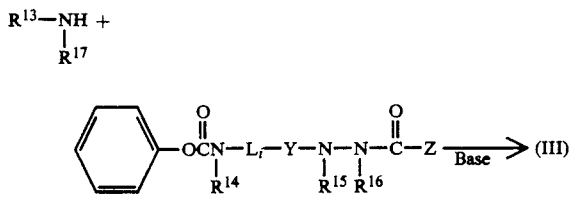

Preferably, a hydrazine derivative of the general formula (III) used in the present invention is present in an amount of about $1\times10^{-6}$ to about $5\times10^{-2}$ mol, more preferably $1\times10^{-5}$ to $2\times10^{-2}$ mol, per mol of total silver halide.

When a hydrazine derivative used in the present invention is incorporated in a photographic material, it may be added in the form of an aqueous solution to a silver halide emulsion or a hydrophilic colloid solution if it is soluble in water, or it may be added in the form of a solution of an organic solvent miscible with water such as alcohols (e.g., methanol, ethanol, etc.), esters (e.g., ethyl acetate), ketones (e.g., acetone), etc., to a silver halide emulsion or a hydrophilic colloid solution if it is insoluble in water.

Hydrazine derivatives used in the present invention may be used alone or in combination.

The hydrazine derivatives may be added to a silver halide emulsion layer or other hydrophilic colloid layer(s), with the proviso that the hydrazine derivative is contained in at least one of these layers.

Although processes for the production of examples of compounds having the general formula (III) are described below, other compounds within the scope of the general formula (III) can be synthesized in a similar way.

SYNTHESIS EXAMPLE 1

(1) Synthesis of 2-{4-[3-(3-Nitrophenyl)ureido]phenyl}-1-formylhydrazine 200 ml of acetonitrile and 200 ml of N,N-dimethylformamide were added to 60.4 g of 2-(4-aminophenyl)-1-formylhydrazine to be dissolved, followed by cooling to −5° C. 65.6 g of metanitrophenyl isocyanate dissolved in 200 ml of acetonitrile was added dropwise thereto. During this dropwise addition, the solution was cooled with stirring so that the temperature thereof would not exceed −5° C. A further 300 ml of acetonitrile was added at 0° C., and after stirring for 3 hours, formed crystals were filtered and washed with acetonitrile and then with methanol. The thus-obtained crystals were dissolved in 1 liter of N,N-dimethylformamide, the undissolved portion was filtered off, and 3 liters of methanol was added to the filtrate, followed by cooling to form crystals. The thus-formed crystals were then filtered and washed with acetonitrile and then methanol. The yield was 98.5 g.

(2) Synthesis of 2-{4-[3-(3-aminophenyl)ureido]phenyl}-1-formylhydrazine 138 g of iron powder, 5 g of ammonium chloride, 2.45 liters of dioxane and 985 ml of water were mixed and heated on a steam bath with stirring. 98 g of the nitro compound obtained under Step (1) above was added thereto, and the mixture was refluxed for 40 minutes. The undissolved matter was filtered off, and after the filtrate was condensed under reduced pressure, water was added. The thus-formed crystals were filtered and washed with acetonitrile. The yield was 79 g.

(3) Synthesis of Hydrazine Derivative (III-4)

4 g of the amino compound obtained under Step (2) above was dissolved in 20 ml of N,N-dimethylacetamido, and 20 ml of acetonitrile and 1.4 g of triethylamine were added thereto,followed by cooling to −5° C. 4.4 g of (2,4-di-tert-pentylphenoxy)acetylchloride was added thereto dropwise, during which time the mixture was cooled with stirring so that the temperature thereof would not exceed 0° C. The stirring was continued at 0° C. for 1 hour, and then at room temperature for 2 hours, and the mixture was poured into water to effect crystalization. The crystals were filtered and recrystallized from acetonitrile. The yield was 4.8 g and the crystals had a melting point of 152° to 154° C.

SYNTHESIS EXAMPLE 2

Synthesis of Hydrazine Derivative (III-5)

60 ml of N,N-dimethylacetamide, 60 ml of acetonitrile and 4.01 g of triethylamine were added to 11.4 g of the amino compound obtained under Step (2) of Synthesis Example 1, and the solution was cooled to 0° C. 13.5 g of 4-(2,4-di-tert-pentylphenoxy)butyroylchloride was added dropwise thereto. During that time, the mixture was cooled with stirring so that the temperature thereof would not exceed 5° C. After the stirring was continued for a further 1.5 hours, water was added to effect crystallization. The crystals were filtered and recrystallized from acetonitrile. The yield was 11.2 g and the melting point was 207° to 209° C.

SYNTHESIS EXAMPLE 3

Synthesis of Hydrazine Derivative (III-13)

10 ml of N,N-dimethylacetamide and 0.9 ml of triethylamine were added to 2.5 g of 3-[3-(2,4-di-t-pentylphenoxy)propylcarbamoylamino]propionic acid and the solution was cooled to −15° C. After 0.61 ml of ethyl chloroformate was added dropwise to the resulting solution in such a manner that the temperature thereof would not exceed −5° C., the solution was stirred for 15 minutes at −10° C. Then 0.97 g of 2-(4-aminophenyl)-1-formylhydrazine dissolved in 7 ml of N,N-dimethylacetamide was added thereto. After the mixture was stirred at −30° C. for 30 minutes, it was stirred for 30 minutes at room temperature, and an ice-cooled 2% aqueous solution of sodium hydrogencarbonate was poured thereinto. The resulting crystals were filtered, washed with water and then recrystallized from 25 ml of acetonitrile. The yield was 1.9 g and the melting point was 181.5° C.

SYNTHESIS EXAMPLE 4

Synthesis of Hydrazine Derivative (III-15)

300 ml of N,N-dimethylacetamide, 30 ml of triethylamine and 58.3 g of 3-(2,4-di-tert-pentylphenoxy)-propylamine were added to 54.2 g of 2-(4-phenoxycarbonylaminophenyl)-1-formylhydrazine synthesized from phenyl chloroformate and 2-(4-aminophenyl)-1-formylhydrazine and the solution was heated at 60° C. for 1 hour with stirring. After the reaction mixture was cooled to 30° C., it was poured into a mixture of 900 ml of hydrochloric acid (0.5 mol/liter) with 700 ml of ethyl acetate. The organic layer was separated, condensed and then dissolved in 350 ml of acetonitrile. Then 1 liter of water was added to effect crystallization, and the resulting crystals were filtered and washed with water. The crystals were then dissolved in 600 ml of acetonitrile by heating, and after 3 g of activated carbon was added, the mixture was filtered while it was hot. After the filtrate was cooled to room temperature, the filtrate was stirred for 1 hour, then cooled with ice and was stirred until the temperature became 5° C. The resulting crystals were filtered off and washed with 150 ml of acetonitrile. The yield was 69.2 g and the melting point was 158° to 160° C.

SYNTHESIS EXAMPLE 5

Synthesis of Hydrazine Derivative (III-22)

To 2.3 g of trichloromethyl chloroformate dissolved in 50 ml of ethyl acetate were added dropwise 6.5 g of 3-(2,4-di-tert-amylphenoxy)propylamine and 4.5 g of triethylamine dissolved in 10 ml of ethyl acetate with stirring and cooling with ice. After the mixture was reacted for 2 hours at room temperature, the solid was filtered, and the filtrate was condensed. The condensed filtrate was reacted with 2-(4-aminophenyl)-1-formylhydrazine and chlorinated m-nitrobenzenesulfonyl, then 6.7 g of 2-(3-aminobenzenesulfonamidophenyl)-1-formylhydrazine that had been obtained by neutral reduction in iron powder was added thereto, and the resulting mixture was heated and stirred in 30 ml of dimethylformamide at 30° C. After reacting for 2 hours, the rubbery solid that had been separated by adding water was separated and refined by silica gel column chromatography (the developing solvent: a mixed solvent of chloroform and methanol; the ratio: changed from 20/1 to 10/1) to obtain the intended product. The yield was 4.5 g (33% of the theoretical yield), and the melting point was 120° C.

SYNTHESIS EXAMPLE 6

Synthesis of Hydrazine Derivative (III-10)

8.6 g of the amino compound obtained under Step (2) of Synthesis Example 1 and 9.7 g of hexadecylsuccinic anhydride were dispersed in 100 ml of acetic acid and the reaction was effected at 50° C. for 10 hours. The mixture was allowed to cool, the resulting crystals were filtered off, 30 ml of dimethylformamide and 0.5 g of activated carbon were added to the crystals, followed by heating to dissolve the crystals, and the remaining mixture was filtered. 120 ml of acetonitrile was added to the filtrate, and the thus-formed crystals were filtered off to obtain the desired product in an amount of 9.9 g. The thermal decomposition point was 183° to 185° C.

SYNTHESIS EXAMPLE 7

Synthesis of Hydrazine Derivative (III-12)

30 ml of N,N-dimethylacetamide, 30 ml of acetonitrile and 4.4 g of triethylamine were added to 8.6 g of the amino compound obtained under Step (2) of Synthesis Example 1 and the resulting solution was cooled with ice to 3° C. 16.3 g of 4-(2,4-di-tert-pentylphenoxy)-butanesulfonylchloride was added dropwise to the solution and the solution then was allowed to react for 3 hours while cooling with ice. 150 ml of water was added to the reaction mixture, and the separated waxy matter was subjected to silica gel column chromatography (the developing solvent: a mixed solution of ethyl acetate with hexane; the mixed ratio: 1/10 - 1/1 - 1/10) to purify it. The obtained solid was dissolved in 40 ml of ethanol, the mixture was filtered, and then 100 ml of hexane was added to effect recrystallization. The desired product was obtained in an amount of 4.9 g. The decomposition point was 140° to 143° C.

Hydrazine derivatives described in the following publications can be used together with hydrazine derivatives represented by the above general formulae (II) and (III), if desired: *Research Disclosure,* No. 23516 (November, 1983), page 346 and publications disclosed therein, U.S. Pat. Nos. 4,080,207, 4,269,929, 4,276,364, 4,278,748, 4,385,108, 4,459,347, 4,560,638 and 4,478,928, British Patent 2,011,391B, and Japanese Patent Application (OPI) No. 179734/85.

At least one of the amine compounds or quaternary onium salts described below may be present together with a hydrazine derivative.

Amine compounds that can be used in the present invention in this manner are preferably compounds having the following general formula (A):

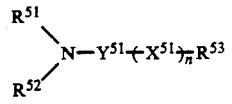

(A)

wherein $R^{51}$ and $R^{52}$, which may be the same or different, each represents a substituted or unsubstituted alkyl group having 1 to 30 carbon atoms (the alkyl group may be straight chained, branched or cyclic), and $R^{51}$ and $R^{52}$ may be bonded to form a ring that may be a saturated heterocyclic ring containing one or more hetero atoms (e.g., an oxygen atom, a sulfur atom, a nitrogen atom, etc.). Specific examples of $R^{51}$ and $R^{52}$ are a methyl group, an ethyl group, an isopropyl group, an n-butyl group, an n-octyl group, a t-octyl group, a cyclohexyl group, a pyrrolidyl group, a morpholino group, etc.

Suitable substituents for $R^{51}$ and $R^{52}$ include an aryl group (preferably having 6 to 20 carbon atoms), an alkoxy group (preferably having 1 to 20 carbon atoms), a sulfo group, a sulfonamido group (preferably an alkylsulfonamido group having 1 to 20 carbon atoms or an arylsulfonamido group having 6 to 20 carbon atoms), a carbonamido group (preferably an alkylcarbonamido group having 2 to 20 carbon atoms or an arylcarbonamido group having 7 to 20 carbon atoms), and a ureido group (preferably an alkylureido group having 1 to 20 carbon atoms or an arylureido group having 6 to 20 carbon atoms).

In the general formula (A), $R^{53}$ represents a substituted or unsubstituted alkyl group having 1 to 30 carbon atoms (e.g., a methyl group, an ethyl group, an n-butyl group, an n-octyl group, an n-dodecyl group, an n-hexadecyl group, a t-butyl group, a cyclohexyl group, etc.), a substituted or unsubstituted aryl group having 6 to 30 carbon atoms (e.g., a phenyl group, a naphthyl group, etc.), or a substituted or unsubstituted heterocyclic group (including a 5-, 6- or 7-membered heterocyclic group containing one or more nitrogen, oxygen or sulfur atoms or the like, to which group a condensed ring is attached at a suitable position, for example, a pyridine ring, a pyrimidine ring, an imidazole ring, a quinoline ring, an isoquinoline ring, a benzimidazole ring, a thiazole ring, a benzothiazole ring, etc.).

Suitable substituents for $R^{53}$ include a halogen atom (e.g., fluorine, chlorine, or bromine), an alkyl group (preferably having 1 to 20 carbon atoms), an aryl group (preferably having 6 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably having 6 to 20 carbon atoms), an acyl group (preferably having 2 to 20 carbon atoms), an acylamino group (preferably an alkanoylamino group having 1 to 20 carbon atoms or a benzoylamino group having 6 to 20 carbon atoms), a nitro group, a cyano group, an oxycarbonyl group (preferably an alkoxycarbonyl group having 1 to 20 carbon atoms or an aryloxycarbonyl group having 6 to 20 carbon atoms), a hydroxy group, a carboxy group, a sulfo group, a ureido group (preferably an alkylureido group having 1 to 20 carbon atoms or an arylureido group having 6 to 20 carbon atoms), a sulfonamido group (preferably an alkylsulfonamido group having 1 to 20 carbon atoms or an arylsulfonamido group having 6 to 20 carbon atoms), a sulfamoyl group (preferably an alkylsulfamoyl group having 1 to 20 carbon atoms or an arylsulfamoyl group having 6 to 20 carbon atoms), a carbamoyl group (preferably an alkylcarbamoyl group having 1 to 20 carbon atoms or an arylcarbamoyl group having 6 to 20 carbon atoms), an acyloxy group (preferably having 1 to 20 carbon atoms), an amino group (e.g., an unsubstituted amino group, preferably a secondary or tertiary amino group substituted by an alkyl group having 1 to 20 carbon atoms or an aryl group having 6 to 20 carbon atoms), a carboxylic acid ester group (preferably an alkyl carboxylic acid ester group having 1 to 20 carbon atoms or an aryl carboxylic acid ester group having 6 to 20 carbon atoms), a sulfone group (preferably an alkylsulfone group having 1 to 20 carbon atoms or an arylsulfone group having 6 to 20 carbon atoms), and a sulfinyl group (preferably an alkylsulfinyl group having 1 to 20 carbon atoms or an arylsulfinyl group having 6 to 20 carbon atoms.

Two or more of these substituents may be substituted on $R^{53}$ and if so, the substituents may be the same or different.

$Y^{51}$ in the general formula (A) represents a substituted or unsubstituted alkylene group having 1 to 10 carbon atoms (e.g., a methylene group, a dimethylene group, trimethylene group, a tetramethylene group, a methylpropylene group, etc.). Suitable substituents for $Y^{51}$ include an aryl group, an alkoxy group, a hydroxy group, a halogen atom, etc.

$X^{51}$ in the general formula (A) represents —$CONR^{55}$—, —$OCONR^{55}$—, —$NR^{55}CONR^{55}$—, —$NR^{55}COO$—, —COO—, —OCO—, —CO—, —$NR^{55}CO$—, —$SO_2NR^{55}$—, —$NR^{55}SO_2$—, —$SO_2$—, —S— or —O— wherein $R^{55}$ represents a hydrogen atom or a lower alkyl group having 1 to 5 carbon atoms, and n is 0 or 1.

Preferred examples of the amine compounds represented by the general formula (A) are shown below, but the present invention is not to be construed as being limited to these compounds.

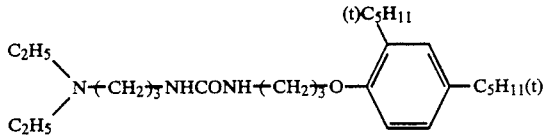
(A-1)

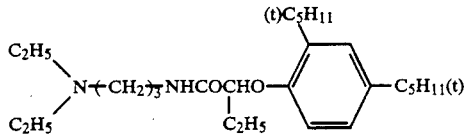
(A-2)

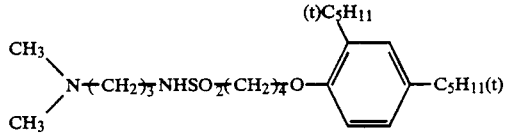
(A-3)

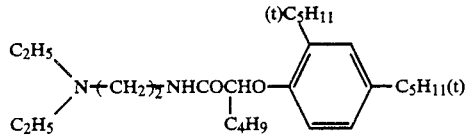
(A-4)

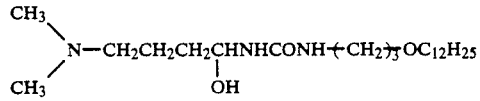
(A-5)

-continued
(A-6)
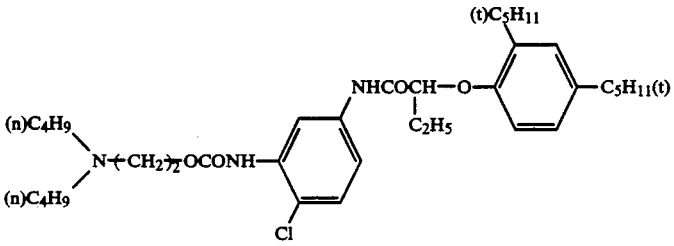
(A-7)
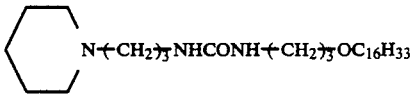
(A-8)
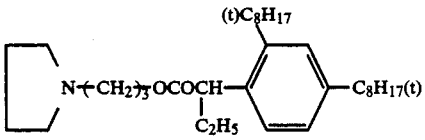
(A-9)
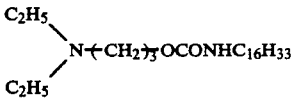
(A-10)
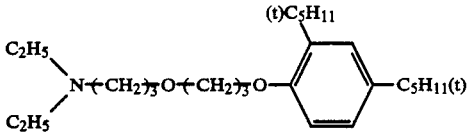
(A-11)
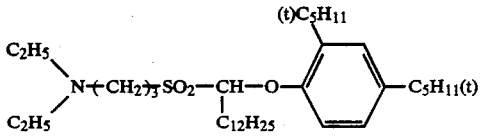
(A-12)
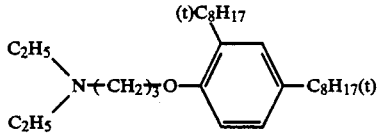
(A-13)
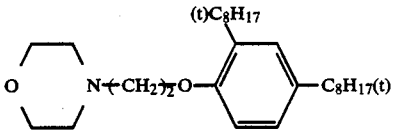
(A-14)
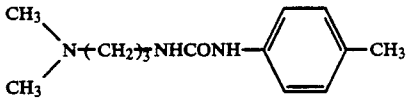
(A-15)
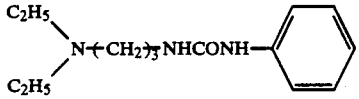
(A-16)
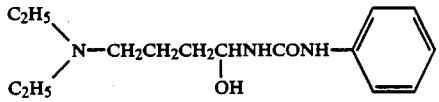

-continued

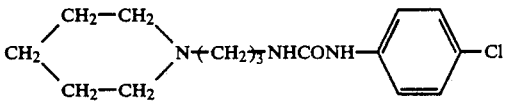

(A-17)

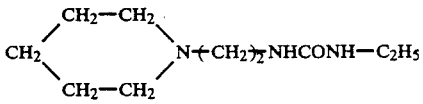

(A-18)

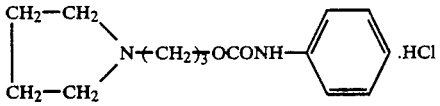

(A-19)

Onium compounds that may be used in the present invention preferably are compounds represented by the general formulae (B), (C) and (D) described below. The general formula (D) is as follows:

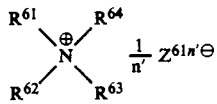

(B)

wherein $R^{61}$, $R^{62}$, $R^{63}$ and $R^{64}$, which may be the same or different, each represents a substituted or unsubstituted alkyl group, a substituted or unsubstituted aryl group, a substituted or unsubstituted aralkyl group, a substituted or unsubstituted heterocyclic ring, or an amino group, and may combine to form a ring ; $Z^{61}$ represents an anion; and n' is 1 or 2.

Groups represented by $R^{61}$, $R^{62}$, $R^{63}$ and $R^{64}$ in the general formula (B) preferably have 1 to 30 carbon atoms.

Alkyl groups represented by $R^{61}$ to $R^{64}$ include straight chained, branched or cyclic alkyl groups. Aryl groups represented by $R^{61}$ to $R^{64}$ are preferably a phenyl group or a naphthyl group. Heterocyclic rings represented by $R^{61}$ to $R^{64}$ are preferably a monocyclic or bicyclic aromatic heterocyclic group (more preferably a 5-membered or 6-membered heterocyclic group containing at least one of N, O and S). Aralkyl groups represented by $R^{61}$ to $R^{64}$ are preferably those whose alkyl moiety is straight chained, branched or cyclic, and aralkyl groups wherein the aryl moiety is a phenyl group, a naphthyl group, or a monocyclic or bicyclic aromatic heterocyclic groups (more preferably a 5- or 6-membered group containing at least one of N, O and S). Suitable substituents for these groups include a straight chained, branched or cyclic alkyl group (preferably having 1 to 20 carbon atoms), an aralkyl group (which is preferably monocyclic or bicyclic wherein the alkyl moiety has 1 to 3 carbon atoms), an alkoxy group (preferably having 1 to 20 carbon atoms), a monosubstituted or disubstituted amino group (preferably an amino group substituted by an alkyl group, an acyl group, an alkylsulfonyl group, or an arylsulfonyl group having 1 to 20 carbon atoms and when the amino group is disubstituted, the sum of the carbon atoms of the substituents is 20 or less), a mono-, di- or trisubstituted or unsubstituted ureido group (preferably having 1 to 29 carbon atoms), a substituted or unsubstituted aryl group (which is preferably monocyclic o bicyclic having 6 to 29 carbon atoms), a substituted or unsubstituted arylthio group (preferably having 6 to 29 carbon atoms), a substituted or unsubstituted alkylthio group (preferably having 1 to 29 carbon atoms), a substituted or unsubstituted alkylsulfinyl group (preferably having 1 to 29 carbon atoms), a substituted or unsubstituted arylsulfinyl group (which is preferably monocyclic or bicyclic having 6 to 29 carbon atoms), a substituted or unsubstituted alkylsulfonyl group (preferably having 1 to 29 carbon atoms), a substituted or unsubstituted arylsulfonyl group (which is preferably monocyclic or bicyclic having 6 to 29 carbon atoms), an aryloxy group (which is preferably monocyclic or bicyclic having 6 to 29 carbon atoms), a carbamoyl group (preferably having 1 to 29 carbon atoms), a sulfamoyl group (preferably having 1 to 29 carbon atoms), a hydroxy group, a halogen atom (e.g., F, Cl, Br and I), a sulfonic acid group, a carboxylic acid group, etc. Additionally, these substituents may be further substituted by the following substituents: an alkyl group having 1 to 20 carbon atoms, a monocyclic or bicyclic aryl group having 6 to 20 carbon atoms, an alkoxy group having 1 to 20 carbon atoms, an aryloxy group having 6 to 20 carbon atoms, an alkylthio group having 1 to 20 carbon atoms, an arylthio group having 6 to 20 carbon atoms, an alkylsulfonyl group having 1 to 20 carbon atoms, an arylsulfonyl group having 6 to 20 carbon atoms, a carbonamido group having 1 to 20 carbon atoms, a sulfonamido group having 0 to 20 carbon atoms, a carbamoyl group having 1 to 20 carbon atoms, a sulfamoyl group having 1 to 20 carbon atoms, an alkylsulfinyl group having 1 to 20 carbon atoms, an arylsulfinyl group having 1 to 20 carbon atoms, an ester group having 2 to 20 carbon atoms, a hydroxy group, -COOM or $-SO_2M$ (wherein M represents a hydrogen atom, an alkali metal atom or substituted or unsubstituted ammonium), a trisubstituted ammonio group $$(-N^{\oplus}R^{61}R^{62}R^{63} \cdot \frac{1}{n'} Z^{61n'\ominus}$$

wherein $R^{61}$, $R^{62}$, $R^{63}$, $Z^{61}$, and n' have the same meaning as defined for $R^{61}$, $R^{62}$, $R^{63}$, $Z^{61}$, and n' in the general formula (B)), or a halogen atom (e.g., F, Cl, Br and I).

Examples of groups represented by $Z^{61}$ in the general formula (B) are inorganic anions such as halide ions (e.g., $F^{\ominus}$, $Cl^{\ominus}$, $Br^{\ominus}$ and $I^{\ominus}$), a perchlorate ion, a nitrate ion, a sulfate ion, $PF_6^{\ominus}$ and $OH^{\ominus}$ or organic acid ions such as an acetic acid ion, a benzoic acid ion, a methanesulfonic acid ion and a paratoluenesulfonic acid ion. Further, these organic sulfonic acid ions and carboxylic acid ions may be substituted on one of the groups represented by $R^{61}$, $R^{62}$, $R^{63}$ and $R^{64}$ to form an inner salt. The number of $Z^{61}$ groups and the corresponding number of anionic charges depend upon the number of cationic charges in the compound represented by the general formula (B), and will be the number necessary to impart a neutral charge to the entire compound.

Examples of compounds represented by the general formula (B) are shown below; however, the present invention is not to be construed as being limited to these compounds.

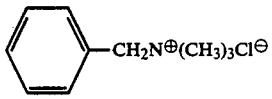

(B-1)

$(CH_3)_3N^{\oplus}CH_2CH_2OCH_3Br^{\ominus}$ (B-2)

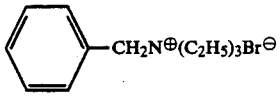

(B-3)

$(n)C_{16}H_{33}N^{\oplus}(CH_3)_3Br^{\ominus}$ (B-4)
$[(n)C_4H_9]_4N^{\oplus}Cl^{\ominus}$ (B-5)
$[(n)C_4H_9]_4N^{\oplus}ClO_4^{\ominus}$ (B-6)
$[(n)C_3H_7]_4N^{\oplus}OH^{\ominus}$ (B-7)
$(C_2H_5)_4N^{\oplus}ClO_4^{\ominus}$ (B-8)
$(C_2H_5)_4N^{\oplus}F^{\ominus}$ (B-9)

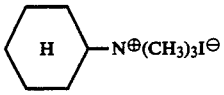

(B-10)

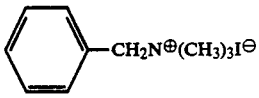

(B-11)

$(CH_3)_3N^{\oplus}CH_2CH_2OHCl^{\ominus}$ (B-12)

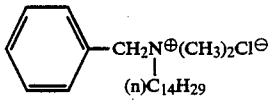

(B-13)

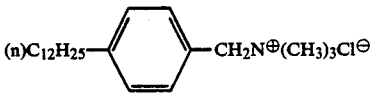

(B-14)

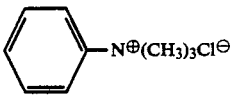

(B-15)

$(n)C_{12}H_{25}N^{\oplus}(CH_3)_3Cl^{\ominus}$ (B-16)

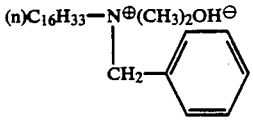

(B-17)

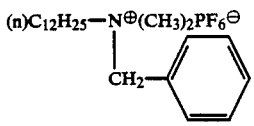

(B-18)

$(C_2H_5)_3N^{\oplus}-(CH_2)_8-N^{\oplus}(C_2H_5)_3 2Cl^{\ominus}$ (B-19)
$[(n)C_4H_9]_3N^{\oplus}CH_2CH_2N^{\oplus}[(n)C_4H_9]_3SO_4^{2-}$ (B-20)

-continued $(C_2H_5)_2\overset{NH_2}{\overset{|}{N}}{}_{\oplus}(CH_2)_4\overset{NH_2}{\overset{|}{N}}{}_{\oplus}(C_2H_5)_2 2Cl^{\ominus}$ (B-21)

$[(n)C_4H_9]_2\overset{NH_2}{\overset{|}{N}}{}_{\oplus}(CH_2)_8\overset{NH_2}{\overset{|}{N}}{}_{\oplus}[(n)C_4H_9]_2 2Br^{\ominus}$ (B-22)

Compounds of the general formula (C) are as follows:

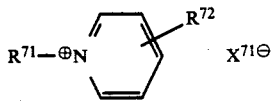

(C)

wherein $X^{71\ominus}$ represents an anion; $R^{71}$ represents $-Y^{71}-R^{73}$, $-Y^{71}-COOR^{73}$, $-Y^{71}-OCOR^{73}$, $-Y^{72}-COO-Y^{71}-OCOR^{73}$, $-Y^{72}-OCO-Y^{71}-COOR^{73}$ or $-Y^{72}-COO-Y^{71}-COOR^{73}$, wherein $Y^{71}$ represents an alkylene group, an arylene group or an aralkylene group, $R^{73}$ represents an alkyl group, an aryl group, an aralkyl group,

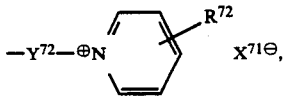

or

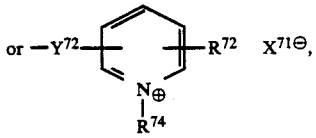

wherein $R^{74}$ represents an alkyl group, an aryl group or an aralkyl group, $Y^{72}$ represents a single bond, an alkylene group, an arylene group or an aralkylene group; and $R^{72}$ represents a hydrogen atom, a halogen atom, an alkyl group, an aryl group, an aralkyl group, an oxycarbonyl group, an acyloxy group, an alkoxy group, an amino group, a substituted amino group, an acylamido group, a sulfonamido group, a carbamoyl group,

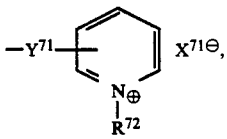

or $R^{71}$ provided that at least one of $R^{71}$ and $R^{72}$ has an ester group.

Examples of groups represented by $X^{71\ominus}$ are included as the same ions as defined for $Z^{61}$ in the general formula (B).

Examples of compounds represented by the general formula (C) are shown below; however, the present invention is not to be construed as being limited to these compounds.

(C-1)
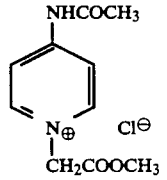
(C-2)
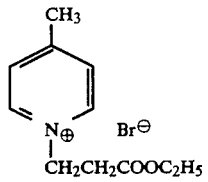
(C-3)
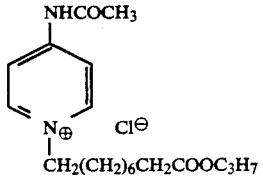
(C-4)
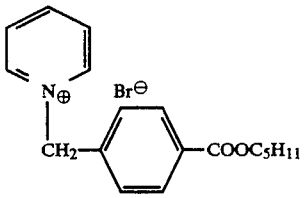
(C-5)
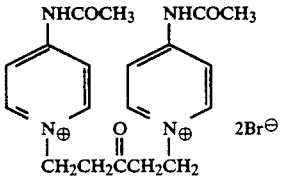
(C-6)
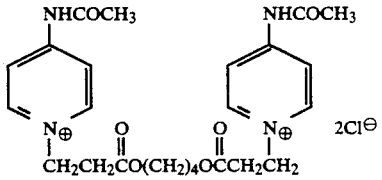
(C-7)
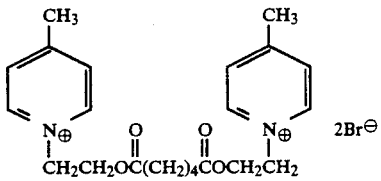
(C-8)
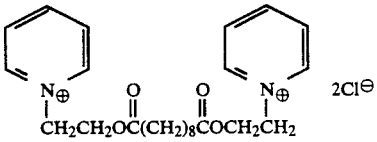
-continued
(C-9)
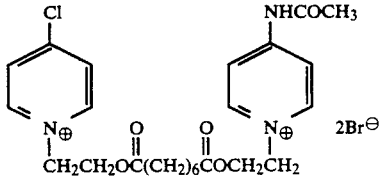
(C-10)
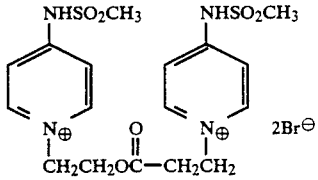
(C-11)
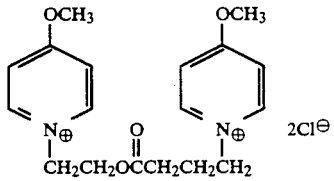
(C-12)
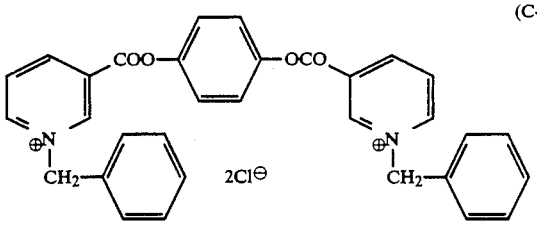
(C-13)
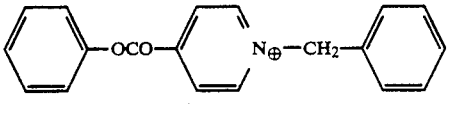
(C-14)
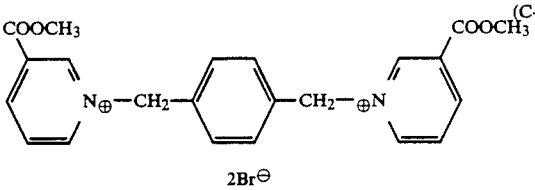
(C-15)
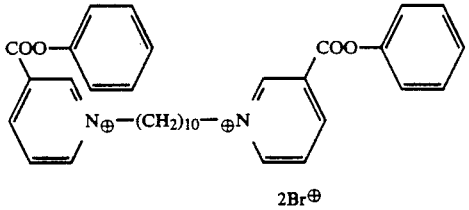
Compounds of the general formula (D) are as follows:
(D)
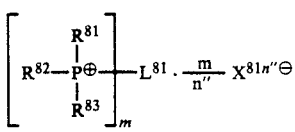

wherein $R^{81}$, $R^{82}$ and $R^{83}$, which may be the same or different, each represents an alkyl group, a cycloalkyl group, an aryl group, an alkenyl group, a cycloalkenyl group, or a heterocyclic residue that may have a substituent, m is an integer, $L^{81}$ represents an m-valent organic group whose carbon atom is bonded to the phosphorus atom, n'' is an integer of 1 to 3, $X^{81}$ represents an n-valent anion, and $X^{81}$ and $L^{81}$ may be bonded.

The general formula (D) will be described below in further detail.

Examples of groups represented by $R^{81}$, $R^{82}$ and $R^{83}$ are a straight chained or branched alkyl group such as a methyl group, an ethyl group, a propyl group, an isopropyl group, a butyl group, an isobutyl group, a sec-butyl group, a tert-butyl group, an octyl group, a 2-ethylhexyl group, a dodecyl group, a hexadecyl group, an octadecyl group, etc.; a cycloalkyl group such as a cyclopropyl group, a cyclopentyl group, a cyclohexyl group, etc.; an aryl group such as a phenyl group, a naphthyl group, a phenanthryl group, etc.; an alkenyl group such as an allyl group, a vinyl group, a 5-hexenyl group, etc.; a cycloalkenyl group such as a cyclopentenyl group, a cyclohexenyl group, etc.; and a heterocyclic residue such as a pyridyl group, a quinolyl group, a furyl group, an imidazolyl group, a thiazolyl group, a thiadiazolyl group, a benzotriazolyl group, a benzothiazolyl group, a morpholinyl group, a pyrimidyl group, a pyrrolidyl group, etc. Suitable substituents for these groups include, in addition to the groups represented by $R^{81}$, $R^{82}$ and $R^{83}$, halogen atoms such as a fluorine atom, a chlorine atom, a bromine atom and an iodine atom, a nitro group, primary, secondary and tertiary amino groups, an alkyl ether group, an aryl ether group, an alkylthio ether group, an arylthio ether group, a carbonamido group, a carbamoyl group, a sulfonamido group, a sulfamoyl group, a hydroxyl group, a sulfoxy group, a sulfonyl group, a carboxyl group, a sulfonic acid group, a cyano group and a carbonyl group.

Examples of groups represented by $L^{81}$ are the groups represented by $R^{81}$, $R^{82}$ and $R^{83}$ as defined above, a polymethylene group such as a trimethylene group, a tetramethylene group, a hexamethylene group, a pentamethylene group, an octamethylene group, a dodecamethylene group, etc., a divalent aromatic group such as a phenylene group, a biphenylene group, a naphthylene group, etc., a polyvalent aliphatic group such as a trimethylene methyl group, a tetramethylene methyl group, etc., a polyvalent aromatic group such as a phenylene-1,3,5-toluyl group, a phenylene-1,2,4,5-tetrayl group, etc., and the like.

Examples of anions represented by $X^{81}$ are a halogen ion such as a chlorine ion, a bromine ion and an iodine ion, a carboxylate ion such as an acetate ion, an oxalate ion, a fumarate ion, a benzoate ion, etc., a sulfonate ion such as a p-toluenesulfonate ion, a methanesulfonate ion, a butanesulfonate ion, a benzenesulfonate ion, etc., a sulfate ion, a perchlorate ion, a carbonate ion, and a nitrate ion.

Particularly preferred compounds represented by the general formula (D) are compounds wherein m is an integer of 1 or 2, $L^{81}$ represents a group selected from the groups represented by $R^{81}$, $R^{82}$ and $R^{83}$ and having 20 or less carbon atoms, or a divalent organic group whose carbon atom is bonded to the phosphorus atom and that contains 20 or less carbon atoms, n'' represents an integer of 1 or 2, $X^{81}$ represents a monovalent or divalent anion, and $X^{81}$ and $L^{81}$ may be chemically bonded.

Many of the above-described compounds represented by the general formula (D) are known and commercially available as reagents. A general process for synthesizing these compounds is a method where phosphinic acids are reacted with an alkylating agent such as sulfonates and halogenated alkyls; or a process where counter anions of phosphonium salts are exchanged in a conventional manner.

Examples of compounds represented by the general formula (D) are shown below; however, the present invention is not to be construed as being limited to these compounds.

(D-1)

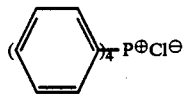

(D-2)

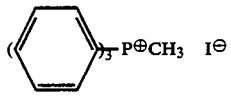

(D-3)

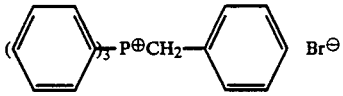

(D-4)

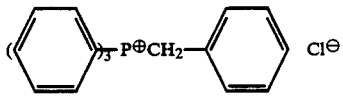

(D-5)

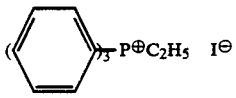

$[(n)C_4H_9]_4P^{\oplus}$ $Br^{\ominus}$ (D-6)

(D-7)

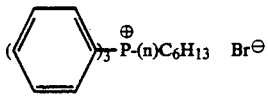

(D-8)

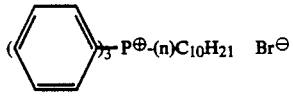

(D-9)

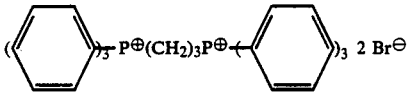

(D-10)

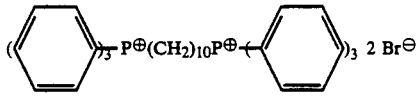

(D-11)

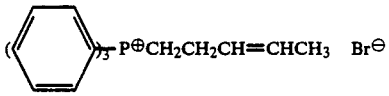

-continued (D-12)

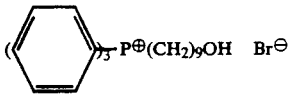

(D-13)

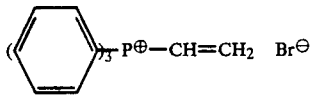

(D-14)

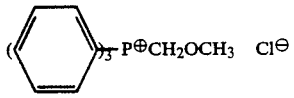

(D-15)

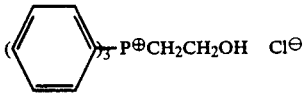

(D-16)

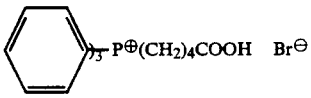

(D-17)

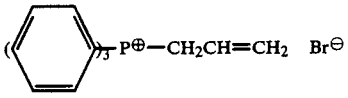

(D-18)

$[(n)C_4H_9]_3P^{\oplus}$-$(n)C_{16}H_{33}$ $Br^{\ominus}$ (D-19)

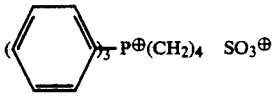

When the above-described amine compounds or quaternary onium salts are used in the present invention, they are added to at least one of the silver halide emulsion layer(s) or at least one of other hydrophilic layer(s) of the photographic material. These compounds are preferably added in amounts of from about $1\times10^{-6}$ mol to about $1\times10^{-1}$ mol, more preferably $1\times10^{-5}$ mol to $5\times10^{-2}$ mol, per mol of total silver halide.

When one or more of the compounds represented by the general formulae (A) to (D) are contained in a photographic material as described above, if the compound is soluble in water, it is added in the form of an aqueous solution to a silver halide emulsion or a hydrophilic colloid solution or, if the compound is insoluble in water, the compound is added as a solution thereof in an organic solvent miscible with water such as alcohols (e.g., methanol, ethanol, etc.), esters (e.g., ethyl acetate), ketones (e.g., acetone), etc., to a silver halide emulsion or a hydrophilic colloid solution.

The amine compounds and quaternary onium salts may be added in combination, if desired. If they are used in combination, they may be present in the same layer or different layers. Further, they may be present in the same layer as the hydrazine derivative, the compound represented by the general formula (I), or in a different layer therefrom. Although the ratio of the amounts of the amine compounds and the quaternary onium salts depends on the nature of the compounds used, the nature of the silver halide emulsion and the nature of the hydrazine derivative, preferably the amine compound/quaternary onium salt molar ratio is from about 50 to about 1.

The compounds represented by the general formula (I) used in the present invention contain a silver halide adsorption group and an acid group and have substantially no absorption maximum in the visible light wavelength region, in particular, in a region comprising light of wavelegnths of not shorter than 460 nm. The general formula (I) is as follows:

$$C\text{-}L\text{-}D \qquad (I)$$

wherein C represents a group which enhances adsorption to silver halide, D represents an acid group, and L represents a divalent linking group.

Herein, these compounds of the general formula (I) are defined as having "substantially no absorption maximum in the visible region", which means that these compounds, when present in a photographic material, impart to that material a remaining color tone which is less than that which would cause practical problems. More particularly, this definition encompasses compounds resulting in the material having remaining color tone after development treatment which is less than that which would cause practical problems.

Preferably, the absorption maximum of the compound in methanol is not more than about 440 nm, more particularly not more than 430 nm.

The groups represented by C in the general formula (I) include groups conventionally used for enhancing adsorption to silver halide, for example, a group having a thioamido component, a mercapto group, heterocyclic groups, groups comprising a radical formed by releasing one hydrogen atom from a compound such as cyanine or merocyanine, and a group comprising two or more groups chosen from among these groups.

A thioamido adsorption enhancing group represented by C is characterized in that it has a divalent thioamido group represented by $$-\underset{\underset{S}{\|}}{C}-NH-.$$

amido group may be a part of a 5- or 6-membered heterocyclic ring. Useful thioamido adsorption enhancing groups can be selected, for example, from those disclosed in U.S. Pat. Nos. 4,030,925, 4,031,127, 4,080,207, 4,245,037, 4,255,511, 4,266,013 and 4,276,364 and *Research Disclosure*, Vol. 151 (November, 1976), RD No. 15162, and *Research Disclosure*, Vol. 176 (December, 1978), RD No. 17626.

Particularly preferred thioamido adsorption enhancing groups are a thioureido group, a thiourethane group, etc.

When a thioamido adsorption enhancing group is a part of a 5- or 6-membered heterocyclic ring, a preferred ring is one generally regarded as an acid nucleus in merocyanine dyes, such as 4-thiazoline-2-thione, thiazolidine-2-thione, 4-oxazoline-2-thione, oxazolidine-2-thione, 2-pyrazoli-5-thione, 4-imidazoline-2-thione, 2-thiohydantoin, rhodanine, isorhodanine, 2-thio-2,4-oxazolidinedione, thiobarbituric acid, 1,3,4-thiazoline-2-thione, 1,3,4-oxadiazoline-2-thione, etc. Further, these thioamido adsorption enhancing groups may be substituted by suitable substituent.

Mercapto groups represented by C include aliphatic mercapto groups, aromatic mercapto groups, and heterocyclic ring-containing mercapto groups (wherein there is no nitrogen atom adjacent to the carbon atom to which the SH group is bonded).

Examples of aliphatic mercapto groups are a mercaptoalkyl group (e.g., a mercaptoethyl group, a mercaptopropyl group, etc.), a mercaptoalkenyl group (e.g., a mercaptopropenyl group, etc.), and a mercaptoalkynyl group (e.g., a mercaptobutynyl group, etc.). Examples of aromatic mercapto groups are a mercaptophenyl group and a mercaptonaphthyl group. Examples of heterocyclic mercapto groups are a 4-mercaptopyridyl group, a 5-mercaptoquinolinyl group, a 6-mercaptobenzothiazolyl group, etc.

Heterocyclic groups represented by C include a 5- or 6-membered heterocyclic ring containing nitrogen, oxygen or sulfur and carbon in combination, with a heterocyclic ring capable of forming imino silver being preferred. Preferred examples of heterocyclic rings include benzotriazole, triazole, tetrazole, indazole, benzimidazole, imidazole, benzothiazole, thiazole, benzoxazole, oxazole, thiadiazole, oxadiazole, triazine, etc. These heterocyclic rings may also have a suitable substituent.

The heterocyclic ring is more preferably benzotriazole, triazole, tetrazole and indazole, with benzotriazole and indazole being mos preferred.

Preferred examples of specific heterocyclic groups are benzotriazole-5-yl, 6-chlorobenzotriazole-5-yl, benzotriazole-5-carbonyl, 5-phenyl-1,3,4-triazole-2-yl, 4-(5-methyl-1,3,4-triazole-2-yl)benzoyl, 1H-tetrazole-5-yl, 3-cyanoindazole-5-yl, etc.

Groups represented by C comprising a radical of compounds such as cyanines or merocyanines mentioned above have substantially no absorption maximum in the visible region, and are selected, for example, from monomethinecyanine, apomerocyanine, etc. In particular, such groups may be cyanines represented by the general formula (I') and merocyanines represented by the general formula (I''), both of which are described below.

Many of the monomethinecyanines and apomerocyanines mentioned above, cyanines represented by the general formula (I') and merocyanines represented by the general formula (I'') are generally known in a broad sense as spectral sensitizing dyes for silver halide emulsions, and since they are compounds which have substantially no absorption maximum in the visible region, they can be used effectively in the present invention. The general formula (I') is as follows:

(I')

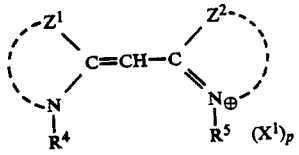

wherein $Z^1$ and $Z^2$, which may be the same or different, each represents a group of non-metal atoms required to complete a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus or a quinoline nucleus, $R^4$ and $R^5$, which may be the same or different, each represents an alkyl group, $X^1$ represents an electric charge balancing counter ion, and p is 0 or 1.

When the general formula (I') is a radical, preferably the radical is formed by releasing one hydrogen atom from a group of atoms represented by $Z^1$ or $Z^2$ or from a group represented by $R^4$ or $R^5$ (as defined above), with a radical formed by releasing one hydrogen atom from $R^4$ or $R^5$ being particularly preferred.

A compound of the general formula (I') that has an acid group (e.g., where $R^4$ or $R^5$ is an alkyl group or an aralkyl group having an acid group) as a substituent may itself be a compound represented by the general formula (I).

In the general formula (I'), a heterocyclic ring formed by $Z^1$ and $Z^2$ is preferably a benzoxazole nucleus, a benzothiazole nucleus, a naphthoxazole nucleus, a naphthothiazole nucleus, a thiazole nucleus or an oxazole nucleus, more preferably a benzoxazole nucleus, a benzothiazole nucleus or a naphthoxazole nucleus, and most preferably, a benzoxazole nucleus or a naphthoxazole nucleus. Further, a heterocyclic ring formed by $Z^1$ and $Z^2$ may be substituted by at least one substituent such as a halogen atom (e.g., fluorine, chlorine, bromine and iodine), a nitro group, an alkyl group (preferably having 1 to 4 carbon atoms such as a methyl group, an ethyl group, a trifluoromethyl group, a benzyl group and a phenethyl group), an aryl group (e.g., a phenyl group), an alkoxy group (preferably having 1 to 4 carbon atoms such as a methoxy group, an ethoxy group, a propoxy group and a butoxy group), a carboxyl group, an alkoxycarbonyl group (preferably having 2 to 5 carbon atoms such as an ethoxycarbonyl group), a hydroxy group, a cyano group, etc.

In the general formula (I'), the alkyl groups represented by $R^4$ and $R^5$ include unsubstituted and substituted alkyl groups. Preferably, suitable unsubstituted alkyl groups have not more than 18 carbon atoms, more preferably not more than 8 carbon atoms, and examples thereof are a methyl group, an ethyl group, an n-propyl group, an n-butyl group, an n-hexyl group, an n-octadecyl group, etc. Preferably, the substituted alkyl groups have not more than 6 carbon atoms, more preferably not more than 4 carbon atoms, in the alkyl moiety, and examples thereof are sulfo group-substituted alkyl groups (wherein the sulfo group may be bonded via an alkoxy group, an aryl group or the like, such as a 2-sulfoethyl group, a 3-sulfopropyl group, a 3-sulfobutyl group, a 4-sulfobutyl group, a 2-(3-sulfopropoxy)ethyl group, a 2-[2-(3-sulfopropoxy)ethoxy]ethyl group, a 2-hydroxy-3-sulfopropyl group, a p-sulfophenethyl group, a p-sulfophenylpropyl group, etc.), carboxy groupsubstituted alkyl groups (wherein the carboxyl group may be bonded via an alkoxy group, an aryl group or the like, such as a carboxymethyl group, a 2-carboxyethyl group, a 3-carboxypropyl group, a 4-carboxybutyl group, etc.), hydroxyalkyl groups (e.g., a 2-hydroxyethyl group, a 3-hydroxypropyl group, etc.), acyloxyalkyl groups (e.g., a 2-acetoxyethyl group, a 3-acetoxypropyl group, etc.), alkoxyalkyl groups (e.g., a 2-methoxyethyl group, a 3-methoxypropyl group, etc.), alkoxycarbonylalkyl groups (e.g., a 2-methoxycarbonylethyl group, a 3-methoxycarbonylpropyl group, a 4-ethoxycarbonylbutyl group, etc.), vinyl group-substituted alkyl groups (e.g., an allyl group), cyanoalkyl groups (e.g., a 2-cyanoethyl group, etc.), carbamoylalkyl groups (e.g., a 2-carbamoylethyl group, etc.), aryloxyalkyl groups (e.g., a 2-phenoxyethyl group, a 3-phenoxypropyl group, etc.), aralkyl groups (e.g., a 2-phenethyl group, a 3-phenylpropyl group, etc.), aryloxyalkyl groups (e.g., a 2-phenoxyethyl group, a 3-phenoxypropyl group, etc.), etc.

Preferably, with respect to the substituents represented by $R^4$ and $R^5$, at least one of the substituents is an alkyl group having a sulfo group or a carboxyl group.

The electric charge balancing counter ion represented by $X^1$ is any anion capable of balancing or neutralizing the positive charge formed by the quaternary ammonium salt of the heterocyclic ring, and examples of such anions include a bromine ion, a chlorine ion, an iodine ion, a p-toluenesulfonate ion, an ethylsulfonate ion, a perchlorate ion, a trifluoromethanesulfonate ion, a thiocyan ion, etc. In this case, p is 1.

Where the heterocyclic quaternary ammonium salt contains an anionic substituent such as a sulfoalkyl substituent, the salt may be in the form of a betaine, a counter ion is not required to be present, and p is thus 0. On the other hand, when the heterocyclic quaternary ammonium salt has two anionic substituents (for example, two sulfoalkyl groups), $X^1$ is a cationic counter ion, for example, selected from an alkali metal ion (e.g., a sodium ion, a potassium ion, etc.) and an ammonium salt (e.g., triethylammonium, etc.).

Of the cyanines represented by the general formula (I'), particularly preferable cyanines are those represented by the following general formula (X):

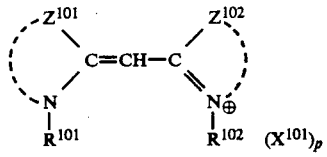

(X)

wherein $Z^{101}$ and $Z^{102}$, which may be the same or different, each represents a group of non-metal atoms required to complete a benzoxazole nucleus, a benzothiazole nucleus or a naphthoxazole nucleus, and $R^{101}$, $R^{102}$, $X^{101}$, and q are the same as defined for $R^4$, $R^5$, $X^1$, and p of the general formula (I').

The cyanines represented by the general formula (X) are specifically represented by the following general formula (X'):

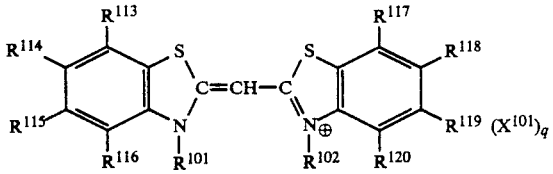

(X')

wherein $R^{101}$, $R^{102}$, $X^{101}$, and q are the same as defined above, and $R^{113}$, $R^{114}$, $R^{115}$, $R^{116}$, $R^{117}$, $R^{118}$, $R^{119}$, and $R^{120}$, which may be the same or different, each represents a hydrogen atom or a group selected from the substituent groups as defined for substituents of $Z^1$ and $Z^2$ of the general formula (I'). $R^{113}$, $R^{114}$, $R^{115}$, $R^{116}$, $R^{117}$, $R^{118}$, $R^{119}$, or $R^{120}$ is preferably a hydrogen atom, a halogen atom, an alkyl group, or an alkoxy group.

The general formula (I'') is as follows:

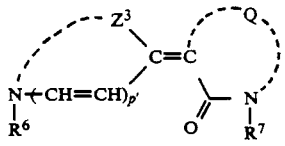

(I'')

wherein $Z^3$ represents a group of non-metal atoms required to complete a thiazoline nucleus, a thiazolidine nucleus, a selenazoline nucleus, a selenazolidine nucleus, a pyrrolidine nucleus, a dihydropyridine nucleus, an oxazoline nucleus, an oxazolidine nucleus, an imidazoline nucleus, an indoline nucleus, a tetrazoline nucleus, a benzothiazoline nucleus, a benzoselenazoline nucleus, a benzimidazoline nucleus, a benzoxazoline nucleus, a naphthothiazoline nucleus, a naphthoselenazoline nucleus, a naphthoxazoline nucleus, a naphthoimidazoline nucleus or a dihydroquinoline nucleus; Q represents a group of non-metal atoms required to complete a rhodanine nucleus, a 2-thiooxazoline-2,4-dione nucleus, a 2-thioselenazoline-2,4-dione nucleus, a 2-thiohydantoin nucleus, a barbituric acid nucleus or a 2-thiobarbituric acid nucleus; $R^6$ and $R^7$, which may be the same or different, each represents a hydrogen atom, an alkyl group or an aryl group; and p' is 0 or 1.

When the compound of the general formula (I'') is a radical, it is preferably formed by releasing one hydrogen atom from the group of atoms represented by $Z^3$ and Q, or the groups represented by $R^6$ and $R^7$. More preferably, a radical is formed by releasing one hydrogen atom from the groups represented by $R^6$ and $R^7$.

If these compounds of the general formula (I'') have as a substituent an acid group (e.g., $R^6$ or $R^7$ is an alkyl group or an aralkyl group substituted by an acid group), the compounds themselves may be a compound represented by the general formula (I).

$Z^3$ preferably represents an oxazoline nucleus, an oxazolidine nucleus, a thiazoline nucleus, a benzothiazoline nucleus, a thiazolidine nucleus, a benzoxazoline nucleus, a naphthoxazoline nucleus, a selenazoline nucleus, a selenazolidine nucleus, a benzoselenazoline nucleus, a benzimidazoline nucleus, a pyrrolidine nucleus, a dihydropyridine nucleus, or a tetrazoline nucleus. More preferably, $Z^3$ represents an oxazoline nucleus, an oxazolidine nucleus, a benzoxazoline nucleus, a thiazoline nucleus, a thiazolidine nucleus, a selenazoline nucleus, a selenazolidine nucleus, a benzimidazoline nucleus, a pyrrolidine nucleus, or a dihydropyridine nucleus. Most preferably, $Z^3$ represents an oxazoline nucleus, an oxazolidine nucleus, a benzoxazoline nucleus, a thiazoline nucleus, a thiazolidine nucleus, a benzimidazoline nucleus or a pyrrolidine nucleus.

$R^6$ and $R^7$, which may be the same or different, each represents a hydrogen atom, an unsubstituted alkyl group having 1 to 18 carbon atoms (preferably an alkyl group having 1 to 8 carbon atoms such as a methyl group, an ethyl group, a propyl group, an isopropyl group, a butyl group, a hexyl group, a dodecyl group, an octadecyl group, etc.), a substituted alkyl group (e.g., an aralkyl group such as a benzyl group, a β-phenylethyl group, etc.), a hydroxyalkyl group (e.g., a 2-hydroxyethyl group, a 3-hydroxypropyl group, a 2-hydroxyethoxyethyl group, etc.), a carboxyalkyl group (e.g., a carboxymethyl group, a 2-carboxyethyl group, a 3-carboxypropyl group, a 4-carboxybutyl group, etc.), a sulfo group-substituted alkyl group (wherein the sulfo group may be bonded to the alkyl group via an alkoxy group, an aryl group, or the like, such as a 2-sulfoethyl group, a 3-sulfopropyl group, a 3-sulfobutyl group, a 4-sulfobutyl group, a 2-(3-sulfopropoxy)ethyl group, a 2-hydroxy-3-sulfopropyl group, a 2-[2-(3-sulfopropoxy)ethoxy]ethyl group, a p-sulfophenethyl group, etc.), a sulfatealkyl group (e.g., a 3-sulfatepropyl group, a 4-sulfatebutyl group, etc.), a mercapto group, a vinyl group-substituted alkyl group (e.g., an aryl group), an acyloxyalkyl group (e.g., a 2-acetoxyethyl group, a 3-acetoxypropyl group, etc.), an alkoxyalkyl group (e.g., a 2-methoxyethyl group, a 3-methoxypropyl group, etc.), an alkoxycarbonylalkyl group (e.g., a 2-methoxycarbonylethyl group, a 3-methoxycarbonylpropyl group, a 4-ethoxycarbonylbutyl group, etc.), a cyanoalkyl group (e.g., a 2-cyanoethyl group, etc.), a carbamoylalkyl group (e.g., a 2-carbamoylethyl group, etc.), an aryloxyalkyl group (e.g., a 2-phenoxyethyl group, a 3-phenoxypropyl group, etc.), a mercaptoalkyl group ( e.g., a 2-mercaptoethyl group, a 3-mercaptopropyl group, etc.), an alkylthioalkyl group (e.g., a 2-methylthioethyl group, etc.) or an aryl group (e.g., a phenyl group, a tolyl group, a naphthyl group, a methoxyphenyl group, a chlorophenyl group, etc.). It is preferred that at least one of $R^6$ and $R^7$ is an alkyl group substituted by a sulfo group or a carboxyl group.

Q represents a group of non-metal atoms required to complete a rhodanine nucleus, a 2-thiooxazoline-2,4-dione nucleus, a 2-thioselenazoline-2,4-dione nucleus, a barbituric acid nucleus or a thiobarbituric acid nucleus (e.g., a barbituric acid nucleus or a thiobarbituric acid nucleus containing a 1-alkyl group (e.g., a 1-methyl group, a 1-ethyl group, a 1-propyl group, a 1-butyl group, etc.), a 1,3-dialkyl group (e.g., a 1,3-dimethyl group, a 1,3-diethyl group, a 1,3-dipropyl group, a 1,3-diisopropyl group, a 1,3-dicyclohexyl group, a 1,3-di(B-methoxyethyl) group, etc.), a 1,3-diaryl group (e.g., a 1,3-diphenyl group, a 1,3-di(p-chlorophenyl) group, a 1,3-di(p-ethoxycarbonylphenyl) group, etc.), a 1-sulfoalkyl group (e.g., a 1-(2-sulfoethyl) group, a 1-(3-sulfopropyl) group, a 1-(4-sulfobutyl) group, etc.), a 1,3-disulfoalkyl group (e.g., a 1,3-di(2-sulfoethyl) group, a 1,3-di(3-sulfopropyl) group, a 1,3-di(4-sulfocyclohexyl) group, etc.), a 1,3-di(sulfoaryl group (e.g., a 1,3-di(4-sulfophenyl) group, etc.), or a 1-sulfoaryl group (e.g., a 1-(4-sulfophenyl) group)), or a 2-thiohydantoin nucleus (although the substituent at the 1-position may have the same meaning as defined for the 3-position ($R^7$), they may be the same or different).

Preferably, the heterocyclic ring formed by Q is a rhodanine nucleus or a 2-thiohydantoin nucleus, with a rhodanine nucleus being more preferred.

Preferably, C represents a radical comprising a cyanine or a merocyanine, with a radical comprising a cyanine being most preferred.

D represents an acid group. Suitable acid groups include those capable of dissociating into an anion when developed. Examples thereof include the substituents of C described above, particularly, for example, a sulfonic acid group, a carboxylic acid group, a phosphonic acid group, a sulfinic acid group, a sulfoamino group, a phosphinic acid group, a sulfuric acid monoester group, a sulfonamido group, a sulfamoyl group, a hydroxyimino group, a hydroxyaminocarbonyl group, a sulfinamido group, a sulfinamoyl group, a hydroxyaminosulfonyl group, etc.

D preferably represents a sulfonic acid group, a carboxylic acid group, a phosphonic acid group, a sulfinic acid group, a sulfoamino group, a sulfuric acid monoester group, with a sulfonic acid group, a carboxylic acid group or a phosphonic acid group being more preferred, and a sulfonic acid group being most preferred.

The acid group represented by D may be in the form of an acid anion. In this case, it may have a suitable cation as an electric charge balancing counter ion. Examples of such a cation are ammonium salts (e.g., triethyl ammonium, pyridinium, etc.), alkali metal ions (e.g., a sodium ion, a potassium ion, etc.), etc.

L is a divalent linking group, which includes atoms or an atomic group containing at least one of C, N, S and O.

Particularly, L represents an alkylene group, an alkenylene group, an alkynylene group, an arylene group, —O—, —S—, —NH—, —N=, —OC—, or —$SO_2$—, which may be substituted and may be combined. More particularly, L represents, for example, (1) an alkylene group (preferably having 1 to 12 carbon atoms such as a methylene group, an ethylene group, a trimethylene group, a tetramethylene group, etc.), (2) an alkenylene group (preferably having 2 to 12 carbon atoms such as a vinylene group, a butenylene group, etc.), (3) an alkynylene group (preferably having 2 to 12 carbon atoms such as an ethynylene group, a butynylene group, etc.), (4) an arylene group (preferably having 6 to 10 carbon atoms such as a phenylene group, a naphthylene group, etc.), (5) —O—, (6) —S—, (7) —NH—, (8) —N=, (9) —CO—, (10) —$SO_2$—, etc. Suitable combinations of these groups include, for example:

$$(11)\ -O-\overset{\overset{\displaystyle O}{\|}}{C}-,\ (12)\ -NH-\overset{\overset{\displaystyle O}{\|}}{C}-,\ (13)\ -NHSO_2-,$$

$$(14)\ -O-\overset{\overset{\displaystyle O}{\|}}{C}NH-,\ (15)\ -NH\overset{\overset{\displaystyle O}{\|}}{C}NH-,\ (16)\ -NHSO_2NH-,$$

and a combination of one of above (1) to (4) and one of above (5) to (16) such as $$\text{-(alkylene)-}\overset{\overset{\displaystyle O}{\|}}{C}NH-,\ \text{-(arylene)-}$$

$$SO_2NH-,\ \text{and -(arylene)-}NH\overset{\overset{\displaystyle O}{\|}}{C}NH-.$$

Of the compounds represented by the general formula (I) used in the present invention, those particularly preferred are compounds represented by the general formula (I') or (I'') having an acid group, with the former being more preferred in view of decreasing the amount of black peppers and reducing undesirable remaining color.

If C in the general formula (I) is a mercapto group or a heterocyclic group, examples are shown below; however, the present invention is not to be construed as being limited to these compounds:
$HSCH_2CH_2SO_3H$ (I-1)
$HSCH_2CO_2H$ (I-2)
(I-3)
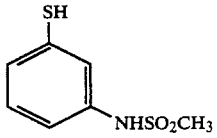
(I-4)
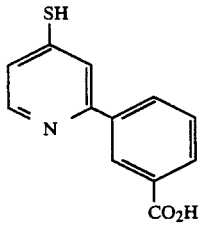
(I-5)
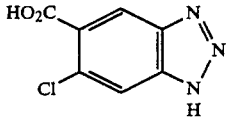
(I-6)
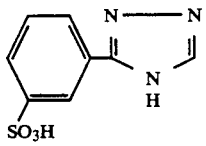
(I-7)
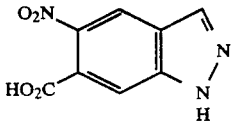
(I-8)
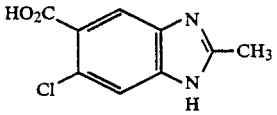
(I-9)
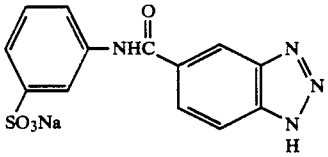
If C in the general formula (I) is a thioamido group, examples are shown below; however, the present invention is not to be construed as being limited to these compounds.
(I-10)
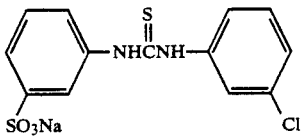
-continued
(I-11)
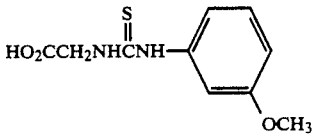
(I-12)
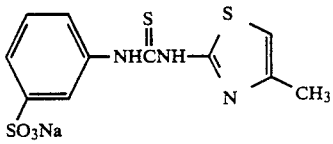
(I-13)
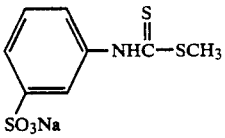
(I-14)
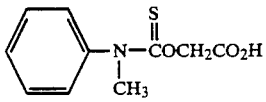
(I-15)
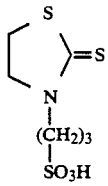
(I-16)
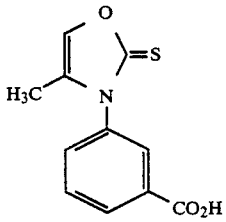
(I-17)
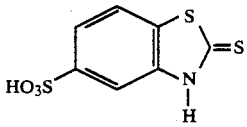
(I-18)
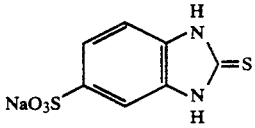
(I-19)
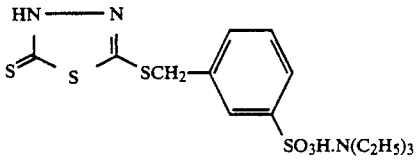
(I-20)
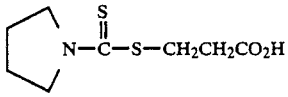

-continued (I-21)

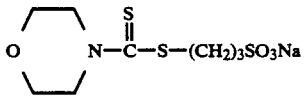

By referring to *Comprehensive Heterocyclic Chemistry, The Structure, Reactions, Synthesis and Use of Heterocyclic Compounds,* by A. Katritzky and C. W. Reese, Pergamon Press, Oxford (1984), Vol. 2–6, the heterocyclic compounds represented by the general formula (I) can be synthesized easily. Further, by referring to *Methoden der Organischen Chemie,* by E. Miiller, Georg Thieme Verlag, Stuttgart (1955), Vol. 9, the thioamido compounds described above can be synthesized, and compounds not described therein can be synthesized in a manner similar to the methods described therein, as would be understood by one of ordinary skill in the art.

Examples of compounds represented by the general formula (I) having a radical where C is represented by the general formulae (I') and (I'') are shown below; however, the present invention is not to be construed as being limited to these compounds.

(I'-1)

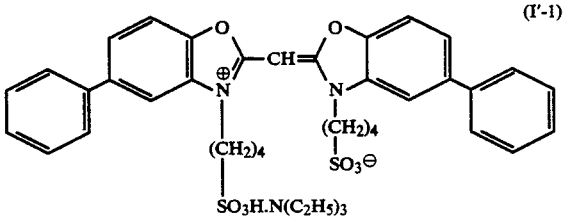

(I'-2)

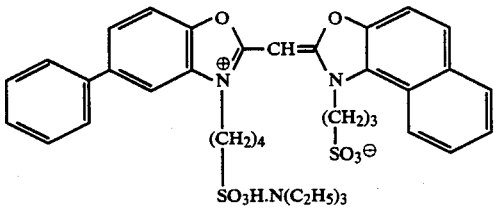

(I'-3)

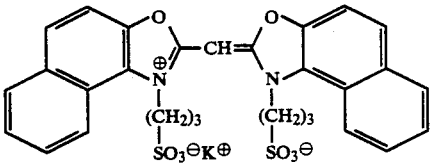

(I'-4)

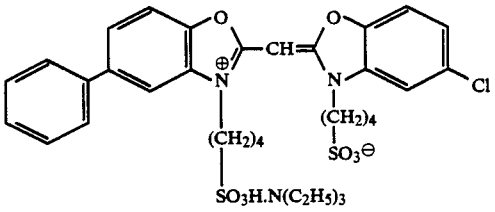

-continued (I'-5)

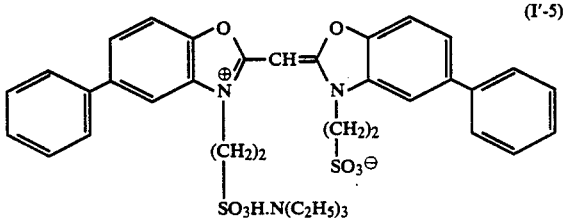

(I'-6)

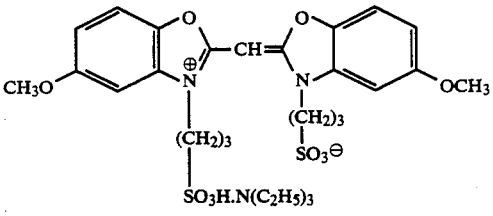

(I'-7)

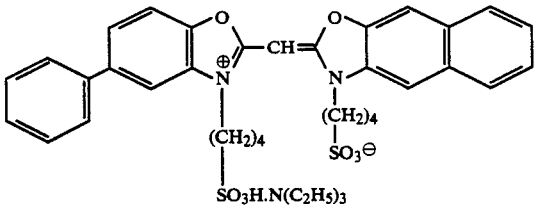

(I'-8)

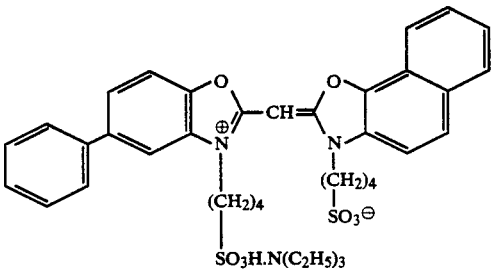

(I'-9)

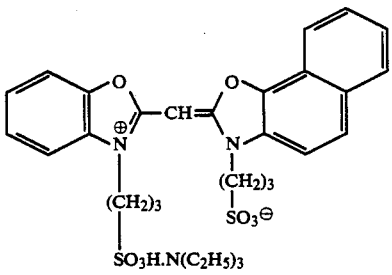

(I'-10)

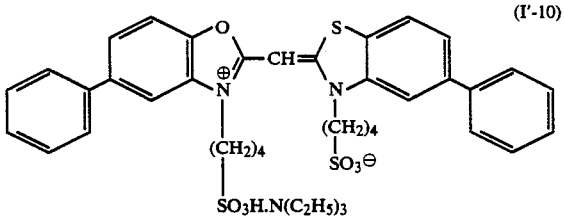

-continued
(I'-11)
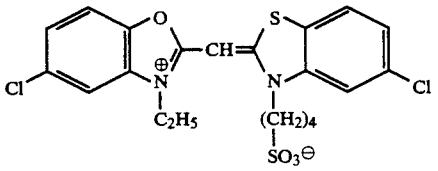
(I'-12)
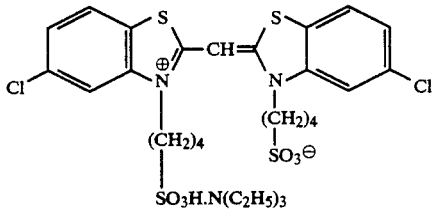
(I'-13)
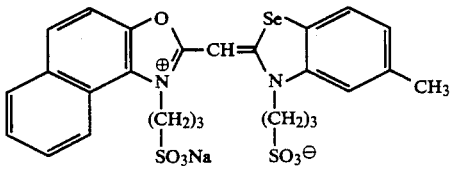
(I'-14)
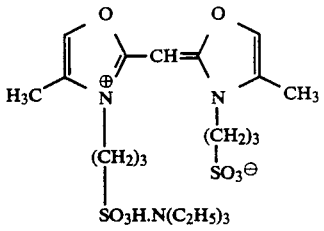
(I'-15)
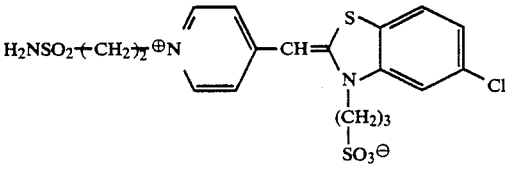
(I'-16)
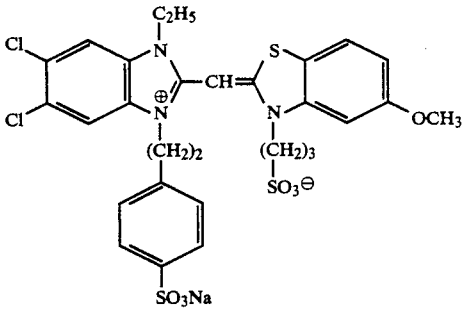
(I'-17)
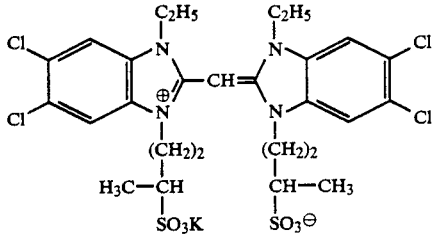
-continued
(I'-18)
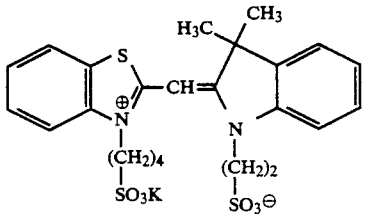
(I'-19)
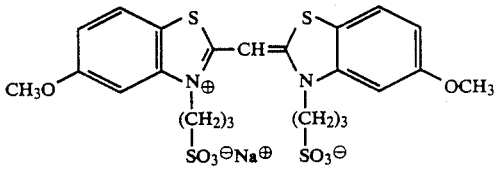
(I'-20)
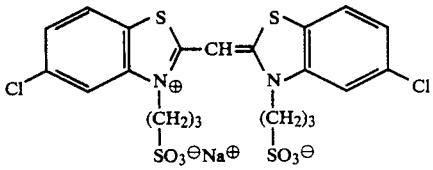
(I'-21)
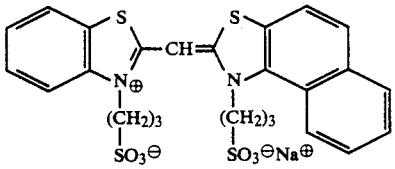
(I'-22)
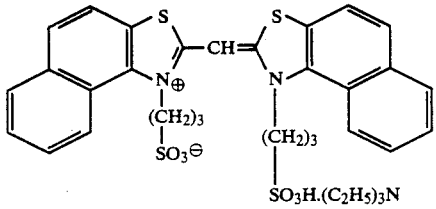
(I''-1)
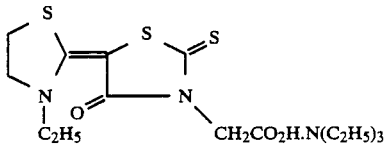
(I''-2)
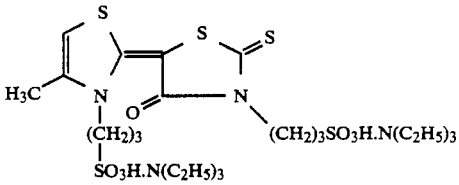
(I''-3)
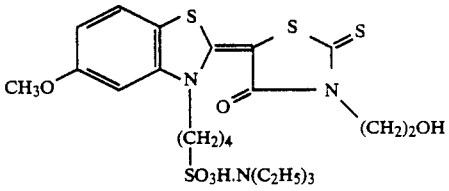

-continued (I''-4)

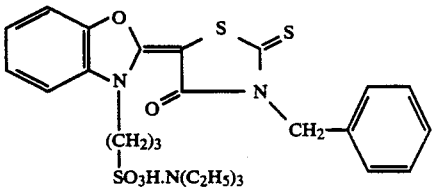

(I''-5)

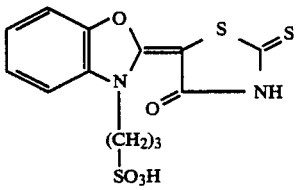

(I''-6)

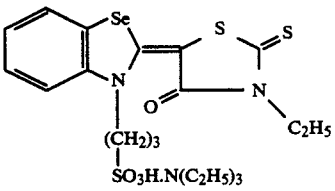

(I''-7)

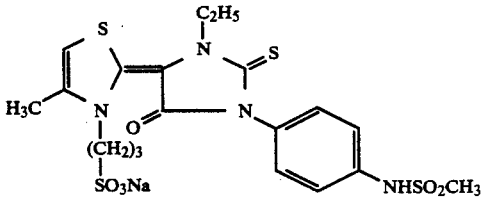

(I''-8)

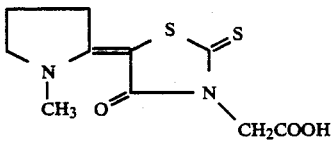

(I''-9)

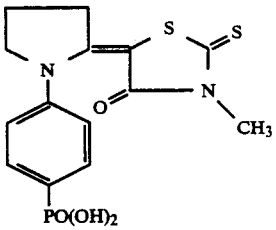

(I''-10)

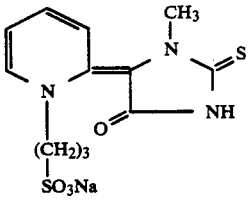

-continued (I''-11)

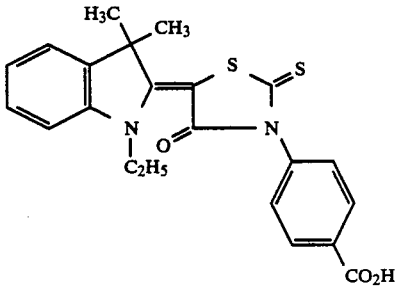

(I''-12)

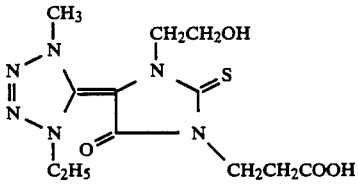

Compounds represented by the general formulae (I') and (I'') are described in U.S. Pat. Nos. 2,852,385, 2,694,638, 3,615,635, 2,912,329, 3,364,031, 3,397,060 and 3,506,443, British Patent No. 1,339,833, etc., and can be easily synthesized by those skilled in the art by referring to these patent specifications or *The Cyanine Dyes and Related Compounds* written by F. M. Hamer, Interscience Publishers, New York (1964). Other compounds represented by the general formulae (I') and (I'') that are not described in these publications can be synthesized in a manner similar to the methods described therein, and such would be recognized by one of ordinary skill in the art.

When the hydrazine derivative and the compound represented by the general formula (I) are to be contained in a photographic material of the present invention, although it is preferred that they be present in the silver halide emulsion layer, they may also be present in other light-insensitive hydrophilic colloid layers (e.g., a protective layer, an intermediate layer, a filter layer, an antihalation layer, etc.). More particularly, when the hydrazine derivative or the compound represented by the general formula (I) is soluble in water, it is added in the form of an aqueous solution to a hydrophilic colloid solution, whereas when the compound is sparingly water-soluble, it is added in the form of a solution in an organic solvent miscible with water such as alcohols, esters, ketones, etc., to a hydrophilic colloid solution. When the compound is added to the silver halide emulsion layer, although it may be added thereto at any time after the start of the chemical ripening and before coating of the emulsion layer, it is preferred that it is added after the chemical ripening but before coating. Particularly, it is advantageous to add the compound to a prepared coating composition.

It is desirable that the amount of hydrazine derivatives to be added to one or more layers of the photographic material of the present invention is selected so as to be optimized according to the grain diameter of the silver halide grains comprising silver halide emulsion, the halogen composition of the grains, the method and degree of chemical sensitization, the relationship betwen the layer where the compound is to be contained and the silver halide emulsion layer, the type of the antifoggant compound employed, etc., and the test method of selecting the amount is well known to those skilled in the art. Preferably, however, the amount is in the range of about $1\times10^{-6}$ to about $5\times10^{-2}$ mol, particularly $1\times10^{-5}$ to $2\times10^{-2}$ mol, per mol of total silver halide.

In the present invention, the compounds represented by the general formula (I) can be added in a manner similar to that described above with respect to the hydrazine derivatives, and the amount thereof is preferably about $1\times10^{-5}$ to $1\times10^{-3}$ mol per mol of total silver halide.

Although the composition of the silver halide emulsion used in the present invention may comprise any of silver chloride, silver chlorobromide, silver iodobromide, silver iodochlorobromide, etc., the emulsion preferably contains silver iodide in an amount of not more than about 10 mol %, more preferably 0.1 to 5 mol %.

The average grain size of the silver halide grains used in the present invention is preferably small (e.g., not more than about 0.7 μm, more preferably not more than 0.5 μm). Basically, although there is no restriction as to the grain size distribution, a monodispersed system is preferred. Herein, a monodispersed system is a system comprising grains wherein at least 95% by weight, or in terms of the number of grains 95%, have a size within ±40% of the average grain size.

The silver halide grains in the photographic emulsion may have a regular crystal shape, for example, that of a cube, an octahedron, a tetradecahedron, or a rhombic dodecahedron, or may comprise an irregular crystal shape, for example, that of a sphere, a plate, or further may be tabular grains having an aspect ratio of 3 to 20, or may be of a composite crystal form based on these shapes.

The internal portion and the outer surface layer of the silver halide grains may comprise a uniform phase or different phases. Two types of silver halide emulsions prepared separately may be mixed and used herein, if desired.

In the process of forming or physically ripening the silver halide emulsion, a cadmium salt, a sulfite, a lead salt, a thallium salt, a rhodium salt or its complex salts, or an iridium salt or its complex salts can also be present.

A silver halide particularly suitable for use in the present invention is prepared in the presence of an iridium salt or a complex salt thereof in an amount of about $10^{-8}$ to about $10^{-5}$ mol per mol of silver and comprises a silver haloiodide having a silver iodide content at the grain surface greater than the average silver iodide content of the grains. When an emulsion containing such a silver haloiodide is used, photographic characteristics that are high in sensitivity and have a high gamma can be obtained.

In connection therewith, it is desirable that an iridium salt in the amount stated above is added before physical ripening is completed during the process of producing a silver halide emulsion, in particular, when the grains are formed.

Iridium salts which may be used herein include water-soluble iridium salts or iridium complexes such as iridium trichloride, iridium tetrachloride, potassium hexachloroiridate (III), potassium hexachloroiridate (IV), ammonium hexachloroiridate (III), etc.

The silver halide emulsion in the photosensitive material used in the present invention may comprise one type of silver halide emulsion or two or more types of silver halide emulsions (e.g., having differences in average grain size, halogen composition, crystal habit, or conditions for chemical sensitization).

If two types of emulsions are used, it is preferred to employ two types of monodispersed emulsions having grains with different average grain size, as disclosed in Japanese Patent Application (OPI) No. 223734/86 and U.S. patent application Ser. No. 918,443 (filed on Oct. 14, 1986) to achieve an increase in maximum density, and when using an emulsion comprising small-sized monodispersed grains, it is preferred that they are chemically sensitized, with chemical sensitization most preferably being carried out by a sulfur sensitization method. If large-sized monodispersed grains are present in the emulsion, it may or may not be chemically sensitized. In this latter case using large-sized monodispersed emulsion grains, because, generally, black peppers are liable to be formed, it is preferred that chemical sensitization is not carried out, or if chemical sensitization is carried out, the chemical sensitization is only carried out to a slight degree. In other words, in comparison to chemical sensitization for small-sized grains, chemical sensitization is carried out in such a manner that the period of chemical sensitization is relatively short, the temperature at which chemical sensitization takes place is lower, or a smaller amount of the chemical sensitizer is used. Although there is no particular restriction on the sensitivity difference between a large-sized grain-containing monodispersed emulsion and a small-sized grain-containing monodispersed emulsion, preferably the sensitivity difference is about 0.1 to about 1.0 measured as $\Delta\log E$, more preferably 0.2 to 0.7. Further, when using a large-sized grain-containing monodispersed emulsion, it is preferred that $\Delta\log E$ is high.

A silver halide emulsion layer may comprise a single layer or be of a multilayer structure (i.e., two layers, three layers, etc.). In the latter case, different silver halide emulsions or the same silver halide emulsion may be used.

As a binder or a protective colloid for a photographic emulsion, it is advantageous to use gelatin, but other hydrophilic colloids can also be used. For example, gelatin derivatives, graft polymers of gelatin with other polymers, proteins such as albumin and casein, cellulose derivatives such as hydroxyethyl cellulose, carboxymethyl cellulose, and cellulose sulfuric acid esters, sugar derivatives such as sodium alginate and starch derivatives, various synthetic hydrophilic polymeric substances such as homopolymers and copolymers of, for example, polyvinyl alcohols, polyvinyl alcohol partial acetals, poly-N-vinyl pyrrolidones, polyacrylic acids, polymethacrylic acids, polyacrylamides, polyvinyl imidazoles, polyvinyl pyrazoles, etc., can be used.

Gelatin may be used as the binder as lime-processed gelatin or acid-processed gelatin, and gelatin hydrolysates and gelatin enzyme decomposition products can also be used as the binder.

The silver halide emulsion used in the present invention may or may not be chemically sensitized. Known methods of chemically sensitizing silver halide emulsions include sulfur sensitization, reduction sensitization and noble metal sensitization, which may be used alone or in combination.

Noble metal sensitization encompasses gold metal sensitization as a representative method, employing gold compounds and, in particular, gold complex salts. Noble metal sensitization, in addition to gold complex salts, may also employ complex salts of platinum, palladium, iridium, etc., as sensitizers and examples thereof are described in U.S. Pat. No. 2,448,060 and British Patent No. 618,061.

In addition to sulfur compounds contained in gelatin, suitable sulfur sensitizers include various sulfur compounds such as thiosulfates, thioureas, thiazoles, rhodanines, etc. Examples thereof are described in U.S. Pat. Nos. 1,574 944, 2,278,947, 2,410,689, 2,728,668, 3,501,313 and 3,656,952.

Reduction sensitizers include stannous salts, amines, formamidinesulfinic acid, silane compounds, etc., and examples thereof are described in U.S. Pat. Nos. 2,487,850, 2,518,698, 2,983,609, 2,983,610 and 2,694,637.

For the purpose of increasing the sensitivity, sensitizing dyes having absorption maximums in the visible region may be added to the photosensitive materials used in the present invention as described in Japanese Patent Application (OPI) No. 52050/80, pages 45–53 (such as cyanine dyes, merocyanine dyes, etc.). Thus, spectral sensitization on the longer wavelength side from the inherent sensitivity region of silver halides can be effected.

Of the sensitizing dyes having absorption maximum in the visible region, trimethine dyes are preferably used in the present invention due to less remaining color and fewer black peppers.

These sensitizing dyes may be used alone or in combination, and a combination of sensitizing dyes is often used for the purpose of supersensitization.

Specifically, a combination of trimethine dyes and merocyanine dyes is preferably used in view of the high senstivity, less remaining color and fewer black peppers.

In addition to sensitizing dyes, other dyes that have no spectral sensitizing effect but exhibit supersensitization, or other compounds that do not absorb visible light but exhibit supersensitization, may also be present in the emulsions.

Useful sensitizing dyes, combinations of dyes exhibiting supersensitization and other compounds exhibiting a supersensitization effect are described in *Research Disclosure*, Vol. 176, RD No. 17643 (December, 1978), under "J" in IV on page 23.

The above Research Disclosure, under "J" in § IV on page 23 mentions as among useful spectral sensitizing dyes for sensitizing silver halide emulsions those found in U.K. Patent No. 742,112 Brooker, U.S. Pat. No. 2,078,233 Brooker and U.S. Pat. No. 3,506,443 Motter, among others.

U.K. Patent No. 742,112 discloses sensitizing dyes of formula (XI), U.S. Pat. No. 2,078,233 Brooker discloses sensitizing dyes of formulae (XII and (XII;) and U.S. Pat. No. 3,506,443 Motter discloses dyes of formulae (XIV) and (XV) as set forth below.

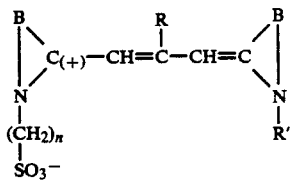
(XI)

in which B together with the adjacent C atom and N atom represents a heterocyclic residue, n represents a positive integer of at least 3 but not more than 18, the $CH_2$ group may be substituted, and R and R, represent a substituted or unsubstituted alkyl radical;

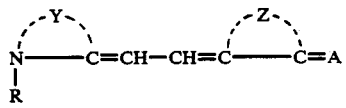
(XII)

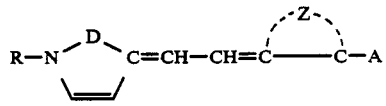
(XIII)

wherein A represents an atom selected from the group consisting of oxygen and sulfur, D represents a phenylene group, R represents an alkyl group, and Y and Z represent the non-metallic atoms necessary to complete a heterocyclic nucleus selected from the group consisting of five-membered and six-membered heterocyclic nuclei;

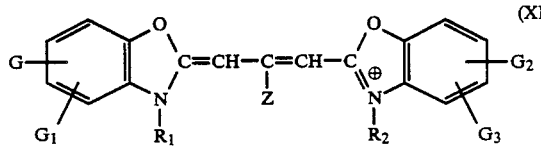
(XIV)

$(X^{\ominus})_{n-1}$ wherein G and $G_3$ each represents a group selected from the group consisting of a halogen atom, a hydroxyl group, an alkoxy group, an amino group, an acylamino group, an acyloxy group, a carbalkoxy group, an alkoxycarbamylamino group, and a phenyl group, such that not more than one of G and $G_3$ each represents a phenyl group $G_1$ and $G_2$ each represents a group selected from the group consisting of a hydrogen atom and a halogen atom; $R_1$ represents an alkyl group, a carboxy alkyl group or a sulfoalkyl group; $R_2$ represents an alkyl group, a carboxyalkyl group or a sulfoalkyl group; Z represents a group selected from the group consisting of a hydrogen atom, an alkyl group and an aryl group; and X represents an acid anion; n represents an integer of from 1 to 2, such that n represents the integer 1 when at least one of $R_1$ and $R_2$ represents a group selected from the group consisting of a sulfoalkyl group and a carboxyalkyl group; and

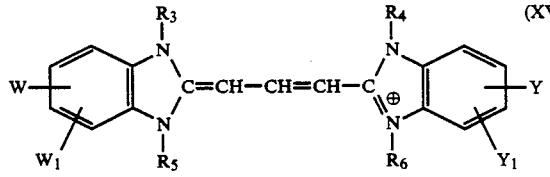
(XV)

$(X_1^{\ominus})_{m-1}$ wherein W and Y each represents a group selected from the group consisting of a hydrogen atom, a halogen atom, an alkoxy group, an amino group, an acylamino group, an acyloxy group, and an alkoxycarbonylamino group; $W_1$ and $Y_1$ each represents a group selected from the group consisting of a hydrogen atom and a halogen atom; $R_3$ represents an alkyl group; $R_4$ represents an alkyl group; $R_5$ and $R_6$ each represents a group selected from the group consisting of an alkyl group, a sulfoalkyl group and a carboxyalkyl group; and XI represents an acid ion; and m represents the integer 1 when at least one of $R_5$ and $R_6$ represents a group selected from the group consisting of a sulfoalkyl group and a carboxyalkyl group.

To prevent fogging during the formation of the photosensitive materials, or during storage or photographic processing of the photosensitive materials, or to stabilize the photographic performance characteristics, various compounds may be incorporated in the photosensitive material of the present invention. For instance, various compounds known as antifoggants or stabilizers can be added thereto, such as azoles (for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.); mercaptopyrimidines; mercaptotriazines; thioketo compounds such as oxazolinethione; azaindenes (such as triazaindenes, tetraazaindenes (in particular 4-hydroxy-substituted (1,3,3a,7)tetraazaindenes), pentaazaindenes, etc.); benzenethiosulfonic acid, benzenesulfinic acid, benzenesulfonic acid amide, etc. Of these compounds, benzoltriazoles (e.g., 5-methylbenzotriazole), tetraazaindenes (e.g., 4-hydroxy-6-methyl-1,3,3a,7-tetraazaindene) and nitroindazoles (e.g., 5-nitroindazole) are preferred. These compounds may also be present in a processing solution to be used during photographic processing.

A 4-hydroxy-6-methyl-1,3,3a,7-tetraazaindene is most preferred as a stabilizer. When a 4-hydroxy-6-methyl-1,3,3a,7-tetraazaindene is used in the present invention, hydroquinone is preferably used together. In such a case, they are preferably incorporated in a silver halide emulsion layer or a adjacent layer thereto and the amounts of 4-hydroxy-6-methyl-1,3,3a,7-tetraazaindene and hydroquinone preferably range $1\times10^{-4}$ to $2\times10^{-2}$ mol per mol of total silver halide and $1\times10^{-3}$ to $1\times10^{-1}$ mol per mol of total silver halide, respectively.

In the photosensitive material of the present invention, one or more of the photographic emulsion layers or other hydrophilic colloid layers may contain an inorganic or organic hardening agent. For example, chromates (chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (mucochloric acid, mucophenoxychloric acid, etc.), etc., can be used alone or in combination.

One or more of the photographic emulsion layers or other hydrophilic colloid layers of the photosensitive material prepared in accordance with the present invention may contain various surface active agents for the purposes of assisting coating, preventing electrification, improving sliding properties, improving emulsification and dispersion, enhancing photographic characteristics (e.g., improving development, hardening, and sensitization) and preventing adhesion, as well as for other known purposes.

For example, the following surface active agents may be used: nonionic surface active agents such as saponins (steroid type), alkylene oxide derivatives (e.g., polyethylene glycols, polyethylene glycol/propylene glycol condensates, polyethylene glycol alkyl ethers, polyethylene glycol alkylaryl ethers, polyethylene glycol esters polyethylene glycol sorbitan esters, polyalkylene glycol alkylamines or amides, and polyethylene oxide adducts of silicones), glycidol derivatives (e.g., alkenylsuccinic acid polyglycerides, and alkylphenol polyglycerides), fatty acid esters of polyhydric alcohols, alkyl esters of sugars, etc.; anionic surface active agents containing an acid group such as a carboxy group, a sulfo group, a phospho group, a sulfate group, a phosphate group, etc., such as alkylcarboxylates, alkylsulfonates, alkylbenzenesulfonates, alkylnaphthalenesulfonates, alkylsulfates, alkyl phosphates, N-acyl-N-alkyl taurines, sulfosuccinates, sulfoalkyl polyoxyethylenealkylphenyl ethers polyoxyethylenealkyl phosphate, etc.; amphoteric surface active agents such as amino acids, aminoalkylsulfonic acids, aminoalkylsulfonic acid esters, aminoalkylphosphoric acid esters, alkylbetaines, aminoxides, etc.; and cationic surface active agents such as alkylamine salts, aliphatic or aromatic quaternary ammonium salts, heterocyclic quaternary ammonium salts of pyridinium or imidazolium, and aliphatic or heterocyclic ring-containing phosphonium salts or sulfonium salts.

Surface active agents preferably used in the present invention are polyalkylene oxides having a molecular weight of about 600 or higher as described in Japanese Patent Publication No. 9412/83.

To prevent static electrical charges, it is preferred to use fluorine-containing type surface active agents, such as those described in Japanese Patent Application (OPI) No. 80849/85, etc.

One or more of the photographic emulsion layers or other hydrophilic colloid layers in the photographic material of the present invention may contain hydroquinone derivatives (so-called DIR hydroquinones) capable of releasing a development restrainer according to the density of the image when developed.

Examples thereof are the compounds described in U.S. Pat. Nos. 3,379,529, 3,620,746, 4,377,634 and 4,332,878, Japanese Patent Application (OPI) Nos. 129536/74, 67419/79, 153336/81, 153342/81, 233642/85, 233648/85 and 18946/86, etc.

To prevent adhesion, one or more of the photographic emulsion layers and other hydrophilic colloid layers in the photographic material of the present invention may contain a matting agent such as silica, magnesium oxide, polymethyl methacrylates, etc.

The photosensitive material used in the present invention can also contain dispersions of water-insoluble or sparingly water-soluble synthetic polymers to improve dimensional stability or the like. For example, polymers of alkyl (meth)acrylates, alkoxyalkyl (meth)acrylates, glycidyl (meth)acrylates, (meth)acrylamides, vinyl esters (e.g., vinyl acetate), acrylonitrile, olefins, styrene, etc., which may be used alone or in combination, or may be combined with acrylic acid, methacrylic acid, $\alpha,\beta$-unsaturated dicarboxylic acids, hydroxyalkyl (meth)acrylates, sulfoalkyl (meth)acrylates, styrene sulfonic acid, or the like can be used. For example, the polymers described in U.S. Pat. Nos. 2,376,005, 2,739,137, 2,853,457, 3,062,674, 3,411,911, 3,525,620, 3,607,290 and 3,645,740 can be used.

Of these, polymer latex of alkylacrylate is preferably used in the present invention.

To prevent black peppers from being formed, preferably one or more of the silver halide emulsion layers and other layers in the photographic material of the present invention can contain a compound having an acid group (other than the compounds represented by the general formula (I) described above). Suitable compounds having an acid group include organic acids such as salicylic acid, acetic acid, ascorbic acid, etc., and polymers or copolymers having as repeating units acid monomers such as acrylic acid, maleic acid, or phthalic acid. Examples of these compounds can be found in Japanese Patent Application (OPI) Nos. 228334/86 and 228437/86, Japanese Patent Application No. 163856/85, and U.S. patent application Ser. No. 904,062 (filed on Sept. 4, 1986). Of these, preferred are low molecular weight compounds such as ascorbic acid, and preferred high molecular weight compounds are water-dispersible latexes of copolymers comprising a cross-linkable monomer having more than one unsaturated group, such as divinyl benzene, and an acid monomer such as acrylic acid.

To obtain superhigh contrast and high sensitivity photographic characteristics using the present silver halide photographic material, it is not required to use conventional infectious type developing solutions or high alkaline developing solutions (i.e., having a pH of about 13 as described in U.S. Pat. No. 2,419,975), but a stable developing solution can be advantageously used.

Thus, the silver halide photographic material of the present invention is capable of providing a negative image of superhigh contrast by employing a developing solution containing as a preservative sulfite ions in an amount of about 0.15 mol/liter or more and having a pH of about 10.5 to about 12.3, particularly, 11.0 to 12.0.

Although there is no specific restriction as to the developing agent used for the developing solution for the present invention, with a view to obtaining good dot quality, the developing agent contains dihydroxybenzenes, and in some cases, a combination of a dihydroxybenzene and a 1-phenyl-3-pyrazolidone or a combination of a dihydroxybenzene and a p-aminophenol can be used.

Dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone, with hydroquinone being particularly preferred.

Developing agents which are 1-phenyl-3-pyrazolidones or their derivatives can also be used in the present invention, including 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

p-Aminophenol type developing agents which can be used in the present invention are N-methyl-p-aminophenol, p-aminophenol, N-(β-hydroxyethyl)-p-aminophenol, N-(4-hydroxyphenyl)glycine, 2-methyl-p-aminophenol, p-benzylaminophenol, etc., with N-methyl-p-aminophenol being preferred.

In general, the developing agent is preferably used in an amount of about 0.05 mol/liter to about 0.8 mol/liter. When a combination of dihydroxybenzenes and 1-phenyl-3-pyrazolidones or p-aminophenols is used, it is preferred that the amount of the former is about 0.05 mol/liter to about 0.5 mol/liter, and the amount of the latter is not more than about 0.06 mol/liter.

Sulfite preservatives which are used in the present invention include sodium sulfite, potassium sulfite, lithium sulfite, ammonium sulfite, sodium bisulfrte, potassium metabisulfite, sodium formaldehyde bisulfite, etc. It is preferred that the sulfite is used in an amount of about 0.4 mol/liter or more, in particular, 0.5 mol/liter or more, with the upper limit preferably being about 2.5 mol/liter.

The alkali agents for adjusting the pH of the developer may include buffers and pH adjustors such as sodium hydroxide, potassium hydroxide, sodium carbonate, potassium carbonate, sodium tertiary phosphate, and potassium tertiary phosphate. The pH of the developing solution is between about 10.5 and about 12.3.

Additives for the developer which may be used in addition to the above various additives include compounds such as boric acid and borax, development restrainers such as sodium bromide, potassium bromide and potassium iodide; organic solvents such as ethylene glycol, diethylene glycol, triethylene glycol, dimethylformamide, methyl cellosolve, hexylene glycol, ethanol and methanol; and black pepper preventing agents or antifoggants such as indazole type compounds (for example, 1-phenyl-5-mercaptotetrazole, and 5-nitroindazole), benzotriazole type compounds (for example, 5-methylbenzotriazole); and if required, toning agents, surface active agents, defoaming agents, hard water softeners, hardening agents or amino compounds as described in Japanese Patent Application (OPI) No. 106244/81, etc., may be included.

Compounds described in Japanese Patent Application (OPI) No. 24347/81 as silver stain preventing agents can also be used in the developing solution of the present invention. Dissolving aids which may be added to the developing solution include the compounds described in Japanese Patent Application (OPI) No. 267759/86, and pH buffers which may be used in the developing solution include the compounds described in Japanese Patent Application (OPI) No. 93433/85 and Japanese Patent Application No. 28708/86.

Fixing solutions can be used which have compositions generally used in photographic processing of this type. The fixing agent .may contain thiosulfates and thiocyanates, and organic sulfur compounds known to have an effect as fixing agents. The fixing solution may further contain as a hardener a water-soluble aluminum salt (e.g., aluminum sulfate, alum, etc.). The amount of the water-soluble aluminum salt is generally 0.4 to 2.0 g/liter in terms of Al. Further, a complex of a trivalent iron compound as an oxidizing agent with ethylenediaminetetraacetic acid can be used.

The development temperature is generally selected from about 18° to about 50° C., preferably 25° to 43° C.

The present invention will now be further explained with reference to the following examples; however, the examples are not to be construed as limiting the scope of the present invention in any manner. Unless otherwise indicated, all parts, percents, ratios and the like are by weight.

EXAMPLE 1

An aqueous silver nitrate solution and an aqueous potassium bromide/potassium iodide solution were mixed by the double jet method in the presence of ammonia with the pAg being kept at 7.9 to prepare a silver bromoiodide Emulsion A (comprising 2 mol % of silver iodide and 98 mol % of silver bromide) of monodispersed cubic grains having an average grain size of 0.2 μm. Separately from that, an aqueous silver nitrate solution and an aqueous potassium bromide solution were mixed by the double jet method in the presence of ammonia with the pAg being kept at 7.9 to prepare a silver bromide Emulsion B of monodispersed cubic grains having an average grain size of 0.35 μm. Emulsion A was further sulfur-sensitized by sodium thiosulfate.

Sensitizing Dye (5,5'-dichloro-3,3'-di(3-sulfopropyl)-9-ethyloxacarbocyanine sodium salt) was added to Emulsions A and B in amounts of $6\times10^{-4}$ mol and $4.5\times10^{-4}$ mol per mol of silver, respectively, followed by spectral sensitization.

Then, as a stabilizer, 4-hydroxy-6-methyl-1,3,3a,7-tetraazaindene was added to each emulsion.

These Emulsions A and B were then mixed so that the silver halide weight ratio was 6 to 4, and as shown in Table 1, Sensitizing Dye A shown below (represented merely as "A" in Table 1) was added, or the compounds represented by the general formula (I) was added (the specific compounds as designated in the specification are shown in Table 1.).

Sensitizing Dye A

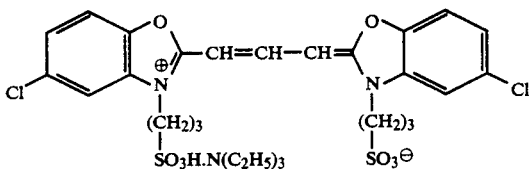

Then, a hydrazine derivative having the following structure was added in an amount of $4\times10^{-3}$ mol per mol of silver.

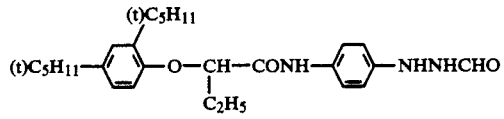

Further, as a surface active agent, an alkylbenzenesulfonate, and as a hardening agent, a vinyl sulfonic acid type hardening agent were added, then after the pH of the emulsions were adjusted to 5.8, the thus-prepared emulsions were coated on each polyethylene terephthalate support having a thickness of 100 μm so that the amount of the applied silver was 3.0 g/m². As a protective layer, gelatin in an amount of 1 g/m² was coated thereon to prepare Sample Nos. 1 to 43 as shown in Table 1.

After the samples were exposed to a tungsten light of 3,200° K. through an optical wedge used for sensitometry for 5 seconds, they were developed with the developing solution having the following composition at 38° C. for 30 seconds, followed by fixing, washing and drying (the development was carried out using an automatic developing processor, FG-660F, manufactured by Fuji Photo Film Co., Ltd.).

| Developing Solution | |
|---|---|
| Hydroquinone | 35.0 g |
| N-Methyl-p-aminophenol ½ Sulfate | 0.8 g |
| Sodium Hydroxide | 13.0 g |
| Potassium Tertiary Phosphate | 74.0 g |
| Potassium Sulfite | 90.0 g |
| Disodium Ethylenediaminetetraacetate | 1.0 g |
| Potassium Bromide | 4.0 g |
| 5-Methylbenzotriazole | 0.6 g |
| 3-Diethylamino-1,2-propanediol | 15.0 g |
| Water to make | 1 liter |

-continued

| Developing Solution | |
|---|---|
| | (pH 11.5) |

The photographic characteristics of the thus-obtained samples are shown in Table 1.

The relative sensitivity was a relative value of a reciprocal of exposure resulting in a density of 1.5, and the value of Sample 1 was established as 100. The evaluation as to amount of black peppers formed was made by observing the size and the number of black peppers formed in unexposed portions of the sample using a 25× magnifier, and then measured on scale of 1 to 5, with a rating of 5 indicating the least formation of black peppers and a rating of 1 indicating the highest formation of black peppers. The remaining color was evaluated such that samples developed at 38° C. for 20 seconds were made separately, and the tint at the unexposed portions was evaluated visually.

As will be understood from Table 1, when the compounds of the present invention were used, the amount of black peppers formed was remarkably improved. Although the amount or occurrence of black peppers could be reduced by increasing the addition amount of the spectral sensitizing dye, Sensitizing Dye A, the remaining color was adversely affected On the other hand, instead of adding this spectral sensitizing dye A, when the present compounds were used, the amount of remaining color was acceptable.

The compounds of the present invention used herein had substantially no absorption maximum in the visible region, and did not have spectral sensitization in the longer wavelength regions. Rather, they were apt to decrease the sensitivity and $D_{max}$ a slight amount, but not to such levels that would cause problems in practical usage.

TABLE 1

| Sample No.* | Compound Type | Compound Amount (mol/mol of Ag) | Relative Sensitivity | $D_{max}$ | Amount of Black Peppers | Remaining Color |
|---|---|---|---|---|---|---|
| 1 | — | — | 100 | 5.31 | 1 | Good |
| 2 | A | $2.5\times10^{-4}$ | 103 | 5.33 | 2 | Rather good |
| 3 | " | $5.0\times10^{-4}$ | 105 | 5.27 | 3 | Bad |
| 4 | " | $7.5\times10^{-4}$ | 106 | 5.25 | 4 | " |
| 5 | (I'-1) | $2.5\times10^{-4}$ | 96 | 5.30 | 3 | Good |
| 6 | " | $5.0\times10^{-4}$ | 96 | 5.15 | 4 | " |
| 7 | " | $7.5\times10^{-4}$ | 96 | 5.07 | 5 | " |
| 8 | (I'-2) | $2.5\times10^{-4}$ | 96 | 5.31 | 3 | " |
| 9 | " | $5.0\times10^{-4}$ | 96 | 5.30 | 4 | " |
| 10 | " | $7.5\times10^{-4}$ | 93 | 5.25 | 5 | " |
| 11 | (I'-6) | $2.5\times10^{-4}$ | 100 | 5.30 | 3 | " |
| 12 | " | $5.0\times10^{-4}$ | 100 | 5.31 | 3 | " |
| 13 | " | $7.5\times10^{-4}$ | 98 | 5.28 | 4 | " |
| 14 | (I'-9) | $2.5\times10^{-4}$ | 100 | 5.33 | 3 | " |
| 15 | " | $5.0\times10^{-4}$ | 99 | 5.30 | 3 | " |
| 16 | " | $7.5\times10^{-4}$ | 5.03 | 4 | " | |
| 17 | (I'-10) | $2.5\times10^{-4}$ | 94 | 5.20 | 3 | " |
| 18 | " | $5.0\times10^{-4}$ | 92 | 5.06 | 4 | Rather good |
| 19 | " | $7.5\times10^{-4}$ | 89 | 5.95 | 4 | Rather good |
| 20 | (I'-12) | $2.5\times10^{-4}$ | 98 | 5.27 | 3 | Good |
| 21 | " | $5.0\times10^{-4}$ | 98 | 5.23 | 4 | Rather good |
| 22 | " | $7.5\times10^{-4}$ | 96 | 5.19 | 4 | " |
| 23 | (I-6) | $2.5\times10^{-4}$ | 87 | 5.18 | 2 | Good |
| 24 | " | $5.0\times10^{-4}$ | 84 | 5.15 | 2 | " |
| 25 | " | $7.5\times10^{-4}$ | 80 | 5.03 | 2-3 | " |
| 26 | (I-9) | $2.5\times10^{-4}$ | 89 | 5.22 | 2 | " |
| 27 | " | $5.0\times10^{-4}$ | 88 | 5.19 | 2 | " |

TABLE 1-continued

| Sample No.* | Compound Type | Compound Amount (mol/mol of Ag) | Relative Sensitivity | $D_{max}$ | Amount of Black Peppers | Remaining Color |
|---|---|---|---|---|---|---|
| 28 | " | $7.5 \times 10^{-4}$ | 84 | 5.08 | 3 | " |
| 29 | (I-10) | $2.5 \times 10^{-4}$ | 105 | 5.35 | 2 | " |
| 30 | " | $5.0 \times 10^{-4}$ | 108 | 5.38 | 2 | " |
| 31 | " | $7.5 \times 10^{-4}$ | 113 | 5.39 | 2-3 | " |
| 32 | (I-15) | $2.5 \times 10^{-4}$ | 95 | 5.34 | 2 | " |
| 33 | " | $5.0 \times 10^{-4}$ | 97 | 5.33 | 2 | " |
| 34 | " | $7.5 \times 10^{-4}$ | 94 | 5.39 | 3 | " |
| 35 | (I"-1) | $2.5 \times 10^{-4}$ | 102 | 5.30 | 2 | " |
| 36 | " | $5.0 \times 10^{-4}$ | 100 | 5.28 | 2 | " |
| 37 | " | $7.5 \times 10^{-4}$ | 100 | 5.15 | 3 | Rather good |
| 38 | (I"-3) | $2.5 \times 10^{-4}$ | 101 | 5.28 | 2 | Good |
| 39 | " | $5.0 \times 10^{-4}$ | 104 | 5.30 | 2 | " |
| 40 | " | $7.5 \times 10^{-4}$ | 5.35 | 3 | Rather good | |
| 41 | (I"-4) | $2.5 \times 10^{-4}$ | 105 | 5.33 | 2 | Good |
| 42 | " | $5.0 \times 10^{-4}$ | 108 | 5.32 | 2 | " |
| 43 | " | $7.5 \times 10^{-4}$ | 115 | 5.35 | 3 | Rather good |

*Samples 1 to 4 are comparative samples, whereas Samples 5 to 43 are representative of the present invention.

EXAMPLE 2

Instead of Emulsion A as prepared in Example 1, a silver bromoiodide Emulsion A' (comprising 1 mol % of silver iodide and 99 mol % of silver bromide) that had been sulfur-sensitized and had an average grain size of 0.2 μm was used, and instead of Emulsion B as prepared in Example 1, a silver bromide Emulsion B' of monodispersed cubic grains having an average grain size of 0.3 μm that had not been chemically sensitized was used. As a sensitizing dye, instead of Sensitizing Dye A used in Example 1, 5,5'-diphenyl-3,3'-di(3-sulfobutyl)-9-ethyloxacarbocyanine sodium salt ($\phi_{max}$550 nm) was added to Emulsions A' and B' in an amount of $3.5 \times 10^{-4}$ mol per mol of silver to effect spectral sensitization.

Similarly to Samples 5 to 43 in Example 1, compounds of the present invention were further added, and the same tests were carried out. As in Example 1, when samples of the present invention were used, the amount of black peppers was improved remarkably. The remaining color was favorable when the samples were developed at 38° C. for 20 seconds.

EXAMPLE 3

Dot images were formed on Samples 5 to 43 in Example 1 as follows:

Each commercially available gray contact screen (150 lines/inch) for negatives was brought into firm contact with each sample, and the sample was exposed to white tungsten light through a step wedge with the step difference being 0.1. Development was carried out in a similar manner to Example 1. The obtained dot gradation was evaluated by the number of step wedges that could be counted by the transmitted light. In Comparative Example 1, the gradation showed 13 steps, but in the samples of the present invention, all showed 14 to 15 steps, proving that the dot gradation was rendered soft. Therefore, the samples of the present invention which have less dot choking provide good gradation reproducibility.

The greater the addition amount of compounds of the present invention, the softer was the resulting dot gradation.

When the dot quality was observed visually by a 25× magnifier, in the samples of the present invention the roughness around the dots was smooth and favorable.

EXAMPLE 4

Using Samples 5 to 43 in Example 1, an original obtained by combining a dot original and a letter original was photographed using a process camera by white tungsten light, and was developed in a similar manner as in Example 1. The exposure for each sample was changed such that the dot % of the dot original would be reproduced as 1 to 1.

In contrast to the samples in Comparative Examples 1 to 4, in the samples of the present invention, the number of pinholes was reduced to ½ to ⅓, and the trace of adhesive tape almost disappeared and was insignificant.

EXAMPLE 5

The procedures were the same as in Example 1, but using, instead of Compound (I'-1) used in Samples 5 to 7, Compounds (I'-4), (I'-5), (I'-8) or (I'-11) to prepare samples, and they were evaluated.

The results of photographic characteristics, levels of black peppers and remaining color were similar to the results shown in Example 1 for Samples

EXAMPLE 6

The procedures were the same as in Example 1, but using, instead of Compound (I'-1) used in Samples 5 to 7, Compounds (I'-2), (I'-3) or (I'-7) to prepare samples, and they were evaluated.

The dot gradation and dot quality were evaluated in the same manner as in Example 3, and the same degree of results as shown in Example 3 were obtained.

EXAMPLE 7

An aqueous silver nitrate solution and an aqueous potassium iodide and potassium bromide solution were simultaneously added to an aqueous gelatin solution kept at 50° C. in the presence of ammonia and iridium hexachloride in an amount of $4 \times 10^{-7}$ mol per mol of silver over 60 minutes, during which time the pAg was kept at 7.8 so that a cubic grain monodispersed emulsion having an average grain size of 0.25 μm and an average silver iodide content of 1 mol % was prepared. The emulsion was desalted by the flocculation method and sulfur-sensitized by hypo. The emulsion was divided, then, as a sensitizing dye, sodium salt of 5,5'-dichloro-9-ethyl-3,3'-bis(3-sulfopropyl)oxacarbocyanine, as a stabilizer, 4-hydroxy-6-methyl-1,3,3a,7-tetraazaindene, ascorbic acid, a dispersion of polyethyl acrylate, and 1,3-divinylsulfonyl-2-propanol were added, Compound (III-15) (of the general formula (III) of the present invention) and a compound represented by the general formula (I) were added as shown in Table 2. The resulting emulsions were coated simultaneously together with a protective layer on a polyethylene terephthalate support so that the amount of silver was 3.4 g/m². The samples were exposed in the same manner as in Example 1 and developed, and the photographic characteristics were compared. As is apparent from Table 2, in comparison with the comparative samples, in Sample Nos. 6 to 9 and 11 to 20 of the present invention, the decrease in sensitivity and gamma is less, the amount of black peppers formed is less, and, the dot gradation and the latitude of the line image are good.

Photographic Characteristics 1 were obtained by processing each sample for 30 seconds at 38° C. using Developing Solution A of the formulation described below by an FG-660F automatic developing processor (manufactured by Fuji Photo Film Co., Ltd.).

Photographic Characteristics 2 were obtained by using a developing solution after processing 200 sheets (50.8 cm×61 cm) of Fuji Lith Ortho Film GO-100 (manufactured by Fuji Photo Film Co., Ltd.) that had been blackened 100% and processing in the same manner as for Photographic Characteristics 1. The relative sensitivity is a relative value of a reciprocal of exposure resulting in a density of 1.5, and the value of Sample 1 was established as 100.

The evaluation of black peppers was carried out such that Developing Solution A was fatigued for 5 days without replenishing until the pH increased by 0.05 and the concentration of sulfite ions decreased to 50% of the fresh solution, and processing at 38° C. for 30 seconds was then carried out in the same manner as for Photographic Characteristics 1.

The black peppers were evaluated on a scale of 1 to 5 by observation using a microscope. A rating of 5 indicates the best quality, and a rating of 1 indicates the worst quality. A rating of 5 or 4 is acceptable for practical usage, a rating of 3 is not good, but can possibly be practically used, and a rating of 2 or 1 is not acceptable for practical purposes. The intermediate between a rating of 4 and a rating of 3 is expressed by a rating of 3.5.

The evaluation of the dot gradation was carried out by contacting samples firmly onto a commercially available contact screen (GCS 150) (manufactured by Fuji Photo Film Co., Ltd.) for GSL, exposing them to white tungsten light via a step wedge with the step difference being 0.1, and measuring the dot area ranging from 5% to 95% after developing at 38° C. for 30 seconds.

The latitude of the line image was measured by photographing an original comprising 7-class Ming-cho type and Gothic type phototype setting characters having a density of 0.5 to 1.2 by a camera (DSC351) manufactured by Dainippon Screen Mfg. Co., Ltd., and developing under the same conditions as for Photographic Characteristics 1. The measurements were on a scale of 1 to 5, a rating of 5 indicating the best quality and a rating of 1 indicating the worst quality. A rating of 5 or 4 is acceptable for practical usage, a rating of 3 is not good but possibly can be used practically, and a rating of 2 or 1 is not acceptable for practical use. The intermediate between a rating of 4 and a rating of 3 is expressed by a rating of 3.5.

| Developing Solution A | |
|---|---|
| Hydroquinone | 45.0 g |
| N-Methyl-p-aminophenol ½ Sulfate | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Disodium Ethylenediaminetetraacetate | 1.0 g |
| Potassium Bromide | 6.0 g |
| 5-Methylbenzotriazole | 0.6 g |
| n-Butyldiethanolamine | 15.0 g |
| Water to make | 1 liter (pH 11.6) |

TABLE 2

| Sample No.* | Compound of the General Formula (III) Type | Compound of the General Formula (III) Amount (mol/mol of Ag) | Compound of the General Formula (I) Type | Compound of the General Formula (I) Amount (mol/mol of Ag) | Photographic Characteristics 1 Sensitivity | Photographic Characteristics 1 γ | Photographic Characteristics 2 Sensitivity | Photographic Characteristics 2 γ | Dot Gradation | Latitude of Line Image | Amount of Black Peppers |
|---|---|---|---|---|---|---|---|---|---|---|---|
| 1 | A | $2 \times 10^{-3}$ | — | — | 100 | 16.5 | 79 | 9.0 | 1.2 | 4 | 3 |
| 2 | " | $4 \times 10^{-3}$ | — | — | 110 | 17.5 | 93 | 10.5 | 1.2 | 3.5 | 2 |
| 3 | " | " | (I'-2) | $2.5 \times 10^{-4}$ | 110 | 17.5 | 74 | 8.0 | 1.21 | 5 | 4.5 |
| 4 | " | " | " | $5 \times 10^{-4}$ | 105 | 16.5 | 83 | 9.0 | 1.23 | 5 | 5 |
| 5 | (III-15) | $2 \times 10^{-4}$ | — | — | 100 | 15.5 | 93 | 13.5 | 1.10 | 2 | 2.5 |
| 6 | " | " | (I'-2) | $2.5 \times 10^{-4}$ | 100 | 15.5 | 93 | 13.0 | 1.2 | 4.5 | 4.5 |
| 7 | " | " | " | $5 \times 10^{-4}$ | 105 | 15.0 | 97 | 13.0 | 1.23 | 5 | 5.0 |
| 8 | " | " | (I'-6) | $2.5 \times 10^{-4}$ | 100 | 15.0 | 93 | 12.5 | 1.15 | 3.5 | 4.5 |
| 9 | " | " | " | $5 \times 10^{-4}$ | 98 | 14.5 | 89 | 11.0 | 1.20 | 5 | 5.0 |
| 10 | " | $3 \times 10^{-4}$ | — | — | 112 | 17.0 | 107 | 15.0 | 1.07 | 1 | 1.5 |
| 11 | " | " | (I-9) | $2.5 \times 10^{-4}$ | 110 | 17.0 | 100 | 13.0 | 1.15 | 3 | 3.0 |
| 12 | " | " | " | $5 \times 10^{-4}$ | 105 | 16.5 | 97 | 12.5 | 1.19 | 4 | 3.5 |
| 13 | " | " | (I-5) | $2.5 \times 10^{-4}$ | 107 | 16.5 | 98 | 12.5 | 1.14 | 3.5 | 3.0 |
| 14 | " | " | " | $5 \times 10^{-4}$ | 105 | 16.5 | 93 | 12.0 | 1.18 | 4 | 3.5 |
| 15 | " | " | (I'-2) | $2.5 \times 10^{-4}$ | 112 | 17 | 107 | 15.5 | 1.17 | 3.5 | 4.0 |
| 16 | " | " | " | $5 \times 10^{-4}$ | 115 | 16.5 | 110 | 15.0 | 1.21 | 4.5 | 5.0 |
| 17 | " | " | (I'-6) | $2.5 \times 10^{-4}$ | 107 | 16.5 | 102 | 15.0 | 1.15 | 3.5 | 4.0 |
| 18 | " | " | " | $5 \times 10^{-4}$ | 105 | 16.5 | 100 | 14.0 | 1.20 | 4.5 | 5.0 |
| 19 | " | " | (I''-3) | $2.5 \times 10^{-4}$ | 110 | 17.0 | 105 | 15.0 | 1.14 | 3.5 | 3.0 |
| 20 | " | " | " | $5 \times 10^{-4}$ | 107 | 16.0 | 100 | 14.0 | 1.18 | 4.5 | 4.0 |

*Samples 1 to 5 and 10 are comparative samples, whereas Samples 6 to 9 and 11 to 20 are samples representative of the present invention.

Comparative Compound A:

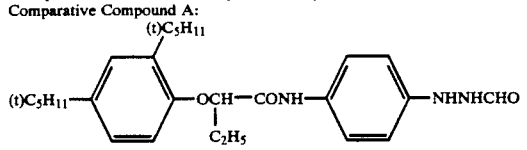

EXAMPLE 8

Preparation of Emulsion C

An aqueous silver nitrate solution and an aqueous potassium iodide and potassium bromide solution were simultaneously added to an aqueous gelatin solution kept at 50° C. in the presence of ammonia and iridium hexachloride in an amount of $4 \times 10^{-7}$ mol per mol of silver over 60 minutes, during which time the pAg was kept at 7.8 so that a cubic grain monodispersed emulsion having an average grain size of 0.3 μm and an average silver iodide content of 1 mol % was prepared.

Preparation of Emulsion D

The same procedures as for Emulsion C were repeated except that the amount of potassium iodide and ammonia were adjusted to prepare a cubic grain monodispersed emulsion having an average grain diameter of 0.22 μm and an average silver iodide content of 0.1 mol %.

Emulsions C and D were desalted by the flocculation method.

Emulsion D was further sulfur-sensitized by hypo to prepare a cubic grain monodispersed sulfur-sensitized emulsion having an average grain size of 0.22 μm and an average silver iodide content of 0.1 mol %.

These silver bromoiodide emulsions were mixed such that the weight ratio of silver halides was ¼, then as a sensitizing dye, sodium salt of 5,5'-dichloro-9-ethyl-3,3'-bis(3-sulfopropyl)oxacarbocyanine, as a stabilizer, 4-hydroxy-6-methyl-1,3,3a,7-tetraazaindene, Aqueous Latex (a) having the structure shown below, a polyethyl acrylate dispersion, and 1,3-divinylsulfonyl-2-propanol were added, compounds of the general formulae (I) and (III) of the present invention were added as shown in Table 3, and the emulsion was coated on a polyethylene terephthalate support so that the amount of silver was 3.4 g/m². Each sample was exposed and developed and the photographic characteristics were determined in the same manner as in Example 7. The results are shown in Table 3. As is apparent from Table 3, in comparison with the comparative samples, Samples 4, 5, 7, 11, 12 and 14 of the present invention showed less of a decrease in sensitivity and gamma, the amount of black peppers is good, and the dot gradation is long even when a fatigued developer solution was used.

The photographic characteristics 1 and 2, the amount of black peppers and the dot gradation were evaluated in the same manner as in Example 7.

Aqueous Latex (a):

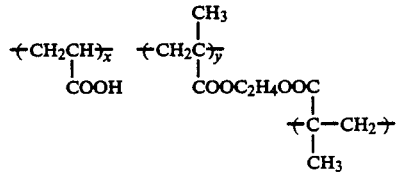

x/y = 70/30 (molar ratio)

TABLE 3

| Sample No.* | Compound of the General Formula (III) Type | Amount (mol/mol of Ag) | Compound of the General Formula (I) Type | Amount (mol/mol of Ag) | Photographic Characteristics 1 Sensitivity | γ | Photographic Characteristics 2 Sensitivity | γ | Dot Gradation | Amount of Black Peppers |
|---|---|---|---|---|---|---|---|---|---|---|
| 1 | A | $2 \times 10^{-3}$ | — | — | 100 | 17.0 | 79 | 10.0 | 1.19 | 3 |
| 2 | " | $4\ 10^{-3}$ | — | — | 107 | 18.5 | 91 | 11.5 | 1.18 | 2 |
| 3 | (III-15) | $2\ 10^{-4}$ | — | — | 102 | 17.0 | 93 | 13.5 | 1.10 | 1.5 |
| 4 | " | " | (I'-2) | $2.5 \times 10^{-4}$ | 105 | 17.5 | 93 | 14.5 | 1.16 | 3.5 |
| 5 | " | " | " | $5 \times 10^{-4}$ | 100 | 17.0 | 93 | 14.5 | 1.20 | 4.5 |
| 6 | " | $4 \times 10^{-4}$ | — | — | 107 | 18.5 | 95 | 15.0 | 1.08 | 1 |
| 7 | " | " | (I'-2) | $5 \times 10^{-4}$ | 107 | 18.0 | 97 | 15.0 | 1.18 | 4.0 |
| 8 | B | $2 \times 10^{-3}$ | — | — | 105 | 16.0 | 91 | 11.0 | 1.16 | 2.5 |
| 9 | " | $4 \times 10^{-3}$ | — | — | 110 | 16.5 | 95 | 11.5 | 1.15 | 1.5 |
| 10 | (III-1) | $2 \times 10^{-4}$ | — | — | 110 | 16.0 | 105 | 13.5 | 1.07 | 2.0 |
| 11 | " | " | (I'-2) | $2.5 \times 10^{-4}$ | 112 | 16.5 | 110 | 13.5 | 1.15 | 3.5 |
| 12 | " | " | " | $5 \times 10^{-4}$ | 110 | 15.0 | 105 | 13.0 | 1.17 | 4.5 |
| 13 | " | $4 \times 10^{-4}$ | — | — | 115 | 17.0 | 110 | 14.5 | 1.05 | 1.5 |
| 14 | " | " | (I'-2) | $5 \times 10^{-4}$ | 112 | 15.5 | 107 | 13.0 | 1.16 | 4.5 |

Comparative Compound A:

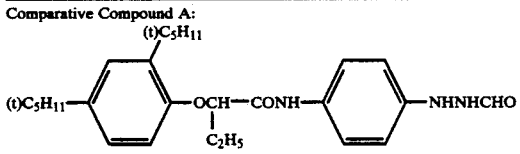

Comparative Compound B:

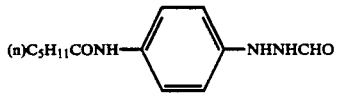

*Samples 1 to 3, 6, 8 to 10, and 13 are comparative samples, whereas Samples 4 and 5, 7, 11, 12 and 14 are representative of the present invention.

EXAMPLE 9

To the emulsion prepared in Example 7 was added the same additive as in Example 7, then Hydrazine Derivative (III-2) or (III-12) and Compound (I'-2) or (I''-2) were added to prepare each sample. In the same manner as in Example 7, the samples were exposed and developed and evaluations of the photographic characteristics were made. In the combinations of compounds according to the present invention, the decrease in sensitivity and gamma is less, and the dot gradation and the latitude of the line image and the amount of black peppers formed were good.

EXAMPLE 10

To the emulsion prepared in Example 7 was added a combination of Hydrazine Derivative (III-15) of the present invention ($1 \times 10^{-4}$ mol/mol of Ag) and Comparative Compound A used in Example 8 ($1 \times 10^{-3}$ mol/mol Ag), and Compound (I'-2) of the present invention was added to prepare a sample. The sample was processed in the same manner as in Example 7, and evaluations determined that there was no decrease in sensitivity and gamma, and the dot gradation and the latitude of the line image and the amount of black peppers formed were good.

EXAMPLE 11

To the emulsion prepared in Example 7 were added the same additives as in Example 7, Compound (III-15) of the present invention in an amount of $2\times10^{-4}$ mol per mol of silver, Compounds (I) of the present invention and Comparative Compounds (1), (2) and (3) as shown in Table 4, and each emulsion was coated together with a protective layer on a polyethylene terephthalate support such that the amount of silver was 3.3 g/m$^2$ to prepare each sample. The samples were processed in the same manner as in Example 7. In comparison with comparative samples, in Sample Nos. 2 to 7 of the present invention there was no decrease in sensitivity and gamma, the dot gradation and the latitude of the line image was improved and the amount of black peppers formed were good.

Photographic Characteristics 1, the amount of black peppers, the dot gradation and the latitude of the line image were evaluated in the same manner as in Example 7.

TABLE 4

| Sample No.* | Compound of the General Formula (I) Type | Amount (mol/mol of Ag) | Photographic Characteristics 1 Sensitivity | γ | Dot Gradation | Latitude of Line Image | Amount of Black Peppers |
|---|---|---|---|---|---|---|---|
| 1 | — | — | 100 | 15.5 | 1.10 | 2 | 2.5 |
| 2 | (I'-2) | $2.5\times10^{-4}$ | 100 | 15.5 | 1.2 | 4.5 | 4.5 |
| 3 | " | $5\times10^{-4}$ | 105 | 15.0 | 1.23 | 5 | 5 |
| 4 | (I'-6) | $2.5\times10^{-4}$ | 100 | 15.0 | 1.15 | 4 | 4.5 |
| 5 | " | $5\times10^{-4}$ | 98 | 14.5 | 1.20 | 4.5 | 5 |
| 6 | (I''-3) | $2.5\times10^{-4}$ | 100 | 15.0 | 1.14 | 3.5 | 3.5 |
| 7 | " | $5\times10^{-4}$ | 95 | 15.0 | 1.18 | 4 | 4.0 |
| 8 | (1) | $2.5\times10^{-4}$ | 100 | 15.0 | 1.10 | 2 | 2.5 |
| 9 | " | $5\times10^{-4}$ | 98 | 14.5 | 1.11 | 2.5 | 2.5 |
| 10 | (2) | $2.5\times10^{-4}$ | 100 | 15.0 | 1.11 | 2 | 2.5 |
| 11 | " | $5\times10^{-4}$ | 95 | 15.0 | 1.12 | 2.5 | 2.5 |
| 12 | (3) | $2.5\times10^{-4}$ | 98 | 15.0 | 1.11 | 2 | 2.5 |
| 13 | " | $5\times10^{-4}$ | 95 | 15.0 | 1.12 | 2.5 | 2.5 |

Comparative Compound (1):

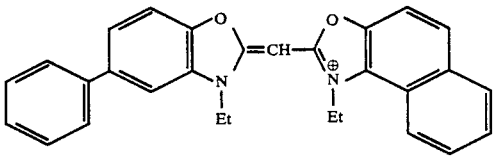

Comparative Compound (2):

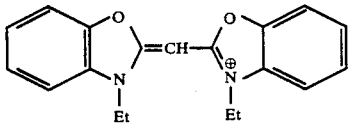

Comparative Compound (3):

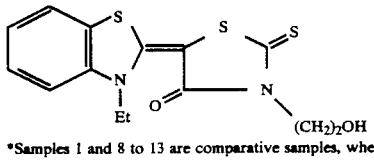

*Samples 1 and 8 to 13 are comparative samples, whereas Samples 2 to 7 are representative of the present invention.

EXAMPLE 12

Preparation of Emulsion E

An aqueous silver nitrate solution and an aqueous potassium iodide and potassium bromide solution were simultaneously added to an aqueous gelatin solution kept at 50° C. in the presence of ammonia and iridium hexachloride in an amount of $4\times10^{-7}$ mole per mol of silver over 60 minutes, during which time the pAg was kept at 7.8, so that a cubic grain monodispersed emulsion having an average grain size of 0.3 μm and an average silver iodide content of 1 mol % was prepared.

Preparation of Emulsion F

In the same manner as in Emulsion E , a cubic grain monodispersed emulsion having an average grain size of 0.20 μm and an average silver halide content of 0.1 mol % was prepared by adjusting the amounts of potassium iodide and ammonia.

Emulsions E and F were desalted by the flocculation method.

Emulsion F was sulfur-sensitized by hypo to prepare a cubic grain monodispersed sulfur-sensitized emulsion having an average grain size of 0.20 μm and an average silver iodide content of 0.1 mol %.

Emulsions A and B were mixed such that the silver halide weight ratio was ¼, then, after adding as a sensitizing dye, sodium salt of 5,5'-dichloro-9-ethyl-3,3'-bis(3-sulfopropyl)oxacarbocyanine, as a stabilizer, 4-hydroxy-6-methyl-1,3,3a,7-tetraazaindene, Aqueous Latex (a) having the structure shown below, a polyethyl acrylate dispersion, and 1,3-divinylsulfonyl-2-propanol, Hydrazine Compound (II-9) of the present invention, the compound of the general formula (I) of the present invention, and an amine or an onium salt were added as shown in Table 5, and the emulsion was coated simultaneously with a protective layer on a polyethylene terephthalate support such that the amount of silver was 3.3 g/m$^2$.

Aqueous Latex (a):

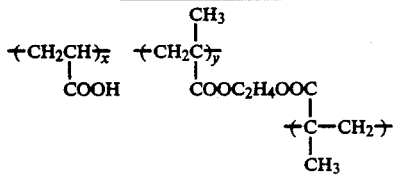

x/y = 70/30
(molar ratio)

Each sample was exposed in the same manner as in Example 1, and developed, and the photographic characteristics were compared in the same manner as in Example 7, which results are shown in Table 5 below. As is apparent from Table 5, in Sample Nos. 4 to 7, 9 to 12, 14 to 16, 18 and 19 according to the present invention, the development process is relatively fast, and even when development is conducted at 30° C. for 20 seconds, the $D_{max}$ is 5 or more, the gamma is 10 or more, and the dot gradation, the latitude of the line image and the amount of black peppers formed are good. The photographic characteristics were obtained by processing each sample at 38° C. for 20 seconds and 30 seconds using Developing Solution A having the formulation shown above using an FG-660F automatic developing processor (manufactured by Fuji Photo Film Co., Ltd.). The relative sensitivity is a relative value of a reciprocal of exposure resulting in a density of 1.5 and the value of Sample 1 was established as 100 when developed at 38° C. for 30 seconds to obtain Photographic Characteristics.

The evaluation of black peppers was carried out such that Developing Solution E was used for 5 days without replenishing until the pH increased by 0.05 and the concentration of sulfite ions decreased to 50% of the fresh solution, and processing at 38° C. for 30 seconds was then carried out in the same manner as for Photographic Characteristics.

The black peppers were evaluated on a scale of 1 to 5 by observation using a microscope. A rating of 5 indicates the best quality, and a rating of 1 indicates the worst quality. A rating of 5 or 4 is acceptable for practical use, a rating of 3 is not good, but can possibly be practically used and a rating of 2 or 1 is not practical. The intermediate between a rating of 4 and a rating of 3 is expressed by a rating of 3.5.

The evaluation of the dot gradation was obtained by contacting samples firmly onto a commercially available contact screen (GCS 150) (manufactured by Fuji Photo Film Co., Ltd.) for GSL, exposing them to white tungsten light via a step wedge with the step difference being 0.1, and measuring the dot area ranging from 5% to 95% after developing at 38° C. for 30 seconds.

The latitude of the line image was obtained by photographing an original comprising 7-class Ming-cho type and Gothic type phototype setting characters having a reflection density of 0.5 to 1.2 by a camera (DSC351) manufactured by Dainippon Screen Mfg. Co., Ltd., and developing at 30° C. for 30 seconds under the same conditions as for the photographic characteristics. The evaluation results were measured on a scale of 1 to 5, a rating of 5 indicating the best quality and a rating of 1 indicating the worst quality. A rating of 5 or 4 is practical, a rating of 3 is not good but can possibly be practically used, and a rating of 2 or 1 is not practical. The intermediate between a rating of 4 and a rating of 3 is expressed by a rating of 3.5.

TABLE 5

| Sample No.* | Hydrazine (mol/mol of Ag) | Compound of the General Formula (I) Type | Compound of the General Formula (I) Amount (mol/mol of Ag) | Amine or Onium Salt Type | Amine or Onium Salt Amount (mol/mol of Ag) | Photographic Characteristics 38° C., 20 Seconds Sensitivity | 38° C., 20 Seconds γ | 38° C., 20 Seconds $D_{max}$ | 38° C., 30 Seconds Sensitivity | 38° C., 30 Seconds γ | 38° C., 30 Seconds $D_{max}$ | Dot Gradation | Latitude of Line Image | Amount of Black Peppers |
|---|---|---|---|---|---|---|---|---|---|---|---|---|---|---|
| 1 | $3 \times 10^{-3}$ | — | — | — | — | 71 | 8 | 4.0 | 100 | 14.5 | 5.2 | 1.2 | 4.0 | 4.0 |
| 2 | $4 \times 10^{-3}$ | — | — | — | — | 81 | 8.5 | 4.3 | 110 | 16 | 5.5 | 1.2 | 3.5 | 3.0 |
| 3 | $3 \times 10^{-3}$ | — | — | (A-14) | $4 \times 10^{-3}$ | 95 | 15 | 5.1 | 117 | 18 | 6.0 | 1.1 | 2.0 | 2.0 |
| 4 | " | (I'-2) | $2.5 \times 10^{-4}$ | " | " | 95 | 12.0 | 4.9 | 115 | 18 | 6.0 | 1.2 | 4.5 | 4.0 |
| 5 | " | " | $5 \times 10^{-4}$ | " | " | 91 | 12.5 | 5.0 | 115 | 17.5 | 5.9 | 1.24 | 5.0 | 5.0 |
| 6 | " | (I''-2) | $2.5 \times 10^{-4}$ | " | " | 93 | 12.0 | 4.8 | 115 | 18 | 5.8 | 1.18 | 4.5 | 3.5 |
| 7 | " | " | $5 \times 10^{-4}$ | " | " | 91 | 12.5 | 4.7 | 112 | 17.5 | 5.8 | 1.20 | 4.5 | 4.5 |
| 8 | " | — | — | (C-6) | $5 \times 10^{-4}$ | 102 | 12.5 | 5.3 | 120 | 18 | 5.8 | 1.09 | 1.0 | 1.0 |
| 9 | " | (I'-2) | $2.5 \times 10^{-4}$ | " | " | 100 | 13.5 | 5.2 | 120 | 18.5 | 5.8 | 1.18 | 4.0 | 4.5 |
| 10 | " | " | $5 \times 10^{-4}$ | " | " | 98 | 13.5 | 5.1 | 118 | 17.5 | 5.8 | 1.20 | 4.5 | 5.0 |
| 11 | " | (I''-2) | $2.5 \times 10^{-4}$ | " | " | 100 | 13.0 | 5.2 | 117 | 18.0 | 5.9 | 1.15 | 3.5 | 4.0 |
| 12 | " | " | $5 \times 10^{-4}$ | " | " | 95 | 12.0 | 5.0 | 112 | 17.5 | 5.8 | 1.18 | 4.0 | 4.5 |
| 13 | " | — | — | (D-5) | $1 \times 10^{-3}$ | 98 | 14.0 | 5.2 | 117 | 20 | 5.9 | 1.12 | 2.0 | 1.5 |
| 14 | " | (I'-2) | $5 \times 10^{-4}$ | " | " | 100 | 14.0 | 5.2 | 120 | 17.8 | 5.8 | 1.20 | 5.0 | 5.0 |
| 15 | " | (I'-6) | " | " | " | 102 | 13.5 | 5.0 | 126 | 17.5 | 5.9 | 1.22 | 5.0 | 5.0 |
| 16 | " | (I''-2) | " | " | " | 100 | 13.0 | 5.0 | 120 | 18.0 | 6.0 | 1.19 | 4.5 | 4.0 |
| 17 | " | — | — | (A-2) | $1 \times 10^{-3}$ | 91 | 12.0 | 4.8 | 110 | 16.0 | 5.7 | 1.15 | 3.0 | 3.0 |
| 18 | " | (I'-2) | $2.5 \times 10^{-4}$ | " | " | 93 | 11.5 | 4.9 | 110 | 16.5 | 5.8 | 1.22 | 5.0 | 4.5 |
| 19 | " | " | $5 \times 10^{-4}$ | " | " | 89 | 12.0 | 4.7 | 107 | 15.5 | 5.7 | 1.24 | 5.0 | 5.0 |

*Samples 1 to 3, 8, 13 and 17 are comparative samples, whereas Samples 4 to 7, 9 to 12, 14 to 16, 18 and 19 are representative of the present invention.

EXAMPLE 13

An aqueous silver nitrate solution and an aqueous potassium iodide solution were simultaneously added to an aqueous gelatin solution kept at 50° C. in the presence of ammonia and iridium hexachloride in an amount of $4 \times 10^{-7}$ mol per mol of silver over 60 minutes, during which time the pAg was kept at 7.8 so that a cubic grain monodispersed emulsion having an average grain size of 0.25 μm and an average silver iodide content of 1 mol % was prepared. The emulsion was desalted by the flocculation method and sulfur-sensitized by hypo. The emulsion was divided, then, as a sensitizing dye, sodium salt of 5,5'-dichloro-9-ethyl-3,3'-bis(3-sulfopropyl)oxacarbocyanine, as a stabilizer, 4-hydroxy-6-methyl-1,3,3a,7-tetraazaindene, ascorbic acid, a dispersion of polyethyl acrylate, and 1,3-divinylsulfonyl-2-propanol, and Compound (II-12) of the present invention, a compound of the general formula (I), and a quaternary onium compound were added thereto as shown in Table 6. The resulting emulsions were then coated simultaneously together with a protective layer on a polyethylene terephthlate support so that the amount of silver was 3.4 g/m$^2$. The samples were exposed and developed in the same manner as in Example 12, and the photographic characteristics were compared. As is apparent from Table 6, in comparison with the comparative samples, in Sample Nos. 5 to 10 and 15 to 18 of the present invention, the decrease in sensitivity and gamma is less and the amount of black peppers, the dot gradation and the latitude of the line image are good.

The photographic characteristics, the amount of black peppers, the dot gradation and the latitude of the line image were evaluated in the same manner as in Example 12.

TABLE 6

| Sample No.* | Hydrazine (mol/mol of Ag) | Compound of the General Formula (I) Type | Compound of the General Formula (I) Amount (mol/mol of Ag) | Onium Salt Type | Onium Salt Amount (mol/mol of Ag) | Photographic Characteristics 38° C., 20 Seconds Sensitivity | γ | $D_{max}$ | 38° C., 30 Seconds Sensitivity | γ | $D_{max}$ | Dot Gradation | Latitude of Line Image | Amount of Black Peppers |
|---|---|---|---|---|---|---|---|---|---|---|---|---|---|---|
| 1 | $2 \times 10^{-3}$ | — | — | — | — | 81 | 8.0 | 4.3 | 100 | 14.5 | 5.6 | 1.21 | 4.5 | 3.5 |
| 2 | $4 \times 10^{-3}$ | — | — | — | — | 83 | 8.2 | 4.4 | 107 | 16.0 | 5.7 | 1.20 | 4 | 3.0 |
| 3 | $6 \times 10^{-3}$ | — | — | — | — | 85 | 8.2 | 4.5 | 115 | 17.0 | 5.9 | 1.20 | 4 | 2.5 |
| 4 | $2 \times 10^{-3}$ | — | — | (C-6) | $1 \times 10^{-3}$ | 110 | 15.0 | 5.4 | 120 | 18.0 | 6.0 | 1.08 | 2 | 1.0 |
| 5 | " | (I-2) | $2.5 \times 10^{-4}$ | " | " | 107 | 14.0 | 5.4 | 117 | 17.0 | 5.8 | 1.16 | 3.5 | 3.0 |
| 6 | " | " | $5 \times 10^{-4}$ | " | " | 105 | 14.0 | 5.2 | 117 | 17.0 | 5.7 | 1.18 | 4 | 3.5 |
| 7 | " | (I'-2) | $2.5 \times 10^{-4}$ | " | " | 115 | 14.6 | 5.4 | 123 | 17.2 | 5.9 | 1.18 | 4 | 4.0 |
| 8 | " | " | $5 \times 10^{-4}$ | " | " | 112 | 14.5 | 5.4 | 123 | 17.6 | 5.9 | 1.21 | 5 | 5.0 |
| 9 | " | (I"-3) | $2.5 \times 10^{-4}$ | " | " | 112 | 13.5 | 5.3 | 120 | 17.5 | 5.8 | 1.16 | 4 | 4.0 |
| 10 | " | " | $5 \times 10^{-4}$ | " | " | 110 | 13.0 | 5.2 | 117 | 17.0 | 5.7 | 1.20 | 5 | 5.0 |
| 11 | " | — | — | (C-9) | " | 107 | 14.0 | 5.3 | 115 | 16.8 | 5.9 | 1.09 | 2 | 1.5 |
| 12 | " | — | — | (C-11) | " | 105 | 14.2 | 5.4 | 117 | 17.0 | 5.9 | 1.07 | 1 | 1.0 |
| 13 | " | — | — | (D-2) | " | 105 | 13.0 | 5.2 | 117 | 17.6 | 6.0 | 1.08 | 1.5 | 1.0 |
| 14 | " | — | — | (D-6) | " | 100 | 13.6 | 5.4 | 115 | 18.0 | 6.0 | 1.10 | 2 | 1.5 |
| 15 | " | (I'-6) | $5 \times 10^{-4}$ | (C-9) | " | 105 | 13.8 | 5.3 | 115 | 17.0 | 5.8 | 1.20 | 5 | 5 |
| 16 | " | " | " | (C-11) | " | 105 | 14.0 | 5.3 | 115 | 16.8 | 5.7 | 1.18 | 4 | 5 |
| 17 | " | " | " | (D-2) | " | 100 | 13.0 | 5.3 | 117 | 17.2 | 5.8 | 1.22 | 5 | 5 |
| 18 | " | " | " | (D-6) | " | 98 | 13.5 | 5.1 | 110 | 17.0 | 5.8 | 1.21 | 5 | 5 |

*Samples 1 to 4 and 11 to 14 are comparative samples, whereas Samples 5 to 10 and 15 to 18 are representative of the present invention.

EXAMPLE 14

To Emulsion A used in Example 12 were added: as a sensitizing dye, sodium salt of 5,5'-dichloro-9-ethyl-3,3'-bis(3-sulfopropyl)oxacarbocyanine; as a stabilizer, 4-hydroxy-6-methyl-1,3,3a,7-tetraazaindene; polyethyl acrylate; polyethylene glycol (having a molecular weight of 1,000); 1,3-divinylsulfonyl-2propanol; and Compound (I'-2) of the present invention in an amount of $5 \times 10^{-4}$ mol per mol of silver. A hydrazine derivative of the present invention and an amine compound or an onium salt were then added as shown in Table 7. The emulsion was coated together with a protective layer on a polyethylene terephthalate support such that the amount of silver was 3.4 g/m$^2$ and the test procedures and evalautions were carried out in the same manner as in Example 12. The results are shown in Table 7 below. As is apparent from Table 7, in comparison to the comparative samples, in Sample Nos. 2 to 10, 12 to 15, and 17 to 20 of the present invention, the development process is relatively fast, and the amount of black peppers, the dot gradation and the latitude of the line image are good.

The photographic characteristics, the amount of black peppers, the dot gradation and the latitude of the line image were evaluated in the same manner as in Example 12.

TABLE 7

| Sample No.* | Hydrazine Derivative Type | Hydrazine Derivative Amount (mol/mol of Ag) | Amine or Onium Salt Type | Amine or Onium Salt Amount (mol/mol of Ag) | Photographic Characteristics 1 38° C., 20 Seconds Sensitivity | γ | $D_{max}$ | Photographic Characteristics 2 38° C., 30 Seconds Sensitivity | γ | $D_{max}$ | Dot Gradation | Latitude of Line Image | Amount of Black Peppers |
|---|---|---|---|---|---|---|---|---|---|---|---|---|---|
| 1 | (II-7) | $5 \times 10^{-3}$ | — | — | 76 | 8.2 | 3.0 | 100 | 16.5 | 4.4 | 1.23 | 5 | 5 |
| 2 | " | $4 \times 10^{-3}$ | (A-2) | $4 \times 10^{-3}$ | 100 | 12.5 | 3.8 | 117 | 16.0 | 4.6 | 1.21 | 4.5 | 5 |
| 3 | " | " | " | $1 \times 10^{-3}$ | 107 | 13.5 | 4.0 | 120 | 17.0 | 4.7 | 1.19 | 4.5 | 4.1 |
| 4 | " | " | (B-1) | $5 \times 10^{-4}$ | 89 | 12.0 | 3.8 | 105 | 16.2 | 4.6 | 1.20 | 4.5 | 5 |
| 5 | " | " | " | $1 \times 10^{-3}$ | 95 | 13.0 | 3.9 | 110 | 17.0 | 4.6 | 1.18 | 4 | 4.5 |
| 6 | " | " | (B-22) | $5 \times 10^{-4}$ | 89 | 13.5 | 3.9 | 102 | 16.5 | 4.5 | 1.21 | 5 | 5 |
| 7 | " | " | " | $1 \times 10^{-3}$ | 91 | 14.0 | 4.0 | 107 | 16.9 | 4.7 | 1.19 | 4.5 | 4.5 |
| 8 | " | " | (C-6) | $5 \times 10^{-4}$ | 95 | 13.6 | 4.0 | 110 | 17.0 | 4.5 | 1.20 | 5 | 4.5 |
| 9 | " | " | " | $1 \times 10^{-3}$ | 98 | 14.2 | 4.1 | 117 | 17.8 | 4.8 | 1.18 | 4.5 | 4.5 |
| 10 | " | " | (D-1) | $1 \times 10^{-3}$ | 98 | 14.0 | 4.1 | 107 | 17.0 | 4.7 | 1.19 | 4.5 | 4.5 |
| 11 | (II-19) | $3.6 \times 10^{-4}$ | — | — | 86 | 9.0 | 3.2 | 107 | 16.0 | 4.3 | 1.20 | 5 | 5 |
| 12 | " | $3.3 \times 10^{-4}$ | (A-2) | $4 \times 10^{-3}$ | 98 | 12.0 | 3.8 | 117 | 17.0 | 4.5 | 1.19 | 4.5 | 4.5 |
| 13 | " | " | (B-1) | $1 \times 10^{-3}$ | 105 | 13.0 | 3.9 | 120 | 18.0 | 4.7 | 1.18 | 4.5 | 4.5 |
| 14 | " | " | (C-6) | $1 \times 10^{-3}$ | 107 | 12.5 | 4.0 | 123 | 17.0 | 4.7 | 1.19 | 4.5 | 4.5 |
| 15 | " | " | (D-1) | $1 \times 10^{-3}$ | 102 | 13.0 | 4.0 | 115 | 16.5 | 4.7 | 1.18 | 4.5 | 4.5 |
| 16 | (II-39) | $3.3 \times 10^{-4}$ | — | — | 89 | 9.5 | 3.4 | 110 | 17.0 | 4.4 | 1.19 | 4.5 | 5 |
| 17 | " | $3.0 \times 10^{-4}$ | (A-2) | $4 \times 10^{-3}$ | 100 | 13.5 | 3.9 | 115 | 18 | 4.6 | 1.17 | 4.5 | 4.5 |
| 18 | " | " | (B-1) | $1 \times 10^{-3}$ | 102 | 13.8 | 4.0 | 120 | 17.5 | 4.7 | 1.18 | 4.5 | 4.5 |

TABLE 7-continued

| Sample No.* | Hydrazine Derivative Type | Hydrazine Derivative Amount (mol/mol of Ag) | Amine or Onium Salt Type | Amine or Onium Salt Amount (mol/mol of Ag) | Photographic Characteristics 1 38° C., 20 Seconds Sensitivity | γ | $D_{max}$ | Photographic Characteristics 2 38° C., 30 Seconds Sensitivity | γ | $D_{max}$ | Dot Gradation | Latitude of Line Image | Amount of Black Peppers |
|---|---|---|---|---|---|---|---|---|---|---|---|---|---|
| 19 | " | " | (C-6) | $1 \times 10^{-3}$ | 107 | 14.2 | 4.2 | 125 | 17.5 | 4.8 | 1.17 | 4.5 | 4.5 |
| 20 | " | " | (D-1) | $1 \times 10^{-3}$ | 107 | 14.0 | 4.0 | 117 | 16 | 4.7 | 1.17 | 4.5 | 4.5 |

*Samples 1, 11 and 16 are comparative samples, whereas Samples 2 to 10, 12 to 15 and 17 to 20 are representative of the present invention.

EXAMPLE 15

To the emulsion used in Example 12 were added the same additives, and then Hydrazine Compound (II-7) of the present invention (in an amount of $3 \times 10^{-3}$ mol per mol of silver), Compound (C-6) (in an amount of $5 \times 10^{-4}$ mol per mol of silver), compound (I) of the present invention, and Compounds (1), (2) and (3) were added thereto as shown in Table 8. Each emulsion was coated together with a protective layer on a polyethylene terephthalate support such that the amount of silver was 3.0 g/m$^2$ to prepare each sample. These samples were processed in the same manner as in Example 12. In comparison to the comparative samples, in Sample Nos. 2 to 7 of the present invention, there was no decrease in sensitivity, gamma, or $D_{max}$, the dot gradation and the latitude of the line image were improved, and the amount of black peppers was good. Table 8 is shown below.

The photographic characteristics, the amount of black peppers, the dot gradation and the latitude of the line image were evaluated in the same manner as in Example 12.

TABLE 8

| Sample No.* | Compound of the General Formula (I) Type | Compound of the General Formula (I) Amount (mol/mol of Ag) | Photographic characteristics 38° C., 30 Seconds Sensitivity | γ | $D_{max}$ | Dot Gradation | Latitude of Line Image | Amount of Black Peppers |
|---|---|---|---|---|---|---|---|---|
| 1 | — | — | 100 | 18.0 | 5.8 | 1.09 | 1 | 1 |
| 2 | (I'-2) | $2.5 \times 10^{-4}$ | 100 | 18.5 | 5.8 | 1.18 | 4 | 4.5 |
| 3 | " | $5 \times 10^{-4}$ | 98 | 17.5 | 5.8 | 1.20 | 4.5 | 5 |
| 4 | (I'-6) | $2.5 \times 10^{-4}$ | 100 | 17.5 | 5.8 | 1.19 | 4 | 4.0 |
| 5 | " | $5 \times 10^{-4}$ | 98 | 17.0 | 5.8 | 1.22 | 4.5 | 4.5 |
| 6 | (I''-3) | $2.5 \times 10^{-4}$ | 98 | 17.0 | 5.8 | 1.15 | 3.5 | 3 |
| 7 | " | $5 \times 10^{-4}$ | 95 | 16.0 | 5.8 | 1.18 | 4.0 | 3.5 |
| 8 | (1) | $2.5 \times 10^{-4}$ | 100 | 17.0 | 5.7 | 1.10 | 1 | 2 |
| 9 | " | $5 \times 10^{-4}$ | 95 | 16.0 | 5.6 | 1.12 | 2 | 2 |
| 10 | (2) | $2.5 \times 10^{-4}$ | 100 | 16.2 | 5.8 | 1.11 | 1 | 1 |
| 11 | " | $5 \times 10^{-4}$ | 98 | 15.4 | 5.6 | 1.13 | 2 | 2 |
| 12 | (3) | $2.5 \times 10^{-4}$ | 98 | 17.3 | 5.7 | 1.09 | 1 | 1 |
| 13 | " | $5 \times 10^{-4}$ | 93 | 16.0 | 5.4 | 1.10 | 2 | 2 |

Comparative Compound (1):

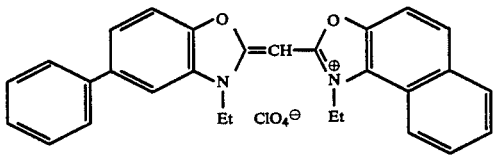

Comparative Compound (2):

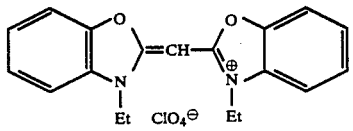

Comparative Compound (3):

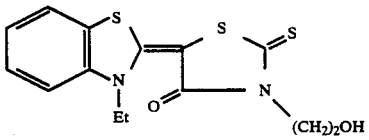

*Samples 1 and 8 to 13 are comparative samples, whereas Samples 2 to 7 are representative of the present invention.

EXAMPLE 16

The procedure was the same as in Example 1, Sample 5, but using (II-9) and (I'-19) instead of (II-7)(a hydrazine derivative) and (I'-1), respectively and further adding hydroquinone in an amount of $1 \times 10^{-2}$ mol per mol of silver to prepare Sample 101.

Sample 101 of the present invention showed good results similar to Sample 5 in Example 5.

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises at least one silver halide emulsion layer on a support, at least one of said silver halide emulsion layer and other constituting layers of said material containing at least one hydrazine derivative and at least one of said silver halide emulsion layer and said other constituting layers containing at least one compound having both a silver halide adsorbing group and an acid group represented by the general formula (I):

C-L-D (I)

wherein C represents a group that enhances adsorption to silver halide, D represents an acid group and L represents a divalent linking group, said compound possessing substantially no absorption maximum in the visible region, wherein at least said silver halide emulsion layer contains said at least one compound represented by said general formula (I) and also contains a cyanine dye or a merocyanine dye having an absorption maximum in the visible region, whereby said silver halide emulsion layer containing said at least one compound represented by said general formula (I) is spectrally sensitized, and wherein said compound of general formula (I) is selected from compounds represented by formula (I')

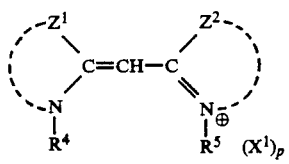
(I')

wherein $Z^1$ and $Z^2$, which may be the same or different, each represents of non-metallic atoms required to complete a benzoxazole nucleus, a benzothiazole nucleus, a benzoselenazole nucleus, a naphthoxzole nucleus, a napthothiazole nucleus, a naphthoselenazole nucleus, a thiazole nucleus, a thiazoline nucleus, an oxazole nucleus, a selenazole nucleus, a selenazoline nucleus, a pyridine nucleus or a quinoline nucleus, $R^4$ and $R^5$, which may be the same or different, each represents an alkyl group, $X^1$ represents an electric charge balancing counter ion, and p is 0 or 1.

2. A silver halide photographic material as claimed in claim 1, wherein said hydrazine derivative is represented by the general formula (II):

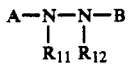
(II)

wherein

A represents an aliphatic group or an aromatic group,

B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group, a sulfamoyl group, or a heterocyclic group, $R^{11}$ and $R^{12}$ both represent a hydrogen atom or one of said $R^{11}$ and $R^{12}$ represents a hydrogen atom and the other represents a substituted or unsubstituted alkylsulfonyl group, a substituted or unsubstituted arylsulfonyl group or a substituted or unsubstituted acyl group, and B, $R^{12}$ and the nitrogen atom to which they are joined may form a partial structure

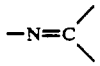

of hydrazone.

3. A silver halide photographic material as claimed in claim 1, wherein said hydrazine derivative is represented by the general formula (III):

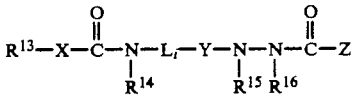
(III)

wherein $R^{13}$ represents an organic group having 30 or less carbon atoms,

X represents —$NR^{17}$— or 0,

L represents a divalent organic linking group,

Y represents a substituted or unsubstituted phenylene group or a naphthylene group, Z represents a hydrogen atom, an aliphatic group or an aromatic group, $R^{14}$ and $R^{17}$, which may be the same or different, each represents a hydrogen atom or an aliphatic group, $R^{15}$ and $R^{16}$ both represent a hydrogen atom or one of said $R^{15}$ and $R^{16}$ represents a hydrogen atom and the other represents an alkylsulfonyl group, an arylsulfonyl group, or an acyl group, and i is 0 or 1.

4. A silver halide photographic material as claimed in claim 1, wherein at least one of said silver halide emulsion layer and said other constituting layers contains at least one of an amine compound and a quaternary onium salt.

5. A silver halide photographic material as claimed in claim 1, wherein said compound represented by the general formula (I) is present in an amount of about $1\times10^{-5}$ to about $1\times10^{-3}$ mol per mol of total silver halide.

6. A silver halide photographic material as claimed in claim 4, wherein said amine compound or said quaternary onium salt is present in an amount of about $1\times10^{-6}$ mol to about $1\times10^{-3}$ mol per mol of total silver halide.

7. A method for forming a superhigh contrast negative image comprising developing an imagewise exposed silver halide photographic material with a developing solution containing sulfite ions in an amount of at least about 0.15 mol per liter and having a pH of about 10.5 to about 12.3, wherein said silver halide photographic material comprises at least one silver halide emulsion layer on a support, at least one of said silver halide emulsion layer and other constituting layers of said material containing at least one hydrazine derivative and at least one of said silver halide emulsion layer and said other constituting layers containing at least one compound having both a silver halide adsorbing group and an acid group represented by the general formula (I):

C-L-D (I)

wherein

C represents a group that enhances adsorption to silver halide,

D represents an acid group, and

L represents a divalent linking group, said compound possessing substantially no absorption maximum in the visible region, wherein at least said silver halide emulsion layer contains said at least one compound represented by said general formula (I) and also contains a cyanine dye or a merocyanine dye having an absorption maximum in the visible region, whereby said silver halide emulsion layer containing said at least one compound represented by said general formula (I) is spectrally sensitized, and wherein said compound of general formula (I) is selected from compounds represented by formula (I')

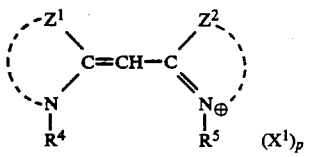

(I')

wherein $Z^1$ and $Z^2$, which may be the same or different, each represents a group of non-metallic atoms required to complete a benzoxazole nucleus, a benzothiazole nucleus, a benzoselenazole nucleus, a naphthoxazole nucleus, a napthothiazole nucleus, a naphthoselenazole nucleus, a thiazole nucleus, a thiazoline nucleus, an oxazole nucleus, a selenazole nucleus, a selenazoline nucleus, a pyridine nucleus or a quinoline nucleus, $R^4$ and $R^5$, which may be the same or different, each represents an alkyl group, $X^1$ represents an electric charge balancing counter ion, and p is 0 or 1.

8. A silver halide photographic material as claimed in claim 1, wherein said hydrazine derivative is represented by the general formula (II'):

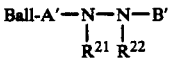

(II')

wherein,

A' represents a divalent aliphatic group or a divalent aromatic group,

B' represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioaoyl group, a thiocarbamoyl group, a sulfamoyl group, or a heterocyclic group, $R^{21}$ and $R^{22}$ both represent a hydrogen atom or one of said $R^{21}$ and $R^{22}$ represents a hydrogen atom and the other represents a substituted or unsubstituted alkylsulfonyl group, a substituted or unsubstituted arylsulfonyl group or a substituted or unsubstituted acyl group, and B, $R^{22}$ and the nitrogen atom to which they are joined may form a partial structure

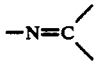

of hydrazone, and

Ball represents a ballast group which is relatively photographically deactive and which has 8 or more carbon atoms.

9. A silver halide photographic material as claimed in claim 1, wherein said cyanine or merocyanine dye having an adsorption maximum in the visible region is represented by formula (XI):

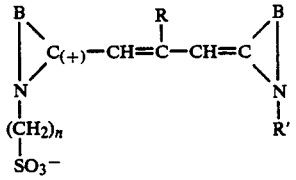

(XI)

in which

B together with the adjacent C atom and N atom represents a heterocyclic residue, n represents a positive integer of at least 3 but not more than 18, the $CH_2$ group may be substituted, and R and R' represent a substituted or unsubstituted alkyl group.

10. A silver halide photographic material as claimed in claim 1, wherein said cyan or merocyanine dye having an adsorption maximum in the visible region is represented by formula (XII):

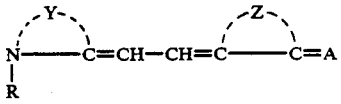

(XII)

wherein

A represents an atom selected from the group consisting of oxygen and sulfur,

R represents an alkyl group, and

Y and Z represent the non-metallic atoms necessary to complete a heterocyclic nucleus selected from the group consisting of five-membered and six-membered heterocyclic nuclei.

11. A silver halide photographic material as claimed in claim 1, wherein said cyanine or merocyanine dye having an adsorption maximum in the visible region is represented by formula (XIII):

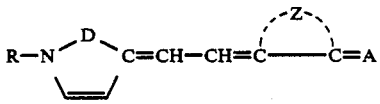

(XIII)

wherein

A represents an atom selected from the group consisting of oxygen and sulfur,

D represents a phenylene group,

R represents an alkyl group, and

Z represents the non-metallic atoms necessary to complete a heterocyclic nucleus selected from the group consisting of five-membered and six-membered heterocyclic nuclei.

12. A silver halide photographic material as claimed in claim 1, wherein said cyanine or merocyanine dye having an adsorption maximum in the visible region is represented by formula (XIV):

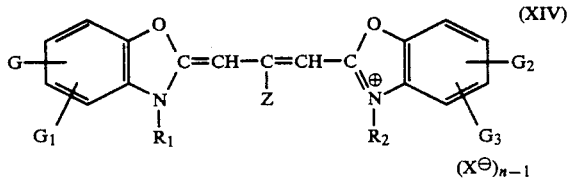

(XIV)

wherein

G and $G_3$ each represents a group selected from the group consisting of a halogen atom, a hydroxyl group, an alkoxy group, an amino group, an acylamino group, an acyloxy group, an alkoxy group, an alkoxycarbonylamino group, and a phenyl group, such that not more than one of G and $G_3$ each represents a phenyl group;

$G_1$ and $G_2$ each represents a group selected from the group consisting of a hydrogen atom and a halogen atom;

$R_1$ represents an alkyl group, a sulfoalkyl group or a carboxyalkyl group;

$R_2$ represents an alkyl group, a sulfoalkyl group or a carboxyalkyl group;

Z represents a group selected from the group consisting of a hydrogen atom, an alkyl group and an aryl group; and X represents an electric charge balancing counter ion;

n represents an integer of from 1 to 2, such that n represents the integer 1 when at least one of $R_1$ and $R_2$ represents a group selected from the group consisting of a sulfoalkyl group and a carboxyalkyl group.

13. A silver halide photographic material as claimed in claim 1, wherein said cyanine or merocyanine dye having an adsorption maximum in the visible region is represented by formula (XV):

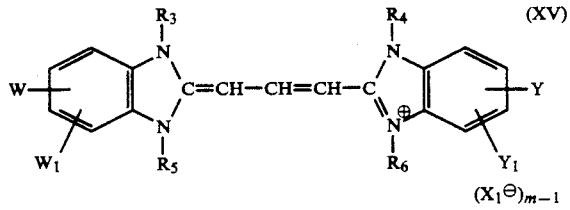

(XV)

wherein

W and Y each represents a group selected from the group consisting of a hydrogen atom, a halogen atom, an alkoxy group, an amino group, an acylamino group, an acyloxy group, and an alkoxycarbonylamino group;

$W_1$ and $Y_1$ each represents a group selected from the group consisting of a hydrogen atom and a halogen atom;

$R_3$ represents an alkyl group;

$R_4$ represents an alkyl group;

$R_5$ and $R_6$ each represents a group selected from the group consisting of an alkyl group, a sulfoalkyl group and a carboxyalkyl group; and $X_1^-$ represents an electric charge balancing counter ion; and m represents an integer of from 1 to 2, such that m represent the integer 1 when at least one of $R_5$ and $R_6$ represents a group selected from the group consisting of a sulfoalkyl group and a carboxyalkyl group.

14. A method for forming a superhigh contrast negative image as claimed in claim 7, wherein said cyanine or merocyanine dye having an adsorption maximum in the visible region is represented by formula (XI):

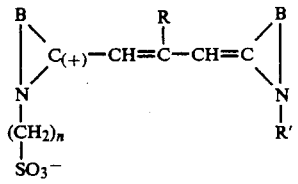

(XI)

in which

B together with the adjacent C atom and N atom represents a heterocyclic residue, n represents a positive integer of at least 3 but not more than 18, the $CH_2$ group may be substituted, and R and R' represent a substituted or unsubstituted alkyl radical.

15. A method for forming a superhigh contrast negative image as claimed in claim 7, wherein said cyanine or merocyanine dye having an adsorption maximum in the visible region is represented by formula (XII):

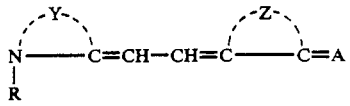

(XII)

wherein

A represents an atom selected from the group consisting of oxygen and sulfur,

R represents an alkyl group, and

Y and Z represent the non-metallic atoms necessary to complete a heterocyclic nucleus selected from the group consisting of five-membered and six-membered heterocyclic nuclei.

16. A method for forming a superhigh contrast negative image as claimed in claim 7, wherein said cyanine or merocyanine dye having an adsorption maximum in the visible region is represented by formula (XIII):

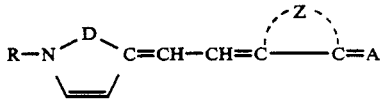

(XIII)

wherein

A represents an atom selected from the group consisting of oxygen and sulfur,

D represents a phenylene group,

R represents an alkyl group, and

Z represents the non-metallic atoms necessary to complete a heterocyclic nucleus selected from the group consisting of five-membered and six-membered heterocyclic nuclei.

17. A method for forming a superhigh contrast negative image as claimed in claim 7, wherein said cyanine or merocyanine dye having an adsorption maximum in the visible region is represented by formula (XIV):

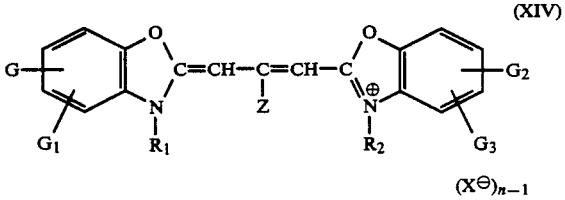

(XIV)

wherein

G and $G_3$ each represents a group selected from the group consisting of a halogen atom, a hydroxyl group, an alkoxy group, an amino group, an acylamino group, an acyloxy group, an alkoxy group, an alkoxycarbonylamino group, and a phenyl group, such that not more than one of G and $G_3$ each represents a phenyl group;

$G_1$ and $G_2$ each represents a group selected from the group consisting of a hydrogen atom and a halogen atom;

$R_1$ represents an alkyl group, a carboxyalkyl group or a sulfoalkyl group;

$R_2$ represents an alkyl group, a carboxyalkyl group or a sulfoalkyl group;

Z represents a group selected from the group consisting of a hydrogen atom, an alkyl group and an aryl group; and X represents an electric charge balancing counter ion;

n represents an integer of from 1 to 2 such that n represents the integer 1 when at least one of $R_1$ and $R_2$ represents a group selected from the group consisting of a sulfoalkyl group and a carboxyalkyl group.

18. A method for forming a superhigh contrast negative image as claimed in claim 7, wherein said cyanine or merocyanine dye having an adsorption maximum in the visible region is represented by formula (XV):

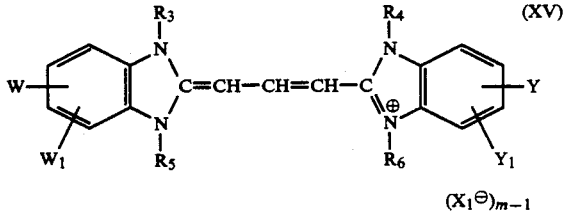

(XV)

wherein

W and Y each represents a group selected from the group consisting of a hydrogen atom, a halogen atom, an alkoxy group, an amino group, an acylamino group, an acyloxy group, and an alkoxycarbonylamino group;

$W_1$ and $Y_1$ each represents a group selected from the group consisting of a hydrogen atom and a halogen atom;

$R_3$ represents an alkyl group;

$R_4$ represents an alkyl group; and $R_5$ and $R_6$ each represents a group selected from the group consisting of an alkyl group, a sulfoalkyl group and a carboxyalkyl group;

$X_1^-$ represents an electric charge balancing counter ion; and m represents an integer of from 1 to 2, such that m represents the integer 1 when at least one of $R_5$ and $R_6$ represents a group selected from the group consisting of a sulfoalkyl group and carboxyalkyl group.

19. A silver halide photographic material as claimed in claim 1, wherein said compound of general formula (I') is represented by the following formula (X):

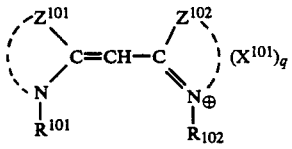

(X)

wherein $Z^{101}$ and $Z^{102}$, which may be the same or different, each represents a group of non-metallic atoms required to complete a benzoxazole nucleus, a benzothiazole nucleus or a naphthoxazole nucleus, $R^{101}$ and $R^{102}$, which may be the same or different, each represents an alkyl group, $X^{101}$ represents an electric charge balancing counter ion, and q is 0 or 1.

20. A silver halide photographic material as claimed in claim 19, wherein said compound of formula (X) is represented by the following formula (X'):

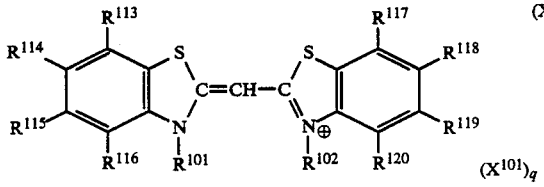

(X')

wherein $R^{101}$ and $R^{102}$, which may be the same or different, each represents an alkyl group, $X^{101}$ represents an electric charge balancing counter ion, q is 0 or 1, and $R^{113}$, $R^{114}$, $R^{115}$, $R^{116}$, $R^{117}$, $R^{118}$, $R^{119}$ and $R^{120}$, which may be the same or different, each represents a hydrogen atom, a halogen atom, a nitro group, an alkyl group, an aryl group, an alkoxy group, a carboxy group, an alkoxycarbonyl group, a hydroxy group or a cyano group.

21. A method for forming a superhigh contrast negative image as claimed in claim 7, wherein said compound of formula (I') is represented by the following formula (X):

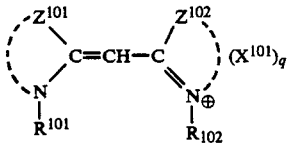

(X)

wherein $Z^{101}$ and $Z^{102}$, which may be the same or different, each represents a group of non-metallic atoms required to complete a benzoxazole nucleus, a benzothiazole nucleus or a naphthoxazole nucleus, $R^{101}$ and $R^{102}$, which may be the same or different, each represents an alkyl group, $X^{101}$ represents an electric charge balancing counter ion, and q is 0 or 1.

22. A method for forming a superhigh contrast negative image as claimed in claim 21, wherein said compound of formula (X) is represented by the following formula (X'):

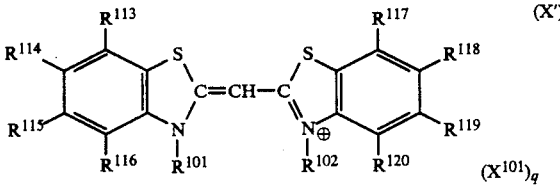

(X')

wherein $R^{101}$ and $R^{102}$, which may be the same or different, each represents an alkyl group, $X^{101}$ represents an electric charge balancing counter ion, q is 0 or 1, and $R^{113}$, $R^{114}$, $R^{115}$, $R^{116}$, $R^{117}$, $R^{118}$, $R^{119}$ and $R^{120}$, which may be the same or different, each represents a hydrogen atom, a halogen atom, a nitro group, an alkyl group, an aryl group, an alkoxy group, a carboxy group, an alkoxycarbonyl group, a hydroxy group or a cyano group.

23. A silver halide photographic material as claimed in claim 1, wherein said cyanine or merocyanine dye having an adsorption maximum in the visible region is

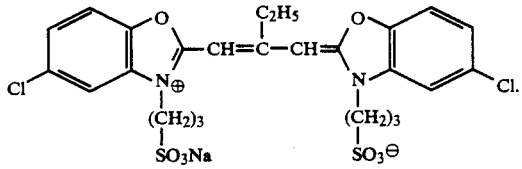

24. A silver halide photographic material as claimed in claim 1, wherein said cyanine or merocyanine dye having an adsorption maximum in the visible region is

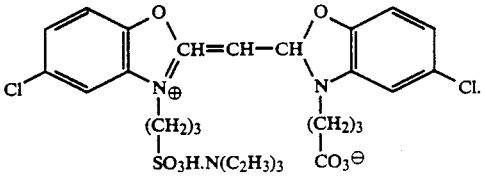

25. A silver halide photographic material as claimed in claim 1, wherein said cyanine or merocyanine dye having an adsorption maximum in the visible region is

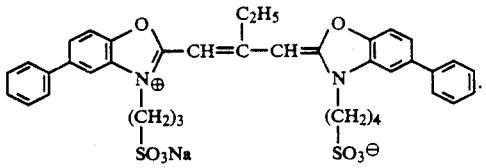

26. A method for forming a high contrast negative image as claimed in claim 7, wherein said cyanine or merocyanine dye having an absorption maximum in the visible region is

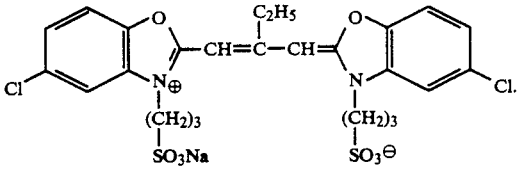

27. A method for forming a high contrast negative image as claimed in claim 7, wherein said cyanine or merocyanine dye having an absorption maximum in the visible region is

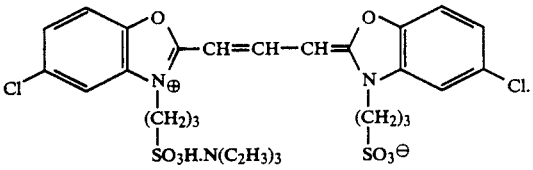

28. A method for forming a high contrast negative image as claimed in claim 7, wherein said cyanine or merocyanaine dye having an absorption maximum in the visible region is

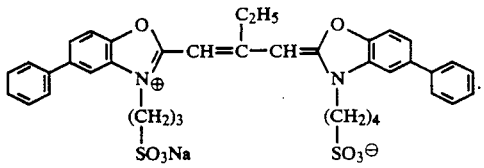

* * * * *